US006696237B1

(12) United States Patent
Yoshioka et al.

(10) Patent No.: US 6,696,237 B1
(45) Date of Patent: Feb. 24, 2004

(54) PHOTOTHERMOGRAPHIC MATERIAL

(75) Inventors: Yasuhiro Yoshioka, Minami-Ashigara (JP); Makoto Suzuki, Minami-Ashigara (JP)

(73) Assignee: Fuji Photo Film Co., Ltd., Ninami-Ashigara (JP)

( * ) Notice: Subject to any disclaimer, the term of this patent is extended or adjusted under 35 U.S.C. 154(b) by 39 days.

(21) Appl. No.: 09/695,864

(22) Filed: Oct. 26, 2000

(30) Foreign Application Priority Data

Oct. 26, 1999 (JP) ..... 11-304347
Jan. 28, 2000 (JP) ..... 2000-020744

(51) Int. Cl.[7] ..... G03C 1/498
(52) U.S. Cl. ..... 430/619; 430/610
(58) Field of Search ..... 430/619, 607, 430/613, 614, 610, 612

(56) References Cited

U.S. PATENT DOCUMENTS 3,544,336 A * 12/1970 Milton
5,460,938 A * 10/1995 Kirk et al. ..... 430/619
5,637,449 A 6/1997 Harring et al.
5,677,121 A * 10/1997 Tsuzuki ..... 430/619
6,174,663 B1 * 1/2001 Kato ..... 430/619
6,248,512 B1 * 6/2001 Miura et al. ..... 430/619

FOREIGN PATENT DOCUMENTS

EP 0 803 764 A1 10/1997

* cited by examiner

*Primary Examiner*—Thorl Chea

(57) ABSTRACT

Disclosed is a photothermographic material comprising, on one side of a support, a photosensitive silver halide, a non-photosensitive silver salt of an organic acid, a reducing agent for silver ions and a binder, which is characterized by containing one or more phenol compounds as the reducing agent and one or more compounds satisfying at least one of the following requirements A and B in combination:

A: the hydrogen bond formation rate constant Kf is 20–4000,

B: the chemical structure is represented by the following formula (II), (III), (IV) or (V) ($R^{21}$ and others represent an alkyl group etc.), or has a phosphoryl group. According to the present invention, there is provided a photothermographicmaterial that can provide sufficient image density at practical reaction temperatures (specifically 100–140° C.) with practical reaction times (specifically 1–30 seconds), and can sufficiently suppress coloration of blank portions during storage in the dark after development.

(II)

(III)

(IV)

(V)

6 Claims, 2 Drawing Sheets

PHOTOTHERMOGRAPHIC MATERIAL

FIELD OF THE INVENTION

The present invention relates to a photothermographic material. In particular, it relates to a photothermographic material that can provides sufficient image density and can sufficiently suppress coloration of blank portions during storage in the dark after development.

BACKGROUND OF THE INVENTION

In recent years, reduction of amount of waste processing solutions is strongly desired in the medical diagnosis field and the photographic art field from the standpoints of environmental protection and space savings. Techniques relating to photosensitive thermographic materials for use in medical diagnosis and photographic-art processes are required which enables efficient exposure by a laser image setter or a laser imager and formation of a clear black image having high resolution and sharpness. The photosensitive thermographic materials can provide users with a simple and non-polluting heat development processing system that eliminates the use of solution-type processing chemicals.

The same is demanded in the field of ordinary image-forming materials. However, photo-images for medical use require high image quality excellent in sharpness and graininess as they need very fine images. In addition, for easy diagnosis, cold monochromatic images are preferred. At present, various types of hard copy systems using pigment and dye, for example, ink jet printers and electrophotographic systems are available as ordinary imaging systems. However, no satisfactory image-forming system is available for medical use.

Meanwhile, methods utilizing a silver salt of an organic acid for forming an image by heat development are described, for example, in U.S. Pat. Nos. 3,152,904 and 3,457,075 and D. Klostervoer, "Thermally Processed Silver Systems", Imaging Processes and Materials, Neblette, 8th ed., compiled by J. Sturge, V. Walworth and A. Shepp, Chapter 9, p.279, (1989). The photothermographic material, in particular, comprises a image-forming layer (photosensitive layer) containing a photocatalyst (e.g., silver halide) in a catalytically active amount, a reducing agent, a reducible silver salt (e.g., silver salt of an organic acid), and optionally a toning agent for controlling tone of silver, which are usually dispersed in a binder matrix. When the photothermographic material is heated at a high temperature (e.g., 80° C. or higher) after imagewise light exposure, a monochromatic black silver image is produced through an oxidation-reduction reaction between the silver halide or the reducible silver salt (which functions as an oxidizing agent) and the reducing agent. The oxidation-reduction reaction is accelerated by catalytic action of a latent image of silver halide generated upon exposure. Therefore, the monochromatic silver images are formed in exposed areas of the materials. This technique is disclosed in many references including U.S. Pat. No. 2,910,377 and Japanese Patent Publication (Kokoku, hereinafter referred to as JP-B) 43–4924, and Fuji Medical Dry Imager FM-DP L was put into the market as an image-forming system for medical diagnosis utilizing photothermographic materials.

Because the aforementioned photothermographic materials are not subjected to fixation after heat development, the thermally reactive organic acid silver salt and reducing agent are left in the photothermographic materials as they are. Thus, they suffer a problem that blank portions thereof are colored if the materials are stored for a long period of time after the heat development. Phenol type reducing agents (see, for example, European Patent Publication EP0803764A1, Japanese Patent Laid-open Publication (Kokai, hereinafter referred to as JP-A) 51-51933, JP-A-6-3793 etc.) are effectively used for the photothermographic materials because of their high reactivity, and the coloration of blank portions can effectively be suppressed by reducing the amount thereof to be used. However, if the amount of o-bisphenol type reducing agent to be used is reduced, it becomes impossible to obtain sufficient image density, and thus image storability is difficult to be compatible with image density.

SUMMARY OF THE INVENTION

Therefore, an object of the present invention is to provide a photothermographic material that can provide sufficient image density at practical reaction temperatures (specifically 100–140° C.) with practical reaction times (specifically 1–30 seconds), and can sufficiently suppress coloration of blank portions during storage in the dark after development.

The inventors of the present invention conducted extensive studies to achieve the aforementioned object. As a result, they found that, if a phenol compound, which is used as a reducing agent, and a compound having a particular hydrogen bond formation rate constant were used in combination in photothermographic materials, sufficient image density could be obtained and image storability could be markedly improved without substantially degrading the reducing property. Thus, they accomplished the present invention.

That is, the present invention provides a photothermographic material comprising, on one side of a support, a photosensitive silver halide, a non-photosensitive silver salt of an organic acid, a reducing agent for silver ions and a binder, wherein it contains one or more phenol compounds as the reducing agent and one or more compounds satisfying at least one of the following requirements A and B in combination:

A: the hydrogen bond formation rate constant Kf is 20–4000,

B: the chemical structure is represented by the following formula (II), (III), (IV) or (V), or has a phosphoryl group:

(II)

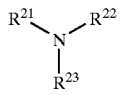

(III)

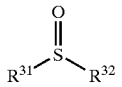

(IV)

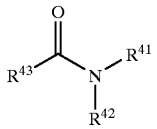

(V)

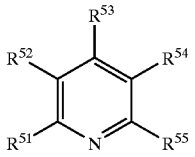

In the formula (II), $R^{21}$ and $R^{22}$ independently represent an alkyl group, and $R^{23}$ represents an alkyl group, an aryl group or a heterocyclic group. Two or more of $R^{21}$, $R^{22}$ and $R^{23}$ may be taken together to form a ring.

In the formula (III), $R^{31}$ and $R^{32}$ independently represent an alkyl group, an aryl group or a heterocyclic group. $R^{31}$ and $R^{32}$ may be taken together to form a ring.

In the formula (IV), $R^{41}$ and $R^{42}$ independently represent an alkyl group, an aryl group or a heterocyclic group. $R^{43}$ represents an alkyl group, an aryl group, a heterocyclic group or —N($R^{44}$) ($R^{45}$). $R^{44}$ and $R^{45}$ independently represent an alkyl group, an aryl group or a heterocyclic group. Two or more of $R^{41}$, $R^{42}$, $R^{43}$, $R^{44}$ and $R^{45}$ may be taken together to form a ring.

In the formula (V), $R^{51}$, $R^{52}$, $R^{53}$, $R^{54}$ and $R^{55}$ independently represent a hydrogen atom or a substituent. Two or more of $R^{51}$, $R^{52}$, $R^{53}$, $R^{54}$ and $R^{55}$ may be taken together to form a ring.

The phenol compound contained in the photothermographic material of the present invention is preferably an o-polyphenol compound, in particular, a compound represented by the following formula (I).

(I)

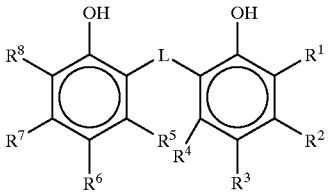

In the formula, $R^1$, $R^2$, $R^3$, $R^4$, $R^5$, $R^6$, $R^7$ and $R^8$ independently represent a hydrogen atom or a group that can substitute on a benzene ring, and L represents a group —S— or a group —$CHR^9$— where $R^9$ represents a hydrogen atom or an alkyl group.

As the compound represented by the formula (I), preferred are those compounds where $R^2$, $R^4$, $R^5$ and $R^7$ are hydrogen atoms, $R^1$ and $R^8$ independently represents an alkyl group, $R^3$ and $R^6$ independently represents an alkyl group, and L is —$CHR^9$—. Particularly preferred are those compounds where $R^1$ and $R^8$ independently represent a secondary or tertiary alkyl group.

The photothermographic material of the present invention preferably contains a compound of which hydrogen bond formation rate constant Kf is 70 to 4000.

Further, the photothermographic material of the present invention preferably contains an o-polyphenol compound and one or more compounds having a phosphoryl. The compound having a phosphoryl group is preferably a compound represented by the following formula (VI):

(IV)

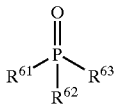

In the formula, $R^{61}$, $R^{62}$ and $R^{63}$ independently represent an alkyl group, an aryl group, an aralkyl group, an alkoxy group, an aryloxy group, an amino group or a heterocyclic group.

In the present specification, "–" indicates a range including numerical values mentioned before and after it as the minimum and maximum values, respectively.

By using a phenolic compound and a compound having a hydrogen bond formation rate constant Kf of 20–4000 or represented by the formula (II), (III), (IV) or (V) or a compound having a phosphoryl group in combination, it became possible to provide a photothermographic material that can provide sufficient image density at a practical reaction temperature and within a practical reaction time, and can sufficiently suppress coloration of blank portions after development and storage in the dark.

PREFERRED EMBODIMENTS OF THE INVENTION

Figure 1:
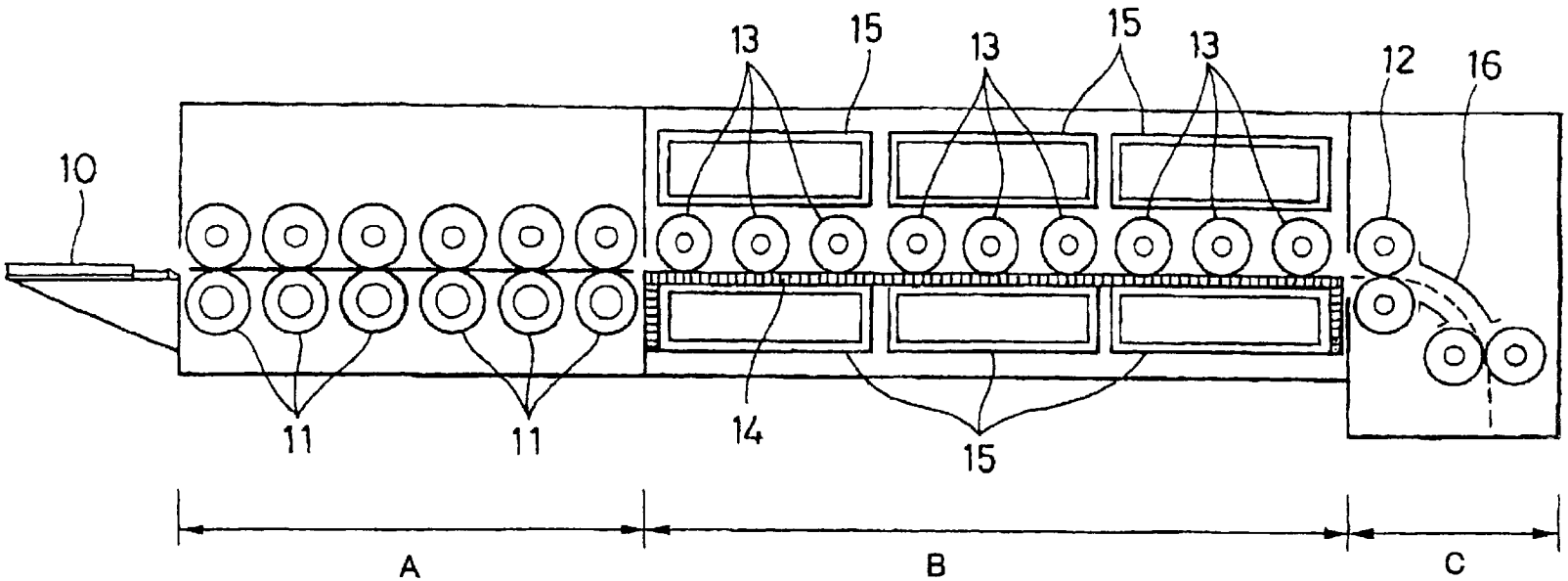
FIG. 1 is a side view of an exemplary heat developing apparatus used for the examples. In the figure, there are shown a photothermographic material 10, carrying-in roller pairs 11, carrying-out roller pairs 12, rollers 13, a flat surface 14, heaters 15, and guide panels 16. The apparatus consists of a preheating section A, a heat development section B, and a gradual cooling section C.

The photothermographic material of the present invention comprises, on one side of a support, a photosensitive silver halide, a non-photosensitive silver salt of an organic acid, a reducing agent for silver ions and a binder. It is characterized by containing (1) one or more phenol compounds as the reducing agent, and (2) one or more compounds satisfying at least one of the requirement A (it has a hydrogen bond formation rate constant Kf of 20–4000) and the requirement B (it has a structure represented by the aforementioned formula (II), (III), (IV) or (V), or has a phosphoryl group), in combination.

The photothermographic material of the present invention contains one or more phenol compounds. It is known that a phenol compound is used as a reducing agent as seen in European Patent Publication EP0803764A1, JP-A-51-51933, JP-A-6-3793 and so forth, and such known phenol compounds can be used for the present invention.

As a result of the extensive study of the present inventors, it was found that, if such a known reducing agent and a compound represented by the formula (II), (III), (IV) or (V) or a compound having a phosphoryl group were used in combination, there could be obtained a surprising effect that image storability could be markedly improved with substantially maintaining the heat-developability.

As the phenol compound used for the present invention, o-polyphenol compounds are preferred because of their high heat-developability.

The "o-polyphenol compound" referred to in the present specification may be any compound, so long as it is a reducing agent containing the following structure.

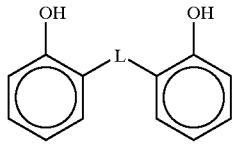

Among such compounds, those compounds of the formula (I) are preferred because of their higher heat-developability. The compounds of the formula (I) will be explained in detail.

In the formula (I), $R^1$ to $R^8$ independently represent a hydrogen atom or a group that can substitute on a benzene ring. Examples of the group that can substitute on a benzene ring include a halogen atom, an alkyl group, an aryl group, an aralkyl group, an alkoxy group, an acylamino group, a sulfonamide group, an acyl group, a carbamoyl group, a sulfamoyl group, an alkoxycarbonyl group, a sulfonyl group, an alkoxyalkyl group, an acylaminoalkyl group and so forth. Examples of the alkyl group include methyl group, ethyl group, propyl group, butyl group, isopropyl group, t-butyl group, t-amyl group, cyclohexyl group, 1-methylcyclohexyl group and so forth. Examples of the aralkyl group include benzyl group and so forth.

Preferably, $R^1$, $R^3$, $R^6$ and $R^8$ independently represent an alkyl group, more preferably a primary alkyl group having 1–20 carbon atoms, a secondary alkyl group having 3–20 carbon atoms, or a tertiary alkyl group having 4–20 carbon atoms.

These groups may further have one or more suitable substituents. Examples of the substituents include a halogen atom, an aryl group, a heterocyclic group, an alkoxy group, an aryloxy group, an alkylthio group, an arylthio group, a hydroxyl group, an acyloxy group, an amino group, an alkoxycarbonyl group, an acyl group, an acylamino group, an oxycarbonyl group, a carbamoyl group, a sulfonyl group, a sulfamoyl group, a sulfonamide group, a phosphoryl group, a carboxyl group and so forth.

Examples of the primary alkyl group include methyl group, ethyl group, propyl group, butyl group, pentyl group, hexyl group, heptyl group, octyl group, nonyl group, decyl group, dodecyl group, benzyl group, methoxymethyl group, 2-methoxyethyl group, phenethyl group, hexyloxycarbonylmethyl group and so forth. Preferred are methyl group and ethyl group.

Examples of the secondary alkyl group include isopropyl group, cyclohexyl group, cyclopentyl group, 1-methoxymethyl-ethyl group, 1-butoxyethyl-ethyl group and so forth. Preferred are unsubstituted secondary alkyl groups, and particularly preferred are isopropyl group and cyclohexyl group.

Examples of the tertiary alkyl group include t-butyl group, t-amyl group, t-octyl group, 1-methylcyclohexyl group, 1-methylcyclopentyl group, 1-methylcyclopropyl group, 1-methyl-1-phenylethyl group, 1,1-dimethyl-4-hexyloxycarbonylbutyl group and so forth. Preferred are unsubstituted tertiary alkyl groups, particularly preferred are t-butyl group and 1-methylcyclohexyl group, and the most preferred is t-butyl group.

Preferably, $R^1$ and $R^8$ independently represent a secondary alkyl group or a tertiary alkyl group. If a secondary alkyl group or a tertiary alkyl group is selected, coating amount can be markedly reduced, and hence the production cost of the photothermographic material and labors may be markedly reduced. Further, if a secondary alkyl group or a tertiary alkyl group is selected, image storability is extremely degraded, unless a compound having a phosphoryl group is used in combination. However, by using them in combination according to the present invention, the image storability is markedly improved. In view of development activity, tertiary alkyl groups are preferred as $R^1$ and $R^8$. While $R^1$ and $R^8$ may be identical or different, they are preferably identical to each other.

As $R^3$ and $R^6$, unsubstituted alkyl groups are preferred. Specific examples thereof include methyl group, ethyl group, propyl group, butyl group, isopropyl group, t-butyl group, t-amyl group, cyclohexyl group, 1-methylcyclohexyl group and so forth. More preferred are methyl group, ethyl group, isopropyl group and t-butyl group, and most preferred are methyl group and ethyl group.

Preferably, $R^2$, $R^4$, $R^5$ and $R^7$ independently represent a hydrogen atom, a halogen atom or an alkyl group, more preferably a hydrogen atom.

L represents a group —S— or a group —$CHR^9$— where $R^9$ represents a hydrogen atom or an alkyl group. The alkyl group is preferably one having 1–20 carbon atoms, which may be unsubstituted or substituted with another or other substituents. Examples of the unsubstituted alkyl group include methyl group, ethyl group, propyl group, butyl group, heptyl group, undecyl group, isopropyl group, 1-ethylpentyl group, 2,4,4-trimethylpentyl group and so forth. Examples of the substituent for the alkyl group are similar to those mentioned for $R^1$, $R^3$, $R^6$ and $R^8$. $R^9$ is more preferably a hydrogen atom or an unsubstituted alkyl group having 1–12 carbon atoms, further preferably a hydrogen atom or an alkyl group having 1–7 carbon atoms, particularly preferably a hydrogen atom, methyl group or n-propyl group.

Specific examples of the phenol compound of the formula (I) used for the present invention will be listed below. However, the phenol compounds that can be used for the present invention are not limited to these.

(I-1)

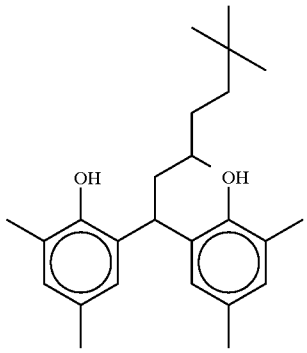

(I-2)

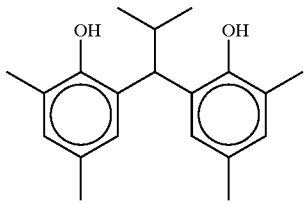

-continued
(I-3)
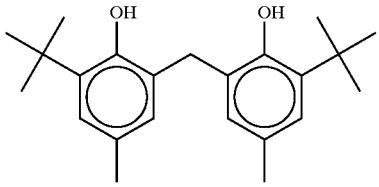
(I-4)
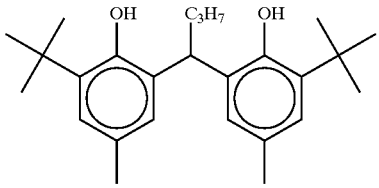
(I-5)
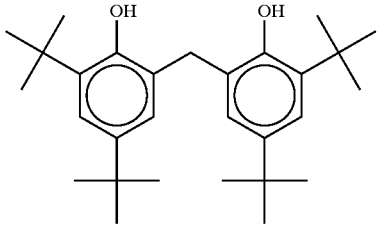
(I-6)
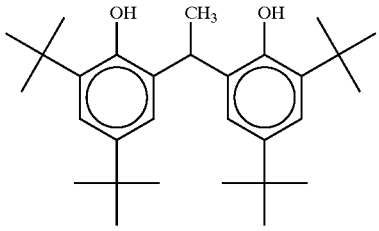
(I-7)
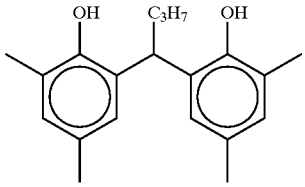
(I-8)
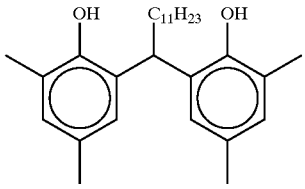
(I-9)
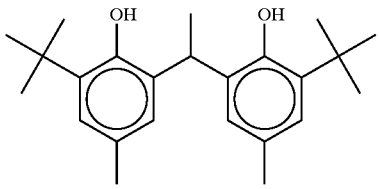
-continued
(I-10)
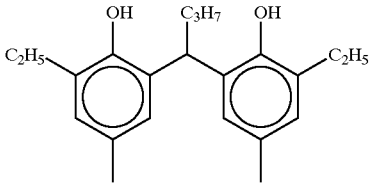
(I-11)
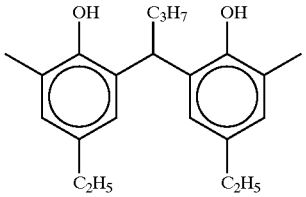
(I-12)
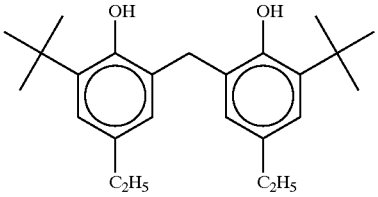
(I-13)
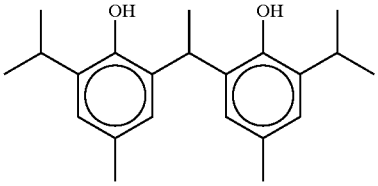
(I-14)
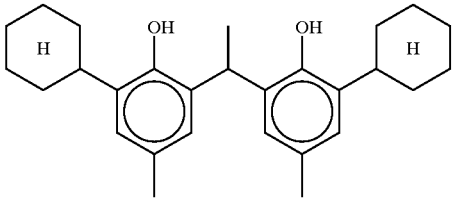
(I-15)
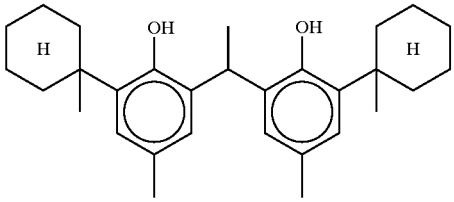
(I-16)
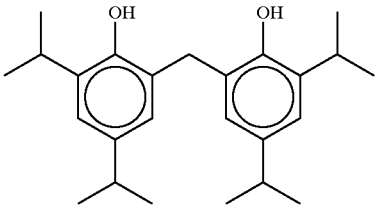
(I-17)
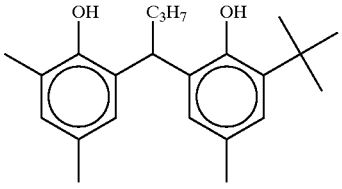

-continued
(I-18)
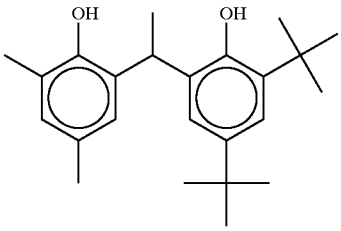
(I-19)
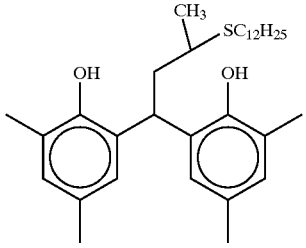
(I-20)
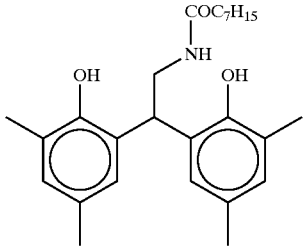
(I-21)
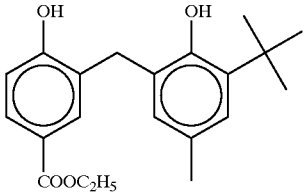
(I-22)
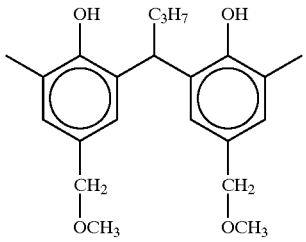
(I-23)
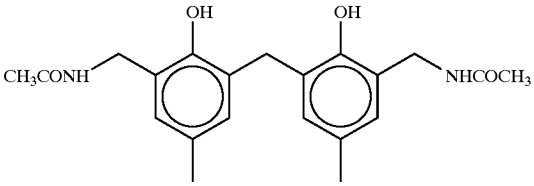
-continued
(I-24)
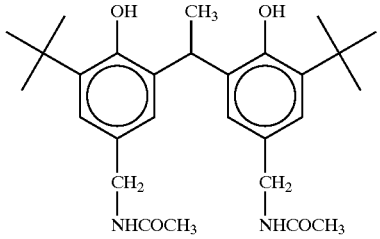
(I-25)
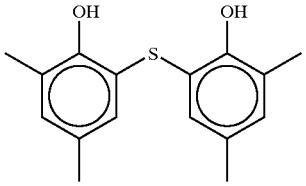
(I-26)
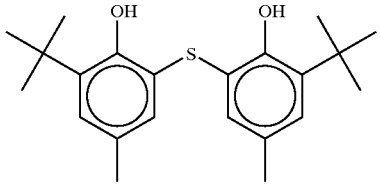
(I-27)
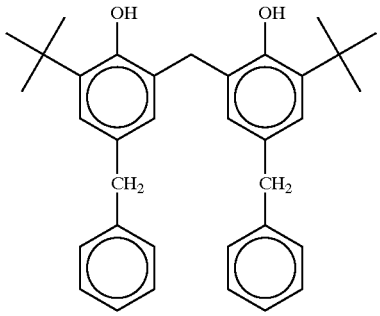
(I-28)
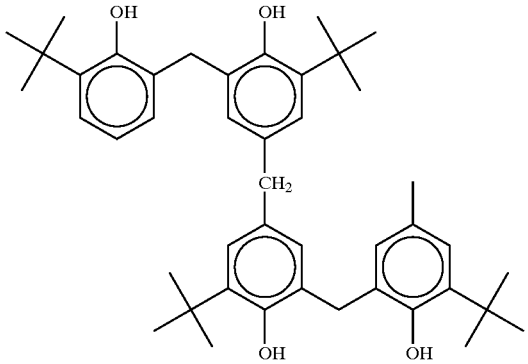
(I-29)
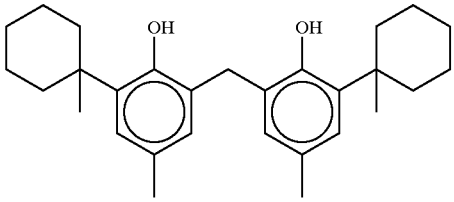

-continued (I-30)

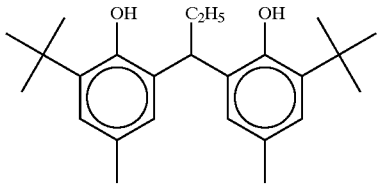

(I-31)

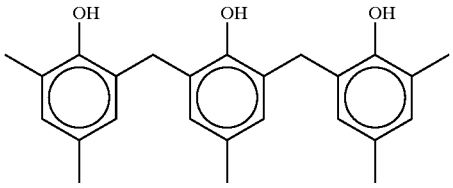

(I-32)

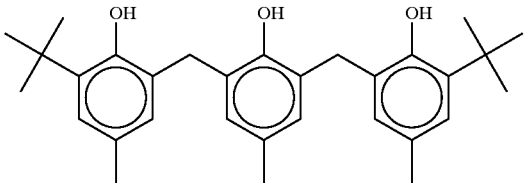

(I-33)

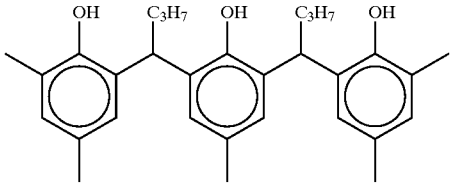

(I-34)

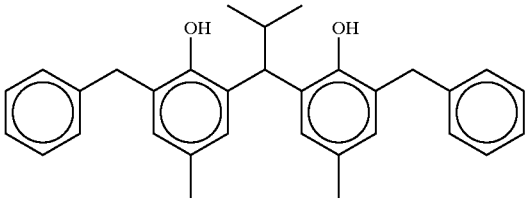

Other than the above compounds, specific examples of the phenol compound used for the present invention are also seen in European Patent Publication EP0803764A1, JP-A-51-51933 and JP-A-6-3793.

The addition amount of the phenol compound is preferably 0.01–4.0 g/$M^2$, more preferably 0.1–2.0 g/$m^2$. With respect to one mole of silver on the surface having the image-forming layer, it is preferably 2–40 mole %, more preferably 5–30 mole %.

Now, the compound having a hydrogen bond formation rate constant Kf of 20–4000 will be explained.

The hydrogen bond formation rate constant Kf, which is used as an index of hydrogen bond formation, is a constant that was examined by R. W. Taft et al. in J. Am. Chem. Soc., 91, 4794 (1969), etc. This is a reaction rate constant in a reaction where a hydrogen bond is formed between p-$FC_6H_4OH$ and a compound, and it is measured by F-NMR or IR or by using a thermodynamic technique. Specific hydrogen bond formation rate constants Kf of various compounds are mentioned in the aforementioned J. Am. Chem. Soc., 91, 4794 (1969). In the present invention, Kf is preferably 20–4000, more preferably 70–4000, further preferably 100–4000, particularly preferably 250–2000. Typical examples of compounds having a hydrogen bond formation rate constant Kf of 20–4000 are listed below.

| | Kf |
|---|---|
| Hexamethylphosphamide | 3600 |
| Triphenylphosphine oxide | 1456 ± 80 |
| 4-Dimethylaminopyridine | 650 ± 90 |
| Dimethyl sulfoxide | 338 ± 7 |
| 2,6-Dimethyl-γ-pyrone | 318 ± 18 |
| Tetramethylurea | 261 ± 5 |
| Trimethyl phosphate | 250 ± 8 |
| N,N-Dimethylacetamide | 242 ± 6 |
| N,N-Dimethylbenzamide | 167 ± 16 |
| Phenyl methyl sulfoxide | 141 ± 4 |
| 4-Methoxypyridine | 139 ± 2 |
| 4-Methylpyridine | 107 ± 2 |
| N,N-Dimethylcyclohexylamine | 118 ± 2 |
| N,N-Dimethylformamide | 115 ± 2 |
| Diphenyl sulfoxide | 106 ± 2 |
| Flavone | 98 ± 6 |
| N,N-Dimethyl-n-propylamine | 95 ± 1 |
| Trimethylamine | 85 ± 2 |
| 2-n-Butylpyridine | 76 ± 2 |
| Pyridine | 76 ± 1 |
| Quinoline | 71 ± 3 |
| Tri-n-butylamine | 37 ± 3 |
| N,N-Dimethylbenzylamine | 38 ± 3 |
| Pyrimidine | 22.5 ± 0.5 |

The compound of the formula (II) will be explained in detail hereafter.

In the formula (II), $R^{21}$ and $R^{22}$ independently represent an alkyl group. $R^{23}$ represents an alkyl group, an aryl group or a heterocyclic group. These groups may be unsubstituted or may be substituted with one or more substituents . Examples of the substituents include those substituents mentioned hereinafter for $R^{51}$. As specific examples of $R^{21}$ and $R^{22}$, there can be mentioned methyl group, ethyl group, propyl group, butyl group, isopropyl group, t-butyl group, t-amyl group, cyclohexyl group, 1-methylcyclohexyl group, benzyl group and so forth as the alkyl group, phenyl group, p-tolyl group, p-methoxyphenyl group and so forth as the aryl group, 2-tetrahydrofuranyl group, 4-pyridyl group and so forth as the heterocyclic group. These groups may be unsubstituted or may be substituted with one or more other substituents. The alkyl group referred to herein does not include an alkenyl group or an alkynyl group. Two or more of $R^{21}$, $R^{22}$ and $R^{23}$ may be taken together to form a ring.

The compound of the formula (III) will be explained in detail hereafter.

In the formula (III), $R^{31}$ and $R^{32}$ independently represent an alkyl group, an aryl group or a heterocyclic group. These groups may be unsubstituted or may be substituted with one or more substituents. Examples of the substituents include those substituents mentioned hereinafter for $R^{51}$. As specific examples of $R^{31}$ and $R^{32}$, there can be mentioned methyl group, ethyl group, propyl group, butyl group, isopropyl group, t-butyl group, t-amyl group, cyclohexyl group, 1-methylcyclohexyl group, benzyl group and so forth as the alkyl group, phenyl group, p-tolyl group, p-methoxyphenyl group and so forth as the aryl group, 2-tetrahydrofuranyl group, 4-pyridyl group and so forth as the heterocyclic group. These substituents may be unsubstituted or may be substituted with one or more other substituents. $R^{31}$ and $R^{32}$ may be taken together to form a ring.

The compound of the formula (IV) will be explained in detail hereafter.

In the formula (IV), $R^{41}$ and $R^{42}$ independently represent an alkyl group, an aryl group or a heterocyclic group. $R^{43}$ represents an alkyl group, an aryl group, a heterocyclic group or —N($R^{44}$) ($R^{45}$). $R^{44}$ and $R^{45}$ independently represent an alkyl group, an aryl group or a heterocyclic group. These groups may be unsubstituted or may be substituted with one or more substituents. Examples of the substituents include those substituents mentioned hereinafter for $R^{51}$. As specific examples of $R^{41}$, $R^{42}$ and $R^{43}$, there can be mentioned methyl group, ethyl group, propyl group, butyl group, isopropyl group, t-butyl group, t-amyl group, cyclohexyl group, 1-methylcyclohexyl group, benzyl group and so forth as the alkyl group, phenyl group, p-tolyl group, p-methoxyphenyl group and so forth as the aryl group, 2-tetrahydrofuranyl group, 4-pyridyl group and so forth as the heterocyclic group. These substituents may be unsubstituted or may be substituted with one or more other substituents. Two or more of $R^{41}$, $R^{42}$, $R^{43}$, $R^{44}$ and $R^{45}$ may be taken together to form a ring.

The compound of the formula (V) will be explained in detail hereafter.

In the formula (V), $R^{51}$, $R^{52}$, $R^{53}$, $R^{54}$ and $R^{55}$ independently represent a hydrogen atom or a substituent. Examples of the substituent include a linear, branched or cyclic alkyl group, a linear, branched or cyclic alkenyl group, an alkynyl group, an aryl group, an acyloxy group, an alkoxycarbonyloxy group, an aryloxycarbonyloxy group, a carbamoyloxy group, a carbonamide group, a sulfonamide group, a carbamoyl group, a sulfamoyl group, an alkoxy group, an aryloxy group, an aryloxycarbonyl group, an alkoxycarbonyl group, an N-acylsulfamoyl group, an N-sulfamoylcarbamoyl group, an alkylsulfonyl group, an arylsulfonyl group, an alkoxycarbonylamino group, an aryloxycarbonylamino group, an amino group, an ammonio group, a cyano group, a nitro group, a carboxyl group, a hydroxy group, a sulfo group, a mercapto group, an alkylsulfinyl group, an arylsulfinyl group, an alkylthio group, an arylthio group, a ureido group, a heterocyclic group (for example, 3- to 12-membered monocycles or condensed cycles containing at least one nitrogen atom, oxygen atom, sulfur atom or the like), a heterocyclyloxy group, a heterocyclylthio group, an acyl group, a sulfamoylamino group, a silyl group, a halogen atom and so forth.

Specific examples of the substituent include a hydrogen atom, a linear, branched or cyclic alkyl group having 1–10 carbon atoms (e.g., trifluoromethyl, methyl, ethyl, propyl, heptafluoropropyl, isopropyl, butyl, t-butyl, t-pentyl, cyclopentyl, cyclohexyl, octyl, 2-ethylhexyl etc.), a linear, branched or cyclic alkenyl group having 2–10 carbon atoms (e.g., vinyl, 1-methylvinyl, cyclohexen-1-yl etc.), an alkynyl group having 2–10 carbon atoms (e.g., ethynyl, 1-propynyl etc.), an aryl group having 6–14 carbon atoms (e.g., phenyl, naphthyl etc.), an acyloxy group having 1–10 carbon atoms (e.g., acetoxy, benzoyloxy etc.), an alkoxycarbonyloxy group having 2–10 carbon atoms (e.g., methoxycarbonyloxy group, 2-methoxyethoxycarbonyloxy group etc.), an aryloxycarbonyloxy group having 7–14 carbon atoms (e.g., phenoxycarbonyloxy group etc.), a carbamoyloxy group having 1–12 carbon atoms (e.g., N,N-dimethylcarbamoyloxy etc.), a carbonamide group having 1–12 carbon atoms (e.g., formamide, N-methylacetamide, acetamide, N-methylformamide, benzamide etc.), a sulfonamido group having 1–10 carbon atoms (e.g., methanesulfonamido, benzenesulfonamido, p-toluenesulfonamido etc.), a carbamoyl group having 1–10 carbon atoms (e.g., N-methylcarbamoyl, N,N-diethylcarbamoyl, N-mesylcarbamoyl etc.), a sulfamoyl group having 0–10 carbon atoms (e.g., N-butylsulfamoyl, N,N-diethylsulfamoyl, N-methyl-N-(4-methoxyphenyl) sulfamoyl etc.), an alkoxy group having 1–10 carbon atoms (e.g., methoxy, propoxy, isopropoxy, octyloxy, t-octyloxy etc.), an aryloxy group having 6–14 carbon atoms (e.g., phenoxy, 4-methoxyphenoxy, naphthoxy etc.), an aryloxycarbonyl group having 7–14 carbon atoms (e.g., phenoxycarbonyl, naphthoxycarbonyl etc.) an alkoxycarbonyl group having 2–10 carbon atoms (e.g., methoxycarbonyl, t-butoxycarbonyl etc.), an N-acylsulfamoyl group having 1–12 carbon atoms (e.g., N-ethylsulfamoyl, N-benzoylsulfamoyl etc.), an N-sulfamoylcarbamoyl group having 1–12 carbon atoms (e.g., N-methanesulfonylcarbamoyl group etc.), an alkylsulfonyl group having 1–10 carbon atoms (e.g., methanesulfonyl, octylsulfonyl, 2-methoxyethylsulfonyl etc.), an arylsulfonyl group having 6–14 carbon atoms (e.g., benzenesulfonyl, p-toluenesulfonyl, 4-phenylsulfonylphenylsulfonyl etc.), an alkoxycarbonylamino group having 2–10 carbon atoms (e.g., ethoxycarbonylamino etc.), an aryloxycarbonylamino group having 7–14 carbon atoms (e.g., phenoxycarbonylamino, naphthoxycarbonylamino etc.), an amino group having 0–10 carbon atoms (e.g., amino, methylamino, diethylamino, diisopropylamino, anilino, morpholino etc.), an ammonio group having 3–12 carbon atoms (e.g., trimethylammonio group, dimethylbenzylammonio group etc.), a cyano group, a nitro group, a carboxyl group, a hydroxy group, a sulfo group, a mercapto group, an alkylsulfinyl group having 1–10 carbon atoms (e.g., methanesulfinyl, octanesulfinyl etc.), an arylsulfinyl group having 6–14 carbon atoms (e.g., benzenesulfinyl, 4-chlorophenylsulfinyl, p-toluenesulfinyl etc.), an alkylthio group having 1–10 carbon atoms (e.g., methylthio, octylthio, cyclohexylthio etc.), an arylthio group having 6–14 carbonatoms (e.g., phenylthio, naphthylthio etc.), a ureido group having 1–13 carbon atoms (e.g. 3-methylureido, 3,3-dimethylureido, 1,3-diphenylureido etc.), a heterocyclic group having 2–15 carbon atoms (a 3- to 12-membered monocycle or condensed cycle containing nitrogen, oxygen, sulfur etc. as a hetero atom, e.g., 2-furyl, 2-pyranyl, 2-pyridyl, 2-thienyl, 2-imidazolyl, morpholino, 2-quinolyl, 2-benzimidazolyl, 2-benzothiazolyl, 2-benzooxazolyl etc.), a heterocyclyloxy group (e.g., pyridyloxy, pyrazolyloxy etc.), a heterocyclylthio group (e.g., tetrazolylthio, 1,3,4-thiadiazolylthio, 1,3,4-oxadiazolylthio, benzimidazolylthio etc.), an acyl group having 1–12 carbon atoms (e.g., acetyl, benzoyl, trifluoroacetyl etc.), a sulfamoylamino group having 0–10 carbon atoms (e.g., N-butylsulfamoylamino, N-phenylsulfamoylamino etc.), a silyl group having 3–12 carbon atoms (e.g., trimethylsilyl, dimethyl-t-butylsilyl etc.), a halogen atom (e.g., fluorine atom, chlorine atom, bromine atom etc.) and so forth. The aforementioned substituents may further have one or more substituents, and examples of such substituents are those mentioned above. Two or more groups selected from $R^{51}$, $R^{52}$, $R^{53}$, $R^{54}$ and $R^{55}$ may be taken together to form a ring.

Specific examples of the electron-donative compounds used for the present invention, i.e., compounds of the formulas (II), (III), (IV) and (V), will be mentioned below. However, the present invention is not limited to these.

(1)

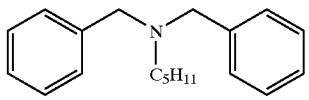

-continued
(2)
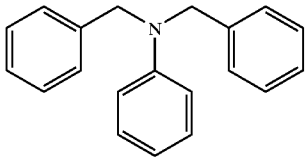
(3)
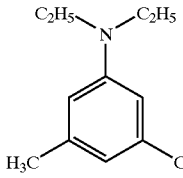
(4)
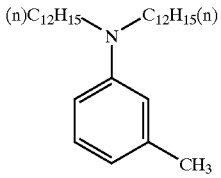
(5)
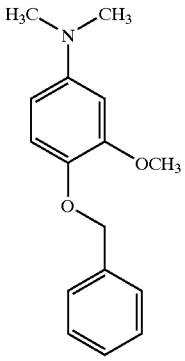
(6)
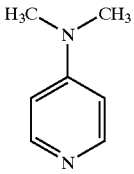
(7)
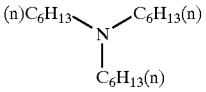
(8)
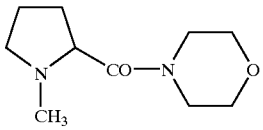
(9)
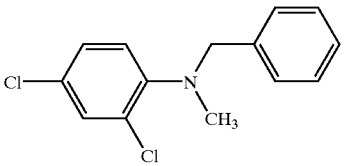
(10)
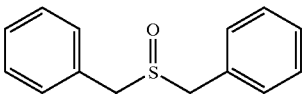
-continued
(11)
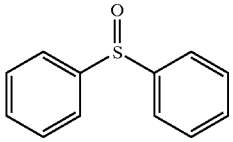
(12)
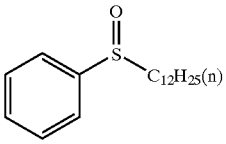
(13)
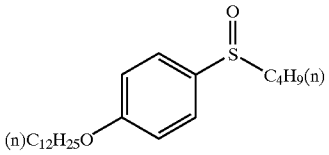
(14)
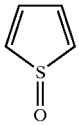
(15)
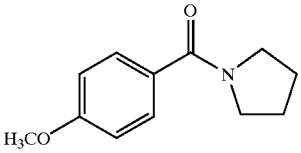
(16)
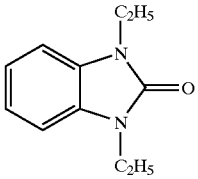
(17)
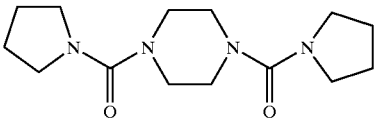
(18)
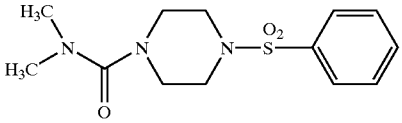
(19)
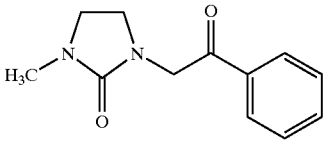
(20)
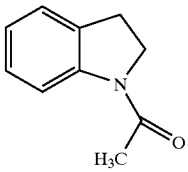

-continued (21)

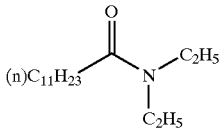

(22)

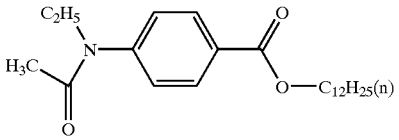

(23)

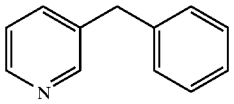

(24)

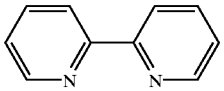

(25)

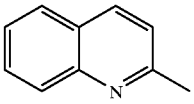

(26)

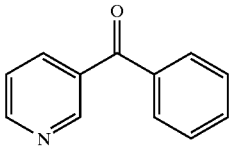

(27)

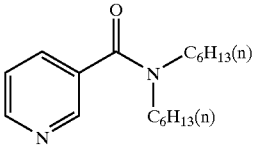

(28)

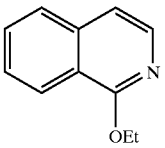

(29)

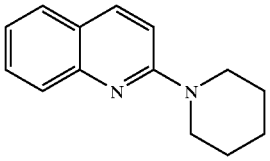

-continued (30)

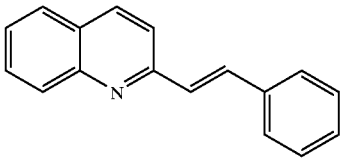

(31)

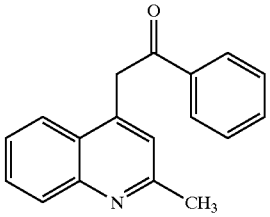

(32)

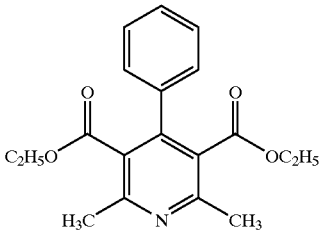

The "compound having a phosphoryl group" (it may be referred to as a "phosphoryl compound" hereafter) used for the present invention may be any compound so long as it is a compound having one or more phosphoryl groups. In particular, the compounds represented by the aforementioned formula (VI) are preferred.

In the formula (VI), $R^{61}$, $R^{62}$ and $R^{63}$ independently represent an alkyl group, an aryl group, an aralkyl group, an alkoxy group, an aryloxy group, an amino group or a heterocyclic group. These groups may be unsubstituted, or they may have one or more substituents.

Example of the alkyl group include methyl group, ethyl group, butyl group, octyl group, dodecyl group, isopropyl group, t-butyl group, t-amyl group, t-octyl group, cyclohexyl group, 1-methylcyclohexyl group and so forth. Examples of the aryl group include phenyl group, cresyl group, xylyl group, naphthyl group, 4-t-butylphenyl group, 4-t-octylphenyl group, 4-anisidyl group, 3,5-dichlorophenyl group and so forth. Examples of the aralkyl group include benzyl group, phenethyl group, 2-phenoxypropyl group and so forth. Examples the alkoxy group include methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group and so forth. Examples of the aryloxy group include phenoxy group, cresyloxy group, isopropylphenoxy group, 4-t-butylphenoxy group, naphthoxy group, biphenyloxy group and so forth. Examples of the amino group include dimethylamino group, diethylamino group, dibutylamino group, dioctylamino group, N-methyl-N-hexylamino group, dicyclohexylamino group, diphenylamino group, N-methyl-N-phenylamino group and so forth.

$R^{61}$, $R^{62}$ and $R^{63}$ preferably represent an alkyl group, an aryl group, an alkoxy group or an aryloxy group. More preferably, at least one of $R^{61}$, $R^{62}$ and $R^{63}$ represents an alkyl group or an aryl group, and further preferably two or more of them represent an alkyl group or an aryl group. It is preferred that $R^{61}$, $R^{62}$ and $R^{63}$ are the same groups from the point that such compounds are available at low cost. When $R^{61}$, $R^{62}$ and $R^{63}$ have a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group and so forth. Preferred substituents are a substituted or unsubstited alkyl group, aryl group, alkoxy group and aryloxy group, and examples thereof include, for example, methyl group, ethyl group, isopropyl group, t-butyl group, t-octyl group, phenyl group, 4-alkoxyphenyl group, 4-acyloxyphenyl group, methoxy group, phenoxy group and so forth.

As $R^{63}$, a phenyl group is preferred and a phenyl group one of which ortho positions is substituted is more preferred. More precisely, examples of the substituent at the ortho positions include a linear, branched or cyclic alkyl group, a linear, branched or cyclic alkenyl group, an alkynyl group, an aryl group, an acyloxy group, an alkoxycarbonyloxy group, an aryloxycarbonyloxy group, a carbamoyloxy group, a carbonamide group, a sulfonamide group, a carbamoyl group, a sulfamoyl group, an alkoxy group, an aryloxy group, an aryloxycarbonyl group, an alkoxycarbonyl group, N-acylsulfamoyl group, N-sulfamoylcarbamoyl group, an alkylsulfonyl group, an arylsulfonyl group, an alkoxycarbonylamino group, an aryloxycarbonylamino group, an amino group, an ammonio group, a cyano group, a nitro group, a carboxyl group, a hydroxy group, a sulfo group, a mercapto group, an alkylsulfinyl group, an arylsulfinyl group, an alkylthio group, an arylthio group, a ureido group, a heterocyclic group (for example, 3- to 12-membered monocycles or condensed cycles containing at least one nitrogen atom, oxygen atom, sulfur atom or the like), a heterocyclyloxy group, a heterocyclylthio group, an acyl group, a sulfamoylamino group, a silyl group, a halogen atom and so forth.

Specific examples of the substituent include a hydrogen atom, a linear, branched or cyclic alkyl group having 1–10 carbon atoms (e.g., trifluoromethyl, methyl, ethyl, propyl, heptafluoropropyl, isopropyl, butyl, t-butyl, t-pentyl, cyclopentyl, cyclohexyl, octyl, 2-ethylhexyl etc.), a linear, branched or cyclic alkenyl group having 2–10 carbon atoms (e.g., vinyl, 1-methylvinyl, cyclohexen-1-yl etc.), an alkynyl group having 2–10 carbon atoms (e.g., ethynyl, 1-propynyl etc.), an aryl group having 6–14 carbon atoms (e.g., phenyl, naphthyl etc.), an acyloxy group having 1–10 carbon atoms (e.g., acetoxy, benzoyloxy etc.), an alkoxycarbonyloxy group having 2–10 carbon atoms (e.g., methoxycarbonyloxy group, 2-methoxyethoxycarbonyloxy group etc.), an aryloxycarbonyloxy group having 7–14 carbon atoms (e.g., phenoxycarbonyloxy group etc.), a carbamoyloxy group having 1–12 carbon atoms (e.g., N,N-dimethylcarbamoyloxy etc.), a carbonamido group having 1–12 carbon atoms (e.g., formamido, N-methylacetamido, acetamido, N-methylformamido, benzamido etc.), a sulfonamido group having 1–10 carbon atoms (e.g., methanesulfonamido, benzenesulfonamido, p-toluenesulfonamido etc.), a carbamoyl group having 1–10 carbon atoms (e.g., N-methylcarbamoyl, N,N-diethylcarbamoyl, N-mesylcarbamoyl etc.), a sulfamoyl group having 0–10 carbon atoms (e.g., N-butylsulfamoyl, N,N-diethylsulfamoyl, N-methyl-N-(4-methoxyphenyl) sulfamoyl etc.), an alkoxy group having 1–10 carbon atoms (e.g., methoxy, propoxy, isopropoxy, octyloxy, t-octyloxy etc.), an aryloxy group having 6–14 carbon atoms (e.g., phenoxy, 4-methoxyphenoxy, naphthoxy etc.), an aryloxycarbonyl group having 7–14 carbon atoms (e.g., phenoxycarbonyl, naphthoxycarbonyl etc.), an alkoxycarbonyl group having 2–10 carbon atoms (e.g., methoxycarbonyl, t-butoxycarbonyl etc.), an N-acylsulfamoyl group having 1–12 carbon atoms (e.g., N-ethylsulfamoyl, N-benzoylsulfamoyl etc.), an N-sulfamoylcarbamoyl group having 1–12 carbon atoms (e.g., N-methanesulfonylcarbamoyl group etc.), an alkylsulfonyl group having 1–10 carbon atoms (e.g., methanesulfonyl, octylsulfonyl, 2-methoxyethylsulfonyl etc.), an arylsulfonyl group having 6–14 carbon atoms (e.g., benzenesulfonyl, p-toluenesulfonyl, 4-phenylsulfonylphenylsulfonyl etc.), an alkoxycarbonylamino group having 2–10 carbon atoms (e.g., ethoxycarbonylamino etc.), an aryloxycarbonylamino group having 7–14 carbon atoms (e.g., phenoxycarbonylamino, naphthoxycarbonylamino etc.), an amino group having 0–10 carbon atoms (e.g., amino, methylamino, diethylamino, diisopropylamino, anilino, morpholino etc.), an ammonio group having 3–12 carbon atoms (e.g., trimethylammonio group, dimethylbenzylammonio group etc.), a cyano group, a nitro group, a carboxyl group, a hydroxy group, a sulfo group, a mercapto group, an alkylsulfinyl group having 1–10 carbon atoms (e.g., methanesulfinyl, octanesulfinyl etc.), an arylsulfinyl group having 6–14 carbon atoms (e.g., benzenesulfinyl, 4-chlorophenylsulfinyl, p-toluenesulfinyl etc.), an alkylthio group having 1–10 carbon atoms (e.g., methylthio, octylthio, cyclohexylthio etc.), an arylthiogroup having 6–14 carbon atoms (e.g., phenylthio, naphthylthio etc.), a ureido group having 1–13 carbon atoms (e.g. 3-methylureido, 3,3-dimethylureido, 1,3-diphenylureido etc.), a heterocyclic group having 2–15 carbon atoms (a 3- to 12-membered monocycle or condensed cycle containing at least one nitrogen, oxygen, sulfur etc. as a hetero atom, e.g., 2-furyl, 2-pyranyl, 2-pyridyl, 2-thienyl, 2-imidazolyl, morpholino, 2-quinolyl, 2-benzimidazolyl, 2-benzothiazolyl, 2-benzoxazolyl etc.), a heterocyclyloxy group (e.g., pyridyloxy, pyrazolyloxy etc.), a heterocyclylthio group (e.g., tetrazolylthio, 1,3,4-thiadiazolylthio, 1,3,4-oxadiazolylthio, benzimidazolylthio etc.), an acyl group having 1–12 carbon atoms (e.g., acetyl, benzoyl, trifluoroacetyl etc.), a sulfamoylamino group having 0–10 carbon atoms (e.g., N-butylsulfamoylamino, N-phenylsulfamoylamino etc.), a silyl group having 3–12 carbon atoms (e.g., trimethylsilyl, dimethyl-t-butylsilyl etc.), a halogen atom (e.g., fluorine atom, chlorine atom, bromine atom etc.) and so forth.

The aforementioned substituents may be present on a position other than the ortho positions of the phenyl group in $R^{63}$.

When $R^{63}$ is a phenyl group having a substituent at its ortho position, $R^{61}$ and $R^{62}$ preferably represent an alkyl group or an aryl group.

Specific examples of the compound having a phosphoryl group used for the present invention will be listed below. However, the present invention is not limited to these.

(II-1)

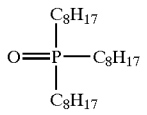

-continued
(II-2)
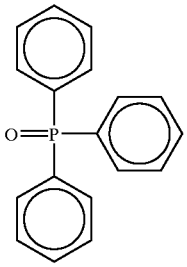
(II-3)
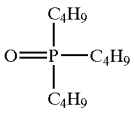
(II-4)
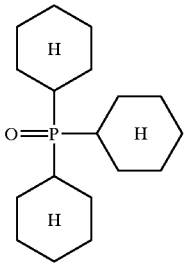
(II-5)
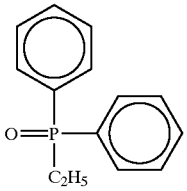
(II-6)
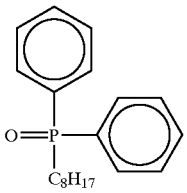
(II-7)
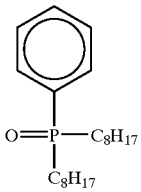
(II-8)
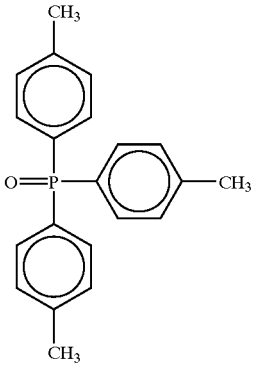
-continued
(II-9)
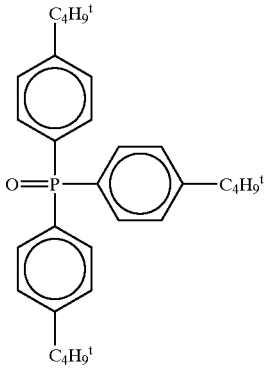
(II-10)
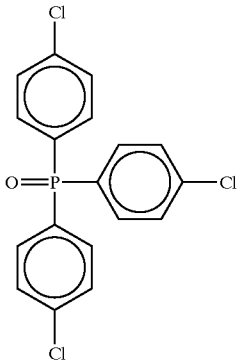
(II-11)
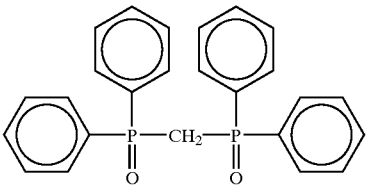
(II-12)
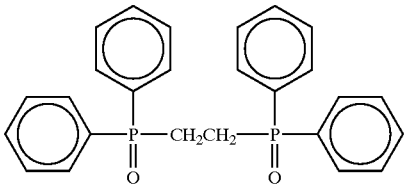
(II-13)
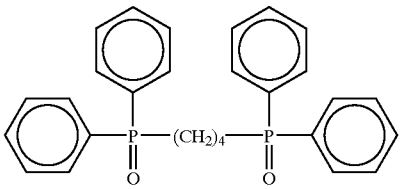
(II-14)
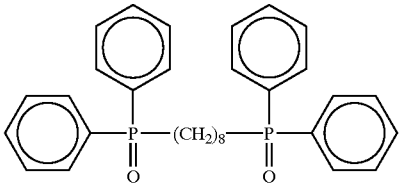

-continued
(II-15)
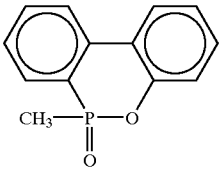
(II-16)
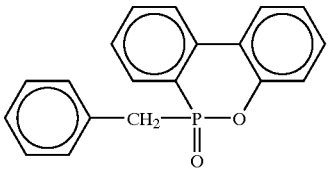
(II-17)
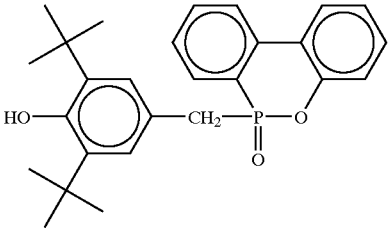
(II-18)
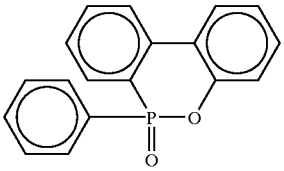
(II-19)
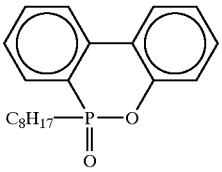
(II-20)
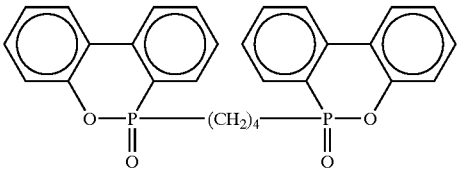
(II-21)
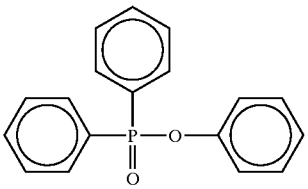
(II-22)
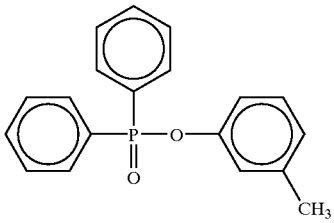
-continued
(II-23)
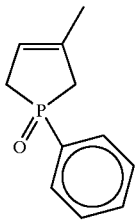
(II-24)
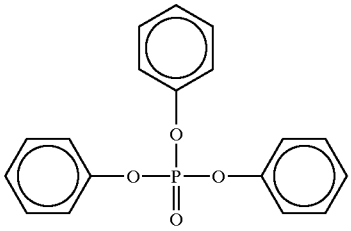
(II-25)
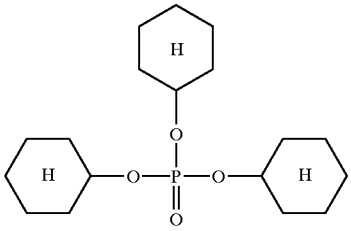
(II-26)
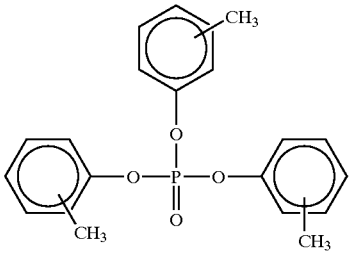
(II-27)
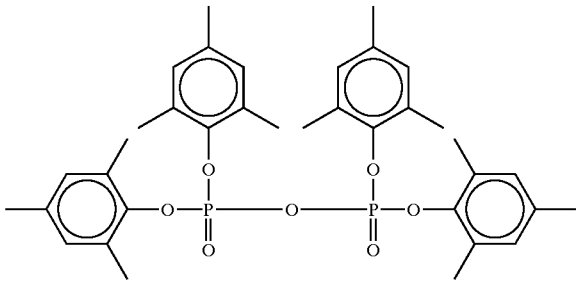
(II-28)
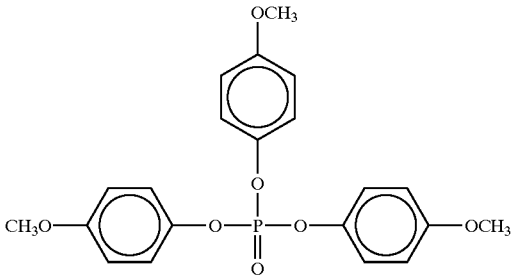

-continued
(II-29)
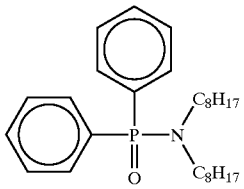
(II-30)
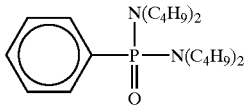
(II-31)
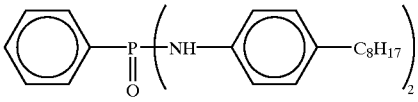
(II-32)
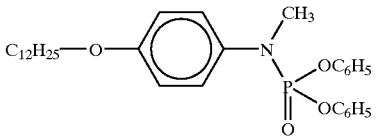
(II-33)
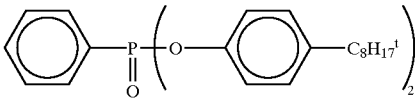
(II-34)
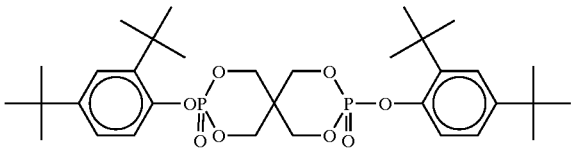
(II-35)
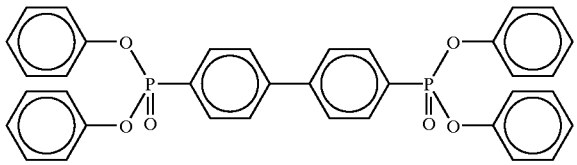
(II-36)
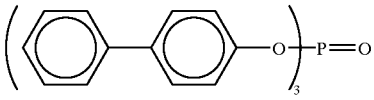
(II-37)
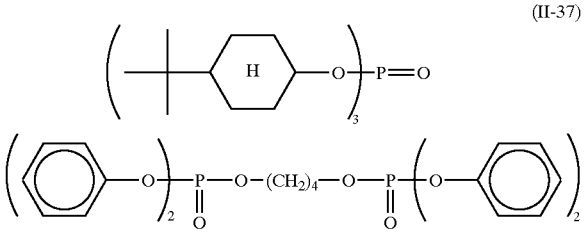
(II-39)
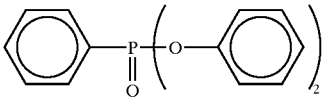
(II-40)
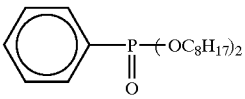
-continued
(II-41)
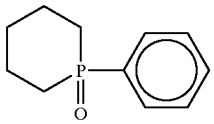
(II-42)
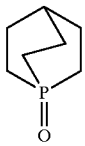
(II-43)
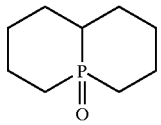
(II-44)
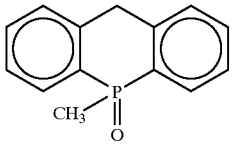
(II-45)
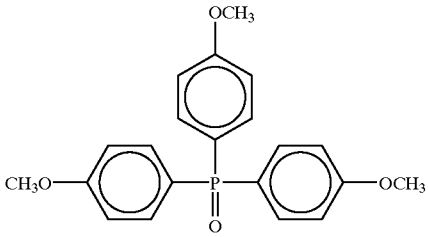
(II-46)
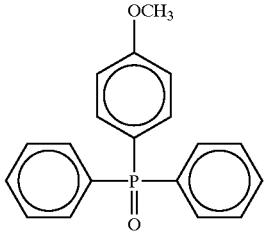
(II-47)
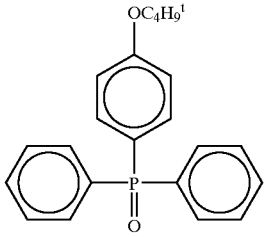
(II-48)
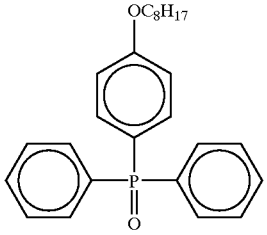

-continued
(II-49)
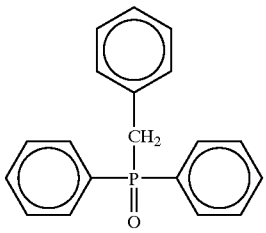
(II-50)
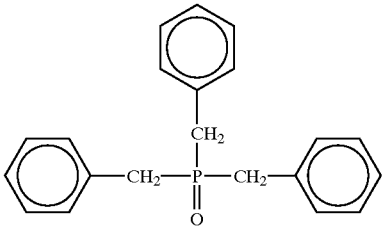
(II-51)
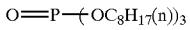
(II-52)
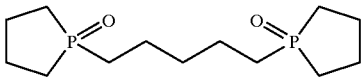
(II-53)
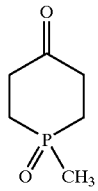
(II-54)
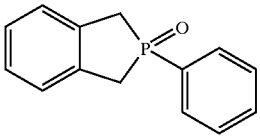
(II-55)
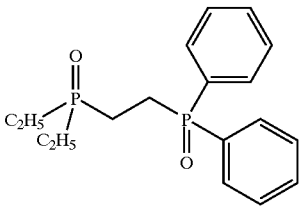
(II-56)
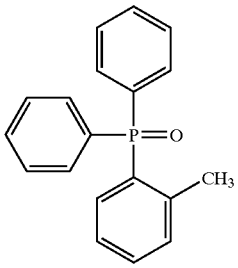
-continued
(II-57)
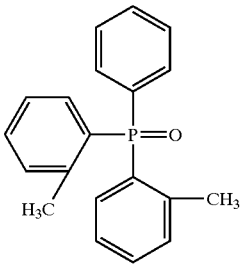
(II-58)
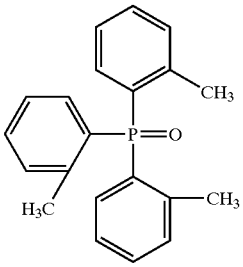
(II-59)
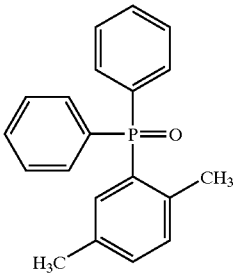
(II-60)
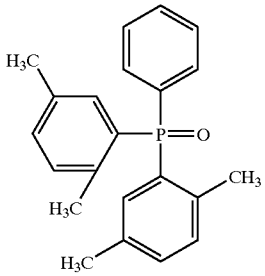
(II-61)
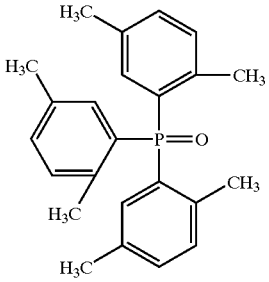

-continued
(II-62)
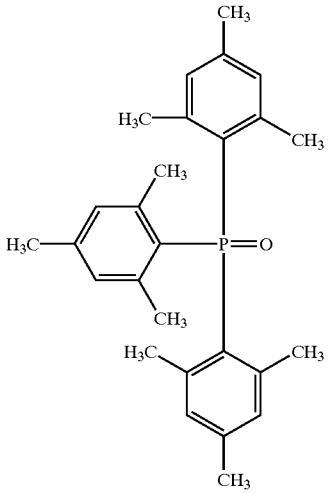
(II-63)
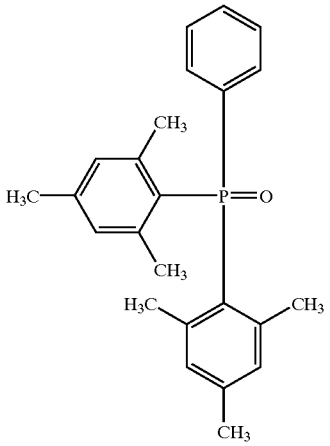
(II-64)
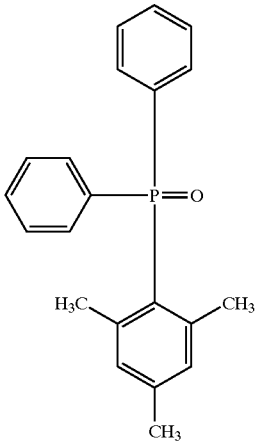
(II-65)
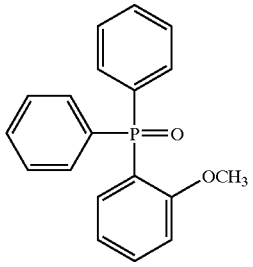
-continued
(II-66)
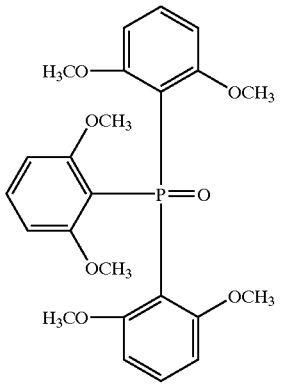
(II-67)
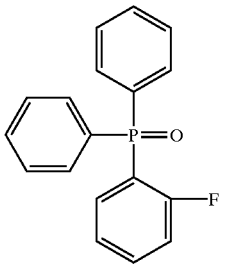
(II-68)
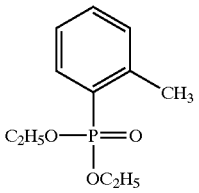
(II-69)
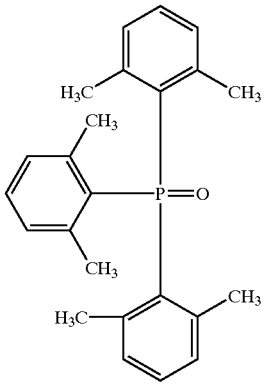
(II-70)
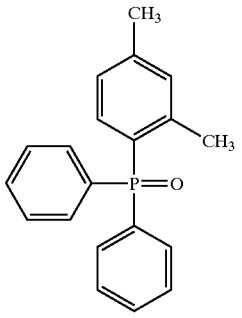

-continued
(II-71)
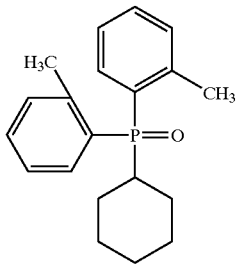
(II-72)
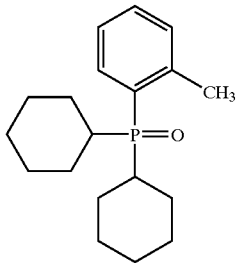
(II-73)
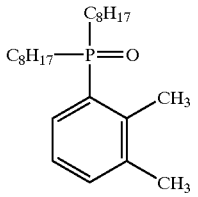
(II-74)
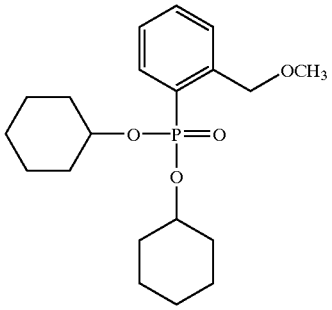
(II-75)
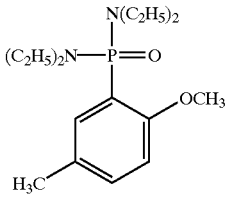
(II-76)
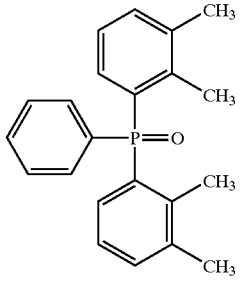
-continued
(II-77)
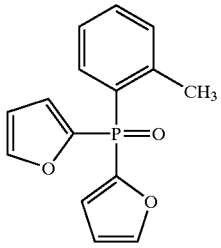
(II-78)
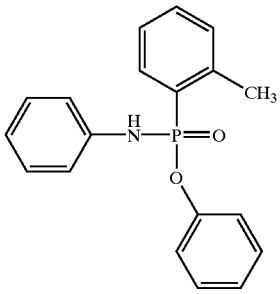
(II-79)
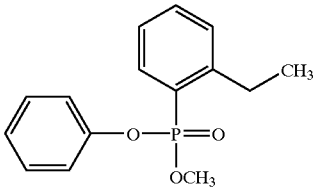
(II-80)
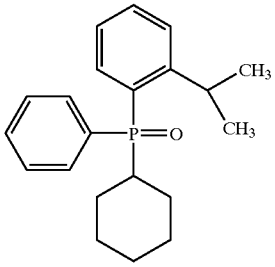
(II-81)
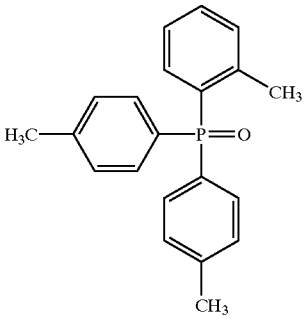
(II-82)
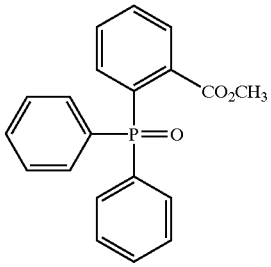

-continued (II-83)

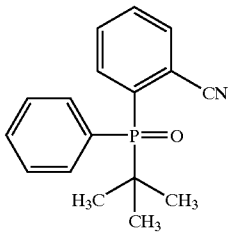

(II-84)

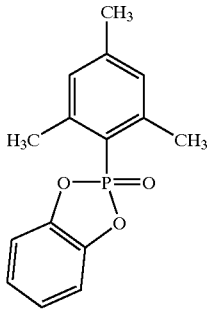

(II-85)

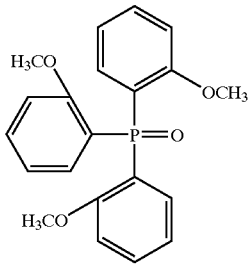

(II-86)

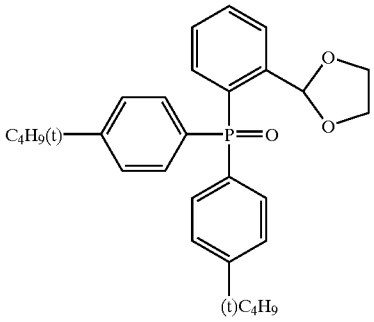

(II-87)

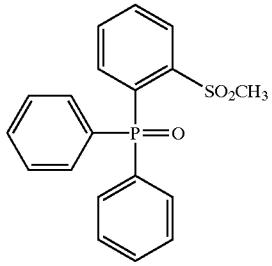

(II-88)

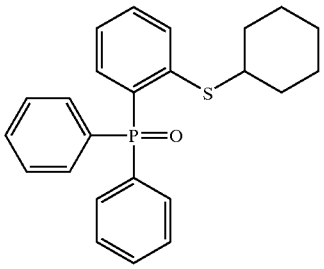

-continued (II-89)

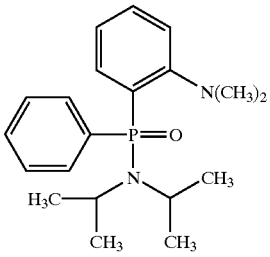

(II-90)

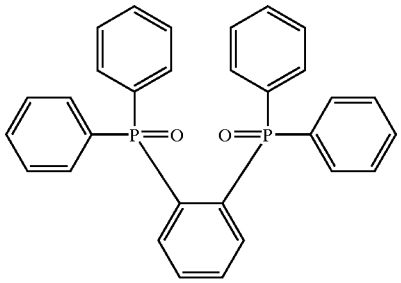

The addition amount of the compound that satisfies at least one of the above requirements A and B is preferably 0.01–4.0 g/M$^2$, more preferably 0.1–2.0 g/M$^2$. With respect to one mole of silver on the surface having the image-forming layer, it is preferably 2–40 mole %, more preferably 5–30 mole %.

The ratio of the addition amounts (molar ratio) of the phenolic reducing agent (compound of the formula (I) ) and the compound that satisfies at least one of the above requirements A and B is preferably in the range of 0.1–10, more preferably in the range of 0.1–2.0, further preferably in the range of 0.5–1.5.

The phenol compound (compound of the formula (I)) and the compound that satisfies at least one of the above requirements A and B are preferably contained in the image-forming layer containing a silver salt of an organic acid. However, one of them may be contained in the image-forming layer and the other may be contained in a non-image-forming layer adjacent thereto, or the both may be contained in a non-image-forming layer. Further, when the image-forming layer consists of a plurality of layers, they may be contained in different layers.

The phenol compound (compound of the formula (I)) and the compound that satisfies at least one of the above requirements A and B may be contained in a coating solution in any state, for example, in a state of solution, emulsified dispersion, solid microparticle dispersion or the like to be contained in the photosensitive material.

As a well known emulsification method, there can be mentioned a method of mechanically preparing an emulsified dispersion by using an oil such as dibutyl phthalate, tricresyl phosphate, glyceryl triacetate or diethyl phthalate, ethyl acetate or cyclohexanone as an auxiliary solvent for dissolution.

As a solid microparticle dispersion method, there can be mentioned a method of preparing a solid dispersion by dispersing powder of the phenol compound (compound of the formula (I)) or the compound that satisfies at least one of the above requirements A and B in a suitable solvent such as water using a ball mill, colloid mill, vibrating ball mill, sand mill, jet mill, roller mill or the like or by means of ultrasonic wave. In this operation, a protective colloid (e.g., polyvinyl alcohol), a surfactant (e.g., an anionic surfactant such as sodium triisopropylnaphthalenesulfonate (mixture of those having three isopropyl groups on different positions)) and so forth may be used. An aqueous dispersion may contain a preservative (e.g., benzisothiazolinone sodium salt).

A silver salt of an organic acid that can be used in the present invention is a silver salt relatively stable against light, but forms a silver image when it is heated at 80° C. or higher in the presence of an exposed photocatalyst (e.g., a latent image of photosensitive silver halide) and a heat developing agent. The silver salt of an organic acid may be any organic substance containing a source capable of reducing silver ions. Such non-photosensitive silver salts of an organic acid are disclosed in JP-A-10-62899, paragraphs 0048 to 0049, European Patent Publication EP0803763A1, page 18, line 24 to page 19, line 37 and European Patent Publication EP0962812A1. Silver salts of an organic acid, in particular, a long chained aliphatic carboxylic acid having from 10 to 30, preferably from 15 to 28 carbon atoms are preferred. Preferred examples of the silver salt of an organic acid include silver behenate, silver arachidinate, silver stearate, silver oleate, silver laurate, silver caproate, silver myristate, silver palmitate, mixtures thereof and so forth.

The shape of the silver salt of an organic acid that can be used for the present invention is not particularly limited. Scaly silver salts of an organic acid are preferred for the present invention. Scaly silver salts of an organic acid are herein defined as follows. A sample of a silver salt of an organic acid is observed under an electronic microscope, and the shape of the observed grains of the salt of an organic acid is approximated to rectangular parallelepiped. The edges of each rectangular parallelepiped are named as a, b and c according to increasing size (c and b may be the same). From the shorter edges a and b, x is obtained according to the following equation:

$$x=b/a$$

The values of x are obtained for about 200 grains, and an average of the value is named as x (average). Samples that satisfy the requirement of x (average) $\geqq 1.5$ are defined to be scaly. Scaly grains preferably satisfy $30 \geqq x$ (average) $\geqq 1.5$, more preferably $20 \geqq x$ (average) $\geqq 2.0$. Acicular grains satisfy $1 \geqq x$ (average) $<1.5$.

In scaly grains, "a" is interpreted as the thickness of tabular grains of which main planes are defined by the sides of b and c. The average of "a" is preferably from 0.01 μm to 0.23 μm, more preferably from 0.1 μm to 0.20 μm. The average of c/b is preferably from 1 to 6, more preferably from 1.05 to 4, further preferably from 1.1 to 3, most preferably from 1.1 to 2.

The grain size distribution of the silver salt of an organic acid is preferably monodispersion. The term "monodispersion" as used herein means that the percentage of the value obtained by dividing the standard deviation of the length of the short axis or the long axis by the length of the short axis or the long axis, respectively, is preferably 100% or less, more preferably 80% or less, further preferably 50% or less. The shape of the silver salt of an organic acid can be determined from a transmission electron microscope image of silver salt of an organic acid dispersion. Another method for determining monodispersion includes a method involving the step of obtaining the standard deviation of a volume-weighted average diameter of the silver salt of an organic acid. The percentage (coefficient of variation) of the value obtained by dividing the standard deviation by the volume-weighted average diameter is preferably 100% or less, more preferably 80% or less, further preferably 50% or less. For example, the value can be obtained from a grain size (volume-weighted average diameter) determined by irradiating silver salt of an organic acid dispersed in a solution with a laser ray and determining an autocorrelation function of the scattered light on the basis of the change in time.

Methods for production and dispersion of the silver salt of an organic acid used for the present invention can be known ones. For example, the aforementioned JP-A-10-62899, European Patent Publication EP0803763A1, and EP0962812A1 can be referred to.

In the present invention, the photosensitive material can be produced by mixing an aqueous dispersion of the silver salt of an organic acid and an aqueous dispersion of the photosensitive silver salt. While the mixing ratio of the silver salt of an organic acid and the photosensitive silver salt can be selected depending on the purpose, the ratio of the photosensitive silver salt with respect to the silver salt of an organic acid is preferably in the range of 1–30 mole %, more preferably 3–20 mole %, particularly preferably 5–15 mole %. For the mixing of them, mixing two or more kinds of aqueous dispersions of the silver salt of an organic acid and two or more kinds of aqueous dispersions of the photosensitive silver salt is preferably used for controlling photographic properties.

While the silver salt of an organic acid can be used in a desired amount, it is preferably used in an amount of 0.1–5 $g/m^2$, more preferably 1–3 $g/m^2$, as the amount of silver.

The photosensitive silver halide that can be used for the present invention is not particularly limited as for halogen composition, and silver chloride, silver chlorobromide, silver bromide, silver iodobromide, and silver chloroiodobromide maybe used. Distribution of the halogen composition may be uniform in the grains, or alternatively, the halogen composition may alter stepwise or continuously in the grains. Silver halide grains having a core/shell structure may preferably be used. A double to quintuple structure is preferred, and more preferably, core/shell grains having a double to quadruple structure may be used. A technique for localizing silver bromide on the surface of silver chloride or silver chlorobromide grains may also be preferably used.

Preparations of the photosensitive silver halide are well known in the art. For example, methods described in Research Disclosure, No. 17029 (June, 1978) and U.S. Pat. No. 3,700,458 can be used. More specifically, a method can be used which comprises the step of preparing photosensitive silver halide grains by addition of a silver-supplying compound and a halogen-supplying compound to a solution of gelatin or other polymer, and then adding a silver salt of an organic acid to the resulting grains.

The grain size of the photosensitive silver halide is preferably made small in order to suppress turbidity after image formation. Specifically, the grain size may preferably be 0.20 μm or less, more preferably from 0.01 to 0.15 μm, further preferably from 0.02 to 0.12 μm. The term "grain size" used herein means a diameter of a sphere having the same volume as the grain where the silver halide grains are regular crystals in cubic or octahedral form and where the silver halide grains are irregular crystals such as spherical or rod-like grains. Where silver halide grains are tabular grains, the term means the diameter of a circle having the same area as a projected area of the main surface of the tabular grain.

Examples of the form of silver halide grains include a cubic form, octahedral form, tabular form, spherical form, rod-like form and potato-like form. In particular, cubic grains are preferred for the present invention. Silver halide grains having round corners are also preferably used in the present invention. Surface index (Miller index) of outer surfaces of the photosensitive silver halide grains is not particularly limited. However, it is desirable that [100] face be present in a high proportion that can achieve high spectral sensitizing efficiency when a spectral sensitizing dye adsorbs thereto. The proportion of [100] face may be preferably not lower than 50%, more preferably at least 65%, still more preferably at least 80%. The proportion of Miller index [100] face can be determined using the method described in T. Tani, J. Imaging Sci., 29, 165 (1985), where the difference in adsorption property of a sensitizing dye to [111] face and [100] face is utilized.

The photosensitive silver halide grain of the present invention desirably contains a metal or metal complex of Group VIII to Group X in the periodic table of elements (including Group I to Group XVIII). The metal or the center metal of the metal complex of Group VIII to X of the periodic table is preferably rhodium, rhenium, ruthenium, osmium or iridium. The metal complex may be used alone, or two or more complexes of the same or different metals may also be used in combination. The metal complex content is preferably from $1\times10^{-9}$ to $1\times10^{-3}$ mole per mole of silver. Such metal complexes are described in JP-A-11-65021, paragraphs 0018 to 0024.

Among them, an iridium compound is preferably contained in the silver halide grains for the present invention. Examples of the iridium compound include hexachloroiridium, hexammineiridium, trioxalatoiridium, hexacyanoiridium and pentachloronitrosyliridium. The iridium compound is used after dissolving the compound in water or an appropriate solvent, and a method commonly used for stabilizing the iridium compound solution, more specifically, a method comprising adding an aqueous solution of hydrogen halogenide (e.g., hydrochloric acid, hydrobromic acid, hydrofluoric acid) or halogenated alkali (e.g., KCl, NaCl, KBr, NaBr) may be used. Instead of using water-soluble iridium, different silver halide grains doped beforehand with iridium may be added and dissolved at the time of preparation of silver halide. The amount of the iridium compound is preferably $1\times10^{-3}$ to $1\times10^{-3}$ mole, more preferably $1\times10^{-7}$ to $5\times10^{-4}$ mole, per mole of silver halide.

Further, metal complexes that can be contained in the silver halide grains used for the present invention (e.g., $[Fe(CN)_6]^{4-}$), desalting methods and chemical sensitization methods are described in JP-A-11-84574, paragraphs 0046 to 0050 and JP-A-11-65021, paragraphs 0025 to 0031.

In the photothermographic material of the present invention, phenol derivatives represented by the formula (A) mentioned in Japanese Patent Application No. 11-73951 are preferably used as a development accelerator.

As sensitizing dyes usable for the present invention, advantageously selected are sensitizing dyes that, after adsorbed onto silver halide grains, can spectrally sensitize the grains within a desired wavelength range. Depending on the spectral characteristics of the light source to be used for exposure, favorable sensitizing dyes having good spectral sensitivity are selected for use in the photothermographic material of the invention. For the details of sensitizing dyes usable herein and methods for adding them to the photothermographic material of the invention, referred to are JP-A-11-65021, paragraphs 0103 to 0109, compounds of formula (II) in JP-A-10-186572, and European Patent Publication EP0803764A1, from page 19, line 38 to page 20, line 35. Regarding the time at which the sensitizing dye is added to the silver halide emulsion, it is desirable that the sensitizing dye is added thereto after the desalting step but before the coating step, more preferably after the desalting but before the start of the chemical ripening.

While the addition amount of the sensitizing dye may be used in a desired amount depending on performance such as sensitivity and fog, it is preferably used in an amount of $10^{-6}$ to 1 mole, more preferably $10^{-4}$ to $10^{-1}$ mole, per 1 mole of the silver halide in the photosensitive layer.

In the present invention, a supersensitizer can be used in order to improve spectral sensitization efficiency. The supersensitizer used for the present invention may be compounds disclosed in European Patent Publication No. 587338, U.S. Pat. Nos. 3,877,943 and 4,873,184, JP-A-5-341432, JP-A-11-109547, JP-A-10-111543 and so forth.

Photosensitive silver halide grains used for the present invention are preferably subjected to chemical sensitization by sulfur sensitization, selenium sensitization or tellurium sensitization. Any known compounds are preferably usable for such sulfur, selenium or tellurium sensitization, and for example, the compounds described in JP-A-7-128768 are usable for that purpose. In the present invention, especially favorable is tellurium sensitization. Tellurium sensitizers usable herein include, for example, diacyltellurides, bis(oxycarbonyl)tellurides, bis(carbamoyl)tellurides, diacylditellurides, bis(oxycarbonyl)ditellurides, bis(carbamoyl)ditellurides, compounds with P═Te bond, tellurocarboxylates, tellurosulfonates, compounds with P—Te bond, tellurocarbonyl compounds, etc. For these, specifically mentioned are the compounds described in JP-A-11-65021, paragraph 0030. Particularly preferred are the compounds of formulae (II), (III) and (IV) given in JP-A-5-313284.

In the present invention, the chemical sensitization may be performed at any time so long as it is performed after the formation of the grains and before the coating. It may be performed after desalting and (1) before the spectral sensitization, (2) simultaneously with the spectral sensitization, (3) after the spectral sensitization, (4) immediately before the coating, or the like. It is particularly preferably performed after spectral sensitization.

The amount of the sulfur, selenium or tellurium sensitizer for use in the present invention varies depending on the type of the silver halide grains to be used, the condition for chemical ripening etc., but may fall generally between $10^{-8}$ and $10^{-2}$ mole, preferably between $10^{-7}$ and $10^{-3}$ mole or so, per mol of the silver halide. Although the conditions for the chemical sensitization are not particularly limited in the present invention, pH falls between 5 and 8, the pAg falls between 6 and 11, preferably between 7 and 10, and the temperature falls between 40 and 95° C., preferably between 44 and 70° C.

In the photothermographic material of the present invention, one or more photosensitive silver halide emulsions may be used or two or more different emulsions (for example, those having different average grain sizes, different halogen compositions, different crystal habits or different chemical sensitization conditions) may be used in combination. By using plural photosensitive silver halides having different sensitivities, contrast can be controlled. Examples of the techniques in the art include those mentioned in JP-A-57-119341, JP-A-53-106125, JP-A-47-3929, JP-A-48-55730, JP-A-46-5187, JP-A-50-73627, JP-A-57-150841 and so forth. Each emulsion may preferably have sensitivity difference of 0.2 log E or higher.

The amount of the photosensitive silver halide is preferably 0.03 to 0.6 g/m$^2$, more preferably 0.05 to 0.4 g/m$^2$, most preferably 0.1 to 0.4 g/m$^2$, as the amount of coated silver per 1 m$^2$ of a photosensitive material. The amount of the photosensitive silver halide per mole of the silver salt of an organic acid is preferably from 0.01 to 0.5 mole, more preferably from 0.02 to 0.3 mole, still more preferably from 0.03 to 0.25 mole.

Methods and conditions for mixing photosensitive silver halide and a silver salt of an organic acid, which are prepared separately, are not particularly limited so long as the effect of the present invention can be attained satisfactorily. Examples thereof include, for example, a method of mixing silver halide grains and a silver salt of an organic acid after completion of respective preparations by using a high-speed stirring machine, ball mill, sand mill, colloid mill, vibrating mill or homogenizer or the like, or a method of preparing a silver salt of an organic acid by mixing a photosensitive silver halide obtained separately at any time during the preparation of the silver salt of an organic acid.

Preferred time for addition of a silver halide to a coating solution for image-forming layer resides in a period of from 180 minutes before coating to just before coating, preferably 60 minutes to 10 seconds before coating. Methods and conditions for mixing are not particularly limited so long as the effect of the present invention can be obtained satisfactorily. Specific examples of the mixing method include a method in which a mixing is performed in a tank designed so as to obtain a desired average residence time which is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

The binder of the layer containing the silver salt of an organic acid of the present invention may be any polymer. Preferred binders are those that are transparent or translucent, and generally colorless. The binder may consist of, for example, a naturally occurring resin, polymer or copolymer, synthetic resin, polymer or copolymer or other media that can form a film, such as gelatins, rubbers, poly(vinyl alcohols), hydroxyethylcelluloses, cellulose acetates, cellulose acetate butyrates, poly (vinylpyrrolidones), casein, starch, poly(acrylic acids), poly (methyl methacrylates), poly(vinyl chlorides), poly (methacrylic acids), styrene/maleic anhydride copolymers, styrene/acrylonitrile copolymers, styrene/butadiene copolymers, poly(vinyl acetals) (e.g., poly(vinyl formal), poly(vinyl butyral)), poly(esters), poly(urethanes), phenoxy resin, poly(vinylidene chlorides), poly(epoxides), poly (carbonates), poly(vinyl acetates), poly(olefins), cellulose esters and poly(amides).

In the present invention, the binder of the layer containing the silver salt of an organic acid preferably has a glass transition temperature of 20–80° C. (also referred to as "high Tg binder" hereinafter), more preferably 23–60° C.

In the present specification, Tg is calculated in accordance with the following equation.

$$1/Tg=\Sigma(Xi/Tgi)$$

In this case, the polymer is considered to be composed of copolymerized monomer components of i=1 to n, i.e., in the number of n. Xi represents a weight ratio of the i-th monomer ($\Sigma Xi=1$), and Tgi is a glass transition temperature (absolute temperature) of a homopolymer composed of the i-th monomer. means the sum of i=1 to n. As the value of glass transition temperature of a homopolymer composed of each monomer (Tgi), used was a value mentioned in Polymer Handbook (3rd Edition) (J. Brandrup, E. H. Immergut (Wiley-Interscience, 1989)).

Polymers serving as the binder may be used each kind alone, or two or more kinds of them may be used in combination as required. Further, one having a glass transition temperature of 20° C. or higher and one having a glass transition temperature of lower than 20° C. may be used in combination. When a blend of two or more kinds of polymers having different glass transition temperatures is used, it is preferred that its weight average Tg should fall within the aforementioned range.

In the present invention, if the layer containing the silver salt of an organic acid is formed by using an aqueous coating solution containing 30% by weight or more of water based on a total solvent, in particular, a coating solution containing a polymer latex having an equilibrated moisture content of 2 weight % or less at 25° C. and relative humidity of 60%, the performance is improved. In the most preferred embodiment, the polymer latex is prepared to have an ion conductivity of 2.5 mS/cm or less. An example of a method for preparing such polymer latex includes a method comprising the step of synthesizing a polymer and then purifying the polymer by using a functional membrane for separation.

The aqueous solvent in which the polymer binder is soluble or dispersible is water or water mixed with 70% by weight or less of a water-miscible organic solvent. Examples of the water-miscible organic solvent include, for example, alcohols such as methyl alcohol, ethyl alcohol and propyl alcohol; cellosolves such as methyl cellosolve, ethyl cellosolve and butyl cellosolve; ethyl acetate, dimethylformamide and so forth.

The term "aqueous solvent" used herein also encompasses systems in which a polymer is not thermodynamically dissolved but is present in a so-called dispersed state.

The definition "equilibrated moisture content at 25° C. and relative humidity of 60%" used herein can be represented by the following equation, in which W1 indicates the weight of a polymer at humidity-conditioned equilibrium in an atmosphere of 25° C. and relative humidity of 60%, and W0 indicates the absolute dry weight of the polymer at 25° C.

$$\text{Equilibrated moisture content at 25° C. and relative humidity of 60\%}=[(\mathbf{W1}-\mathbf{W0})]\times 100\ (\text{weight \%})$$

As for details of the definition of moisture content and methods for measurement, for example, Lecture of Polymer Engineering, 14, Test Methods for Polymer Materials (Polymer Society of Japan, Chijin Shokan) can be referred to.

The equilibrated moisture content at 25° C. and relative humidity of 60% of the binder polymer used for the present invention is preferably 2% by weight or less, more preferably from 0.01 to 1.5% by weight, most preferably from 0.02 to 1% by weight.

In the present invention, polymers dispersible in aqueous solvents are particularly preferred.

Examples of systems in the dispersed state include, for example, polymer latex in which fine solid particles of polymer are dispersed, and a system in which a polymer is dispersed in a molecular state or as micelles, both of which are preferred.

In preferred embodiments of the invention, hydrophobic polymers such as acrylic resins, polyester resins, rubber resins (e.g., SBR resins), polyurethane resins, polyvinyl chloride resins, polyvinyl acetate resins, polyvinylidene chloride resins, and polyolefin resins can preferably be used. The polymers may be linear, branched or crosslinked. They may be so-called homopolymers in which a single monomer is polymerized, or copolymers in which two or more different kinds of monomers are polymerized. The copolymers may be random copolymers or block copolymers. The polymers may have a number average molecular weight of 5,000 to 1,000,000, preferably from 10,000 to 200,000. Polymers having a too small molecular weight fail to give sufficient mechanical strength of an emulsion layer, and those having a too large molecular weight yield bad film forming property, and both of which are not preferred.

The "aqueous solvent" mentioned above means a dispersion medium of which composition comprises at least 30% by weight of water. As for a state of dispersion, systems in any state may be used, for example, emulsion dispersion, micellar dispersion, molecular dispersion of a polymer having a hydrophilic moiety and so forth. Among them, polymer latex is particularly preferred.

Preferred examples of the polymer latex are shown below. They are described as monomers as starting materials. The numerals parenthesized are indicated as % by weight, and the molecular weights are number average molecular weights.

P-1: Latex of —MMA(70)—EA(27)—MAA(3)— (molecular weight: 37000)

P-2: Latex of —MMA(70)—2EHA(20)—St(5)—AA(5)— (molecular weight: 40000)

P-3: Latex of —St(50)—Bu(47)—MMA(3)— (molecular weight: 45000)

P-4: Latex of —St(68)—Bu(29)—AA(3)— (molecular weight: 60000)

P-5: Latex of —St(70)—Bu(27)—IA(3)— (molecular weight: 120000)

P-6: Latex of —St(75)—Bu(24)—AA(1)— (molecular weight: 108000)

P-7: Latex of —St(60)—Bu(35)—DVB(3)—MAA(2)— (molecular weight: 150000)

P-8: Latex of —St(70)—Bu(25)—DVB(2)—AA(3)— (molecular weight: 280000)

P-9: Latex of —VC(50)—MMA(20)—EA(20)—AN(5)—AA(5)— (molecular weight: 80000)

P-10: Latex of —VDC(85)—MMA(5)—EA(5)—MAA(5)— (molecular weight: 67000)

P-11: Latex of —Et(90)—MAA(10)— (molecular weight: 12000)

P-12: Latex of —St(70)—2EHA(27)—AA(3)— (molecular weight: 130000)

P-13: Latex of —MMA(63)—EA(35)—AA(2)— (molecular weight: 33000)

P-14: Latex of —St(80)—Bu(20)— (Tg=39° C., crosslinked)

P-15: Latex of —St(85)—Bu(15)— (Tg=52° C., crosslinked)

P-16: Latex of —St(90)—Bu(7)—AA(3)— (Tg=76° C., crosslinked)

P-17: Latex of —St(70)—BMA(30)— (Tg=63° C., molecular weight: 126000)

P-18: Latex of —St(65)—BMA(30)—AA(5)— (Tg=63° C., molecular weight: 102000)

P-19: Latex of —St(75)—Bu(15)—BMA(10)— (Tg=37° C., crosslinked)

P-20: Latex of —St(80)—2EHA(15)—AA(5)— (Tg=66 C, molecular weight: 98000)

P-21: Latex of —St(92)—Bu(5)—AA(3)— (Tg=84° C., crosslinked)

P-22: Latex of —MMA(76)—2EHA(22)—EGDA(2)— (Tg=55° C., crosslinked)

P-23: Latex of —MMA(60)—MA(40)— (Tg=60° C., 253000)

P-24: Latex of —St(80)—Bu(12)—AA(3)—DVB(5)— (Tg=80° C., crosslinked)

P-25: Latex of —t-BA(100)— (Tg=77° C., 169000)

P-26: Latex of —St(74)—Bu(20)—AA(3)— (Tg=31° C., crosslinked)

P-27: Latex of —St(71)—Bu(26)—AA(3)— (Tg=24° C., crosslinked)

P-28: Latex of —St(70.5)—Bu(26.5)—AA(3)— (Tg=23° C., crosslinked)

P-29: Latex of —St(69.5)—Bu(28.5)—AA(3)— (Tg=20.5° C., crosslinked)

Abbreviations in the above formula represent the following monomers:

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid
MA: methyl acrylate
BMA: butyl methacrylate
EGDA: ethylene glycol diacrylate
t-BA: t-butyl acrylate The polymer latexes mentioned above are also commercially available, and those mentioned below can be used. Examples of acrylic resins include CEBIAN A-4635, 46583, 4601 (all from Daicel Chemical Industries), Nipol Lx811, 814, 821, 820, 857 (all from Nippon Zeon) and so forth; examples of polyester resins include FINETEX ES650, 611, 675, 850 (all from Dai-Nippon Ink and Chemicals), WD-size, WMS (both from Eastman Chemical) and so forth; examples of polyurethane resins include HYDRAN AP10, 20, 30, 40 (all from Dai-Nippon Ink and Chemicals) and so forth; examples of rubber resins are LACSTAR 7310K, 3307B, 4700H, 7132C (all from Dai-Nippon Ink & Chemicals), Nipol Lx4l6, 410, 438C, 2507 (all from Nippon Zeon) and so forth; examples of polyvinyl chloride resins include G351, G576 (both from Nippon Zeon) and so forth; examples of polyvinylidene chloride resins are L502, L513 (both from Asahi Chemical Industry) and so forth; examples of polyolefin resins include CHEMIPEARL S120, SA100 (both from Mitsui Petrochemical) and so forth.

These polymer latexes may be used alone, or two or more of them may be blended as required.

As the polymer latex used in the present invention, styrene/butadiene copolymer latex is particularly preferred. In the styrene/butadiene copolymer, the weight ratio of styrene monomer units to butadiene monomer units is preferably 40/60 to 95/5. The ratio of the styrene monomer units and the butadiene monomer units in the copolymer may preferably be from 60 to 99% by weight. The preferred range of the molecular weight of the copolymer is similar to that mentioned above.

Examples of styrene/butadiene copolymer latexes preferably used for the present invention include the aforementioned P-3 to P-8, P-14 to P-16, P-19, P-21, P-24, P-26 to P-29, commercially available products, LACSTAR-3307B, 7132C, Nipol Lx416 and so forth.

The layer containing silver salt of an organic acid of the photothermographic material of the present invention may optionally be added with a hydrophilic polymer such as gelatin, polyvinyl alcohol, methylcellulose and hydroxypropylcellulose. The amount of the hydrophilic polymer is preferably 30% by weight or less, more preferably 20% by weight or less, of the total binder in the layer containing silver salt of an organic acid.

The layer containing silver salt of an organic acid (i.e., the image-forming layer) may preferably be those formed by using a polymer latex. The amount of the binder in the layer containing a silver salt of an organic acid may be 1/10 to 10/1, more preferably 1/5 to 4/1, as indicated by a weight ratio of a total binder/a silver salt of an organic acid.

The layer containing silver salt of an organic acid generally also serves as a photosensitive layer (an emulsion layer) containing a photosensitive silver halide as a photosensitive silver salt. In that case, the weight ratio of a total binder/a silver halide may preferably be 5 to 400, more preferably 10 to 200.

The total amount of the binder in the image-forming layer of the photothermographic material of the present invention is preferably 0.2 to 30 g/m$^2$, more preferably 1 to 15 g/m$^2$. The image-forming layer may optionally be added with a crosslinking agent, a surfactant to improve coating property of a coating solution and so forth.

The solvent for the coating solution for the layer containing silver salt of an organic acid of the photothermographic material of the present invention (for simplicity, a dispersion medium as well as a solvent is herein referred to as a "solvent" is an aqueous solvent containing at least 30% by weight of water. As components other than water, any water-miscible organic solvents may be used such as, for example, methyl alcohol, ethyl alcohol, isopropyl alcohol, methyl cellosolve, ethyl cellosolve, dimethylformamide, ethyl acetate and so forth. The water content of the solvent for the coating solution is preferably at least 50% by weight, more preferably at least 70% by weight. Preferred examples of the solvent composition include water/methyl alcohol=90/10, water/methyl alcohol=70/30, water/methyl alcohol/dimethylformamide=80/15/5, water/methyl alcohol/ethyl cellosolve=80/10/5, water/methyl alcohol/isopropyl alcohol=85/10/5 and so forth as well as water (numerals indicate weight %).

As antifoggants, stabilizers and stabilizer precursors that can be used for the present invention, there can be mentioned, for example, those mentioned in JP-A-10-62899, paragraph 0070 and European Patent Publication EP0803764A1, from page 20, line 57 to page 21, line 7. Antifoggants preferably used for the present invention are organic halides. Examples thereof include, for example, those disclosed in JP-A-11-65021, paragraphs 0111 to 0112. Particularly preferred are the polyhalogenated compounds of formula (II) mentioned in JP-A-10-339934 (specific examples are tribromomethylnaphthylsulfone, tribromomethylphenylsulfone, tribromomethyl(4-(2,4,6-trimethylsulfonyl)phenyl)sulfone, etc.).

The antifoggants can be formulated in the photothermographic material by the methods mentioned above as methods for formulating the heat developing agents. The polyhalogenated compounds are also preferably added in the form of solid microparticle dispersion.

Other examples of the antifoggant include the mercury(II) salts described in JP-A-11-65021, paragraph 0113, the benzoic acids described in the same, paragraph 0114, the salicylic acid derivatives represented by the formula (Z) mentioned in Japanese Patent Application No. 11-87297 and the formalin scavenger compounds represented by the formula (S) mentioned in Japanese Patent Application No. 11-23995.

The photothermographic material of the present invention may contain an azolium salt as the antifoggant. Examples of the azolium salt include, for example, the compounds of the formula (XI) disclosed in JP-A-59-193447, the compounds disclosed in JP-B-55-12581 and the compounds of the formula (II) disclosed in JP-A-60-153039. The azolium salt may be added in any site of the photothermographic material, and is preferably added in one or more layers on the side of an image-forming layer, more preferably in the layer containing silver salt of an organic acid. The azolium salt may be added at any time during the preparation of the coating solution. When the azolium salt is added to the layer containing silver salt of an organic acid, the azolium salt may be added at any time during the period of from the preparation of the silver salt of an organic acid to the preparation of the coating solution. A time during the period after the preparation of the silver salt of an organic acid and just before coating is preferred. The azolium salt may be added as any form such as powder, solution and microparticle dispersion. The salt may also be added as a solution prepared by mixing the salt with other additives such as a sensitizing dye, a reducing agent, and a toning agent. In the present invention, the amount of the azolium salt to be added is not particularly limited, and the amount may preferably be $1\times10^{-6}$ mole to 2 moles, more preferably $1\times10^{-3}$ mole to 0.5 mole, per mole of silver.

The photothermographic material of the invention may optionally contain a mercapto compound, a disulfide compound, and a thione compound to accelerate, suppress, or control development, or increase efficiency in spectral sensitivity, or to improve storability before and after development. Examples include, for example, those compounds described in JP-A-10-62899, paragraphs 0067 to 0069, compounds of the formula (I) and specific examples in the paragraphs 0033 to 0052 of JP-A-10-186572, and those described in European Patent Publication EP0803764A1, page 20, lines 36 to 56. Among them, mercapto-substituted heteroaromatic compounds are preferred.

In the photothermographic material of present invention, it is preferable to add a toning agent. Examples of the toning agent are described in JP-A-10-62899, paragraphs 0054 to 0055 and European Patent Publication EP0803764A1, page 21, lines 23 to 48. Preferred examples include phthalazinone, phthalazinone derivatives (e.g., 4-(1-naphthyl)phthalazinone, 6-chlorophthalazinone, 5,7-dimethoxyphthalazinone, 2,3-dihydro-1,4-phthalazinone and other derivatives) and metal salts thereof; combinations of phthalazinones and phthalic acid or derivatives thereof (e .g., phthalic acid, 4-methylphthalic acid, 4-nitrophthalic acid, tetrachlorophthalic anhydride and so forth) ; phthalazines including phthalazine and phthalazine derivatives (e.g., 4-(1-naphthyl)phthalazine, 6-isopropylphthalazine, 6-t-butylphthalazine, 6-chlorophthalazine, 5,7-dimethoxyphthalazine, 2,3-dihydrophthalazine and other derivatives) and metal salts thereof; combinations of phthalazines and phthalic acid or derivatives thereof (e.g., phthalic acid, 4-methylphthalic acid, 4-nitrophthalic acid, tetrachlorophthalic anhydride and so forth). Particularly preferred examples include the combinations of phthalazines and phthalic acid or derivatives thereof.

Plasticizers and lubricants that can be used for the photosensitive layer are described in JP-A-11-65021, paragraph 0117. Ultrahigh contrast agents for forming ultrahigh contrast images are described in the same publication, paragraph 0118 and those mentioned in Japanese Patent Application No. 11-91652 as compounds of the formulas (III) to (V) (specific compounds: Chem. 21 to Chem 24); and hardness enhancement promoters are described in JP-A-11-65021, paragraph 0102.

The ultrahigh contrast agent used for the present invention is preferably selected from the group consisting of substituted alkene derivatives, substituted isoxazole derivatives and acetal compounds represented by the following formulas (VII), (VIII) and (IX), respectively.

(VII)

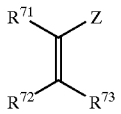

(VIII)

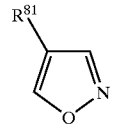

(IX)

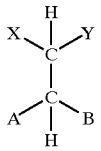

The compound represented by the formula (VII) will be described in detail below.

In the formula (VII), $R^{71}$, $R^{72}$ and $R^{73}$ independently represent a hydrogen atom or a substituent.

When $R^{71}$, $R^{72}$ or $R^{73}$ represents a substituent, examples of the substituent include a halogen atom (e.g., fluorine, chlorine, bromide, iodine), an alkyl group (including a cycloalkyl group and active methine group), an aralkyl group, an alkenyl group, an alkynyl group, an aryl group, a heterocyclic group (including N-substituted nitrogen-containing heterocyclic group), a quaternized nitrogen-containing heterocyclic group (e.g., pyridinio group), an acyl group, an alkoxycarbonyl group, an aryloxycarbonyl group, a carbamoyl group, a carboxyl group or a salt thereof, an imino group, an imino group substituted at N atom, a thiocarbonyl group, a sulfonylcarbamoyl group, an acylcarbamoyl group, a sulfamoylcarbamoyl group, a carbazoyl group, an oxalyl group, an oxamoyl group, cyano group, a thiocarbamoyl group, hydroxyl group or a salt thereof, an alkoxyl group (including a group containing ethyleneoxy group or propyleneoxy group repeating unit), an aryloxy group, a heterocyclyloxy group, an acyloxy group, an (alkoxy or aryloxy)carbonyloxy group, a carbamoyloxy group, a sulfonyloxy group, an amino group, an (alkyl, aryl or heterocyclyl)amino group, an acylamino group, a sulfonamido group, a ureido group, a thioureido group, an imido group, an (alkoxy or aryloxy)carbonylamino group, a sulfamoylamino group, a semicarbazide group, a thiosemicarbazide group, a hydrazino group, a quaternary ammonio group, an oxamoylamino group, an (alkyl or aryl) sulfonylureido group, an acylureido group, an acylsulfamoylamino group, nitro group, mercapto group, an (alkyl, aryl or heterocyclyl)thio group, an acylthio group, an (alkyl or aryl)sulfonyl group, an (alkyl or aryl)sulfinyl group, sulfo group or a salt thereof, a sulfamoyl group, an acylsulfamoyl group, a sulfonylsulfamoyl group or a salt thereof, a phosphoryl group, a group containing phosphoramide or phosphoric acid ester structure, a silyl group and a stannyl group. These substituents each may further be substituted with anyone or more of the above-described substituents.

The substituent represented by $R^{71}$, $R^{72}$ or $R^{73}$ is preferably a group having a total carbon atom number of from 0 to 30, and specific examples of the group include a group having the same meaning as the electron withdrawing group represented by Z in the formula (VII), an alkyl group, hydroxyl group or a salt thereof, mercapto group or a salt thereof, an alkoxyl group, an aryloxy group, a heterocyclyloxy group, an alkylthio group, an arylthio group, a heterocyclylthio group, an amino group, an alkylamino group, an arylamino group, a heterocyclylamino group, a ureido group, an acylamino group, a sulfonamido group and a substituted or unsubstituted aryl group and the like.

$R^{71}$ is preferably a hydrogen atom, an electron with drawing group, an aryl group, an alkylthio group, an alkoxyl group, an acylamino group or a silyl group. More preferably, it is an electron withdrawing group or an aryl group.

When $R^{71}$ represents an electron withdrawing group, $R^{71}$ is preferably a group having a total carbon atom number of from 0 to 30 such as a cyano group, a nitro group, an acyl group, a formyl group, an alkoxycarbonyl group, an aryloxycarbonyl group, a thiocarbonyl group, an imino group, an imino group substituted at N atom, an alkylsulfonyl group, an arylsulfonyl group, a carbamoyl group, a sulfamoyl group, a trifluoromethyl group, a phosphoryl group, carboxy group or a salt thereof, a saturated or unsaturated heterocyclic group, more preferably cyano group, an acyl group, a formyl group, an alkoxycarbonyl group, a carbamoyl group, an imino group, an imino group substituted at N atom, a sulfamoyl group, a carboxyl group or a salt thereof or a saturated or unsaturated heterocyclic group, particularly preferably cyano group, a formyl group, an acyl group, an alkoxycarbonyl group, a carbamoyl group or a saturated or unsaturated heterocyclic group.

When $R^{71}$ represents an aryl group, $R^{71}$ is preferably a substituted or unsubstituted phenyl group having a total carbon atom number of from 6 to 30. The substituent may be any substituent but an electron withdrawing substituent is preferred.

In the formula (VII), when $R^{72}$ or $R^{73}$ represents a substituent, $R^{72}$ or $R^{73}$ preferably represents a group having the same meaning as the electron withdrawing group represented by Z in the formula (VII) mentioned hereinafter, an alkyl group, hydroxyl group or a salt thereof, mercapto group or a salt thereof, an alkoxy group, an aryloxy group, a heterocyclyloxy group, an alkylthio group, an arylthio group, a heterocyclylthio group, an amino group, an alkylamino group, an anilino group, a heterocyclylamino group, an acylamino group or a substituted or unsubstituted phenyl group.

It is more preferred that one of $R^{72}$ and $R^{73}$ is a hydrogen atom and the other is a substituent. The substituent is preferably an alkyl group, hydroxyl group or a salt thereof, mercapto group or a salt thereof, an alkoxyl group, an aryloxy group, a heterocyclyloxy group, an alkylthio group, an arylthio group, a heterocyclylthio group, an amino group, an alkylamino group, an anilino group, a heterocyclylamino group, an acylamino group (particularly, a perfluoroalkanamido group), a sulfonamido group, a substituted or unsubstituted phenyl group or a heterocyclic group, more preferably hydroxyl group or a salt thereof, mercapto group or a salt thereof, an alkoxy group, an aryloxy group, a heterocyclyloxy group, an alkylthio group, an arylthio group, a heterocyclylthio group or a .heterocyclic group, still more preferably hydroxyl group or a salt thereof, an alkoxy group or a heterocyclic group.

In the formula (VII), Z represents an electron withdrawing group or a silyl group. More preferably, Z is an electron withdrawing group.

The electron withdrawing group represented by Z is a substituent having a Hammett's substituent constant σp of a positive value, and specific examples thereof include a cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, carboxy group or a salt thereof, sulfo group or a salt thereof, a heterocyclic group, an alkenyl group, an alkynyl group, an acyloxy group, an acylthio group, a sulfonyloxy group and an aryl group substituted with the above-described electron withdrawing group. The heterocyclic group is a saturated or unsaturated heterocyclic group, and examples thereof include a pyridyl group, a quinolyl group, a quinoxalinyl group, a pyrazinyl group, a benzotriazolyl group, an imidazolyl group, a benzimidazolyl group, a hydantoin-1-yl group, a succinimido group and a phthalimido group and so forth.

The electron withdrawing group represented by Z may further have one or more substituents, and examples of the substituents include those represented by $R^{71}$, $R^{72}$ or $R^{73}$ in the formula (VII).

When Z represents an electron withdrawing group, Z is preferably a group having a total carbon atom number of from 0 to 30 such as a cyano group, an alkoxycarbonyl group, an aryloxycarbonyl group, a carbamoyl group, a thiocarbonyl group, an imino group, an imino group substituted at N atom, a sulfamoyl group, an alkylsulfonyl group, an arylsulfonyl group, nitro group, a perfluoroalkyl group, an acyl group, a formyl group, a phosphoryl group, an acyloxy group, an acylthio group or a phenyl group substituted with an arbitrary electron withdrawing group, more preferably a cyano group, an alkoxycarbonyl group, a carbamoyl group, an imino group, a sulfamoyl group, an alkylsulfonyl group, an arylsulfonyl group, an acyl group, a formyl group, a phosphoryl group, a trifluoromethyl group or a phenyl group substituted with an arbitrary electron withdrawing group, still more preferably a cyano group, a formyl group, an acyl group, an alkoxycarbonyl group, an imino group or a carbamoyl group.

When Z represents a silyl group, it is preferably trimethylsilyl group, t-butyldimethylsilyl group, phenyldimethylsilyl group, triethylsilyl group, triisopropylsilyl group, trimethylsilyldimethylsilyl group or the like.

In the formula (VII), $R^{71}$ and Z, $R^{72}$ and $R^{73}$, $R^{71}$ and $R^{72}$, or $R^{73}$ and Z may be combined with each other to form a ring structure. It is particularly preferred that $R^{71}$ and Z or $R^{72}$ and $R^{73}$ form a ring structure.

The ring structure formed is a non-aromatic carbocyclic ring or a non-aromatic heterocyclic ring, preferably a 5-, 6- or 7-membered ring structure having a total carbon atom number including those of substituents of from 1 to 40, more preferably from 3 to 30.

The compound represented by the formula (VII) is more preferably a compound where Z represents a cyano group, a formyl group, an acyl group, an alkoxycarbonyl group, an imino group or a carbamoyl group, $R^{71}$ represents an electron withdrawing group or an aryl group, and one of $R^{72}$ and $R^{73}$ represents hydrogen atom and the other represents hydroxyl group or a salt thereof, mercapto group or a salt thereof, an alkoxy group, an aryloxy group, a heterocyclyloxy group, an alkylthio group, an arylthio group, a heterocyclylthio group or a heterocyclic group.

The compound represented by the formula (VII) is particularly preferably a compound where Z and $R^{71}$ form a non-aromatic 5-, 6- or 7-membered ring structure and one of $R^{72}$ and $R^{73}$ represents a hydrogen atom and the other represents hydroxyl group or a salt thereof, mercapto group or a salt thereof, an alkoxy group, an aryloxy group, a heterocyclyloxy group, an alkylthio group, an arylthio group, a heterocyclylthio group or a heterocyclic group. In such a compound, Z which forms a non-aromatic ring structure together with $R^{71}$ is preferably an acyl group, a carbamoyl group, an oxycarbonyl group, a thiocarbonyl group or a sulfonyl group or the like, and $R^{71}$ is preferably an acyl group, a carbamoyl group, an oxycarbonyl group, a thiocarbonyl group, a sulfonyl group, an imino group, an imino group substituted at N atom, an acylamino group or a carbonylthio group.

The compound represented by the formula (VIII) will be explained below.

In the formula (VIII), examples of the substituent represented by $R^{81}$ include those described for the substituent represented by $R^{71}$, $R^{72}$ or $R^{73}$ in the formula (VII). $R^{81}$ is preferably an electron withdrawing group.

When $R^{81}$ represents an electron withdrawing group, the electron withdrawing group is preferably a group having a total carbon atom number of from 0 to 30, such as a cyano group, a nitro group, an acyl group, a formyl group, an alkoxycarbonyl group, an aryloxycarbonyl group, an alkylsulfonyl group, an arylsulfonyl group, a carbamoyl group, a sulfamoyl group, a trifluoromethyl group, a phosphoryl group, an imino group or a saturated or unsaturated heterocyclic group, more preferably a cyano group, an acyl group, a formyl group, an alkoxycarbonyl group, a carbamoyl group, a sulfamoyl group, an alkylsulfonyl group, an arylsulfonyl group or a heterocyclic group, particularly preferably a cyano group, a formyl group, an acyl group, an alkoxycarbonyl group, a carbamoyl group or a heterocyclic group.

When $R^{81}$ represents an aryl group, $R^{81}$ is preferably a substituted or unsubstituted phenyl group having a total carbon atom number of from 0 to 30. Examples of the substituent include those described for the substituent represented by $R^{71}$, $R^{72}$ or $R^{73}$ in the formula (VII).

$R^{81}$ is particularly preferably a cyano group, an alkoxycarbonyl group, a carbamoyl group, a heterocyclic group or a substituted or unsubstituted phenyl group, most preferably a cyano group, a heterocyclic group or an alkoxycarbonyl group.

The compound represented by the formula (IX) will be explained below.

In the formula (IX), X and Y each independently represent a hydrogen atom or a substituent, or X and Y may be combined with each other to form a ring structure.

Examples of the substituent represented by X or Y. include those described for the substituent represented by $R^{71}$, $R^{72}$ or $R^{73}$ in the formula (VII). Specific examples thereof include an alkyl group (including a perfluoroalkyl group, a trichloromethyl group etc.), an aryl group, a heterocyclic group, a halogen atom, a cyano group, a nitro group, an alkenyl group, an alkynyl group, an acyl group, a formyl group, an alkoxycarbonyl group, an aryloxycarbonyl group, an imino group, an imino group substituted at N atom, a carbamoyl group, a thiocarbonyl group, an acyloxy group, an acylthio group, an acylamino group, an alkylsulfonyl group, an arylsulfonyl group, a sulfamoyl group, a phosphoryl group, carboxy group or a salt thereof, sulfo group or a salt thereof, hydroxyl group or a salt thereof, mercapto group or a salt thereof, an alkoxy group, an aryloxy group, a heterocyclyloxy group, an alkylthio group, an arylthio group, a heterocyclylthio group, an amino group, an alkylamino group, an anilino group, a heterocyclylamino group, a silyl group and so forth. These groups each may further have one or more substituents. Alternatively, X and Y may be combined with each other to form a ring structure, and the ring structure formed may be either a non-aromatic carbocyclic ring or a non-aromatic heterocyclic ring.

The substituent represented by X or Y is preferably a substituent having a total carbon number of from 1 to 40, more preferably from 1 to 30, such as a cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, a nitro group, a perfluoroalkyl group, an acyl group, a formyl group, a phosphoryl group, an acylamino group, an acyloxy group, an acylthio group, a heterocyclic group, an alkylthio group, an alkoxy group or an aryl group.

X and Y each more preferably represents a cyano group, a nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted at N atom, a phosphoryl group, a trifluoromethyl group, a heterocyclic group, a substituted phenyl group or the like, particularly preferably a cyano group, an alkoxycarbonyl group, a carbamoyl group, an alkylsulfonyl group, an arylsulfonyl group, an acyl group, an acylthio group, an acylamino group, a thiocarbonyl group, a formyl group, an amino group, an imino group substituted at N atom, a heterocyclic group, a phenyl group substituted by an arbitrary electron withdrawing group or the like.

X and Y are also preferably combined with each other to form a non-aromatic carbocyclic ring or a non-aromatic heterocyclic ring. The ring structure formed is preferably a 5-, 6- or 7-membered ring having a total carbon atom number including a substituent or substituents of from 1 to 40, more preferably from 3 to 30. X and Y for forming a ring structure each preferably represent an acyl group, a carbamoyl group, an oxycarbonyl group, a thiocarbonyl group, a sulfonyl group, an imino group, an imino group substituted at N atom, an acylamino group, a carbonylthio group or the like.

In the formula (IX), A and B each independently represent an alkoxy group, an alkylthio group, an alkylamino group, an aryloxy group, an arylthio group, an anilino group, a heterocyclyloxy group, a heterocyclylthio group or a heterocyclylamino group. Alternatively, A and B may be combined with each other to form a ring structure.

Those groups represented by A and B are preferably a group having a total carbon atom number of from 1 to 40, more preferably from 1 to 30, and the group may further have one or more substituents.

A and B are more preferably combined with each other to form a ring structure. The ring structure formed is preferably a 5-, 6- or 7-membered non-aromatic heterocyclic ring having a total carbon atom number of from 1 to 40, more preferably from 3 to 30. Examples of the linked structure formed by A and B (—A—B—) include —O—$(CH_2)_2$—O—, —O—$(CH_2)_3$—O—, —S—$(CH_2)_2$—S—, —S—$(CH_2)_3$—S—, —S—Ph—S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$—Ph—O—, —N$(CH_3)$—Ph—S—, —N(Ph)—$(CH_2)_2$—S— and so forth. Ph denotes a phenyl group.

The compound represented by one of the formulas (VII) to (IX) used in the present invention as an ultrahigh contrast agent may contain an adsorptive group capable of adsorbing silver halide. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorptive group to silver halide may be formed into a precursor. Examples of the precursor include the groups described in JP-A-2-285344.

The compound represented by one of the formulas (VII) to (IX) may contain a ballast group or polymer commonly used in immobile photographic additives such as a coupler. In particular, those containing a ballast group constitute a preferred embodiment of the present invention. The ballast group is a group having 8 or more carbon atoms and being relatively inactive to the photographic properties. Examples of the ballast group include an alkyl group, an aralkyl group, an alkoxyl group, a phenyl group, an alkylphenyl group, a phenoxy group, an alkylphenoxy group and so forth. Examples of the polymer include those described in JP-A-1-100530 and so forth.

The compound represented by one of the formulas (VII) to (IX) for use in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclyl)thio group, or a dissociative group capable of dissociation by a base (e.g., a carboxy group, a sulfo group, an acylsulfamoyl group, a carbamoylsulfamoyl group). In particular, groups containing an ethyleneoxy group or a propyleneoxy group as a repeating unit, or an (alkyl, aryl or heterocyclyl)thio group is preferred examples for the present invention. Specific examples of these groups include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

The compounds represented by formulas (VII) to (IX) used as an ultrahigh contrast agent in the present invention can be easily synthesized according to known methods, and may be synthesized by referring to, for example, U.S. Pat. Nos. 5,545,515, 5,635,339 and 5,654,130, International Patent Publication WO97/34196 or Japanese Patent Application Nos. 9-354107, 9-309813 and 9-272002.

Specific examples of the compounds represented by the formulas (VII) to (IX) for use in the present invention are shown below. However, the present invention is by no means limited to the following compounds.

1

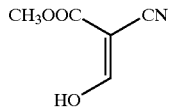

2

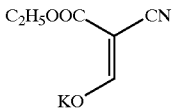

-continued
3
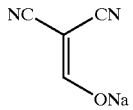
4
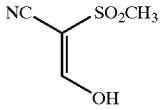
5
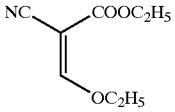
6
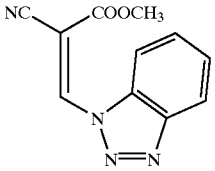
7
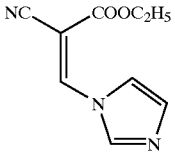
8
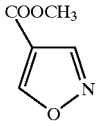
9
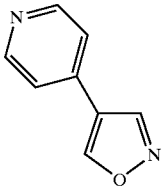
10
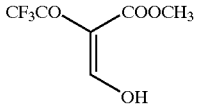
11
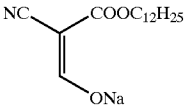
12
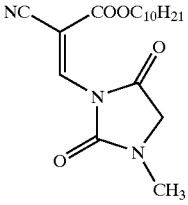
-continued
13
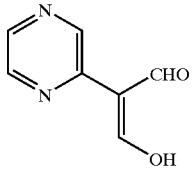
14
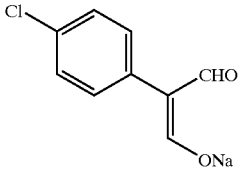
15
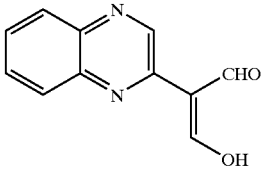
16
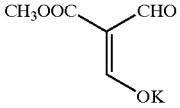
17
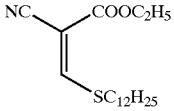
18
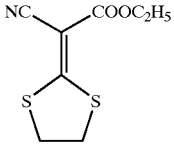
19
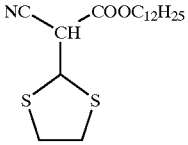
20
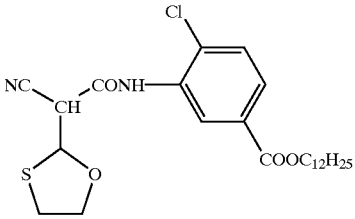
21
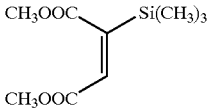
22
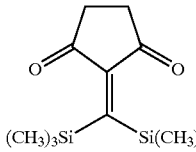

-continued
23
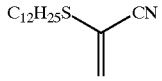
24
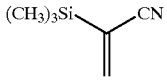
25
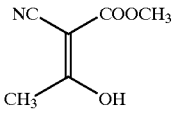
26
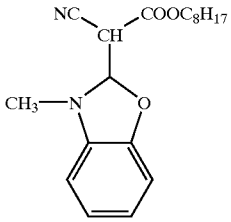
27
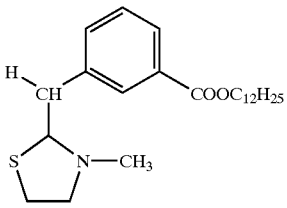
28
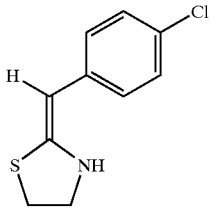
29
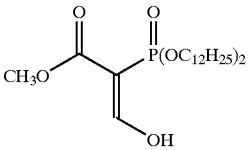
30
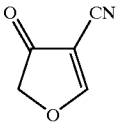
31
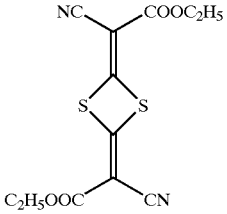
32
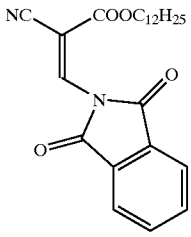
-continued
33
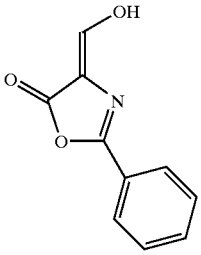
34
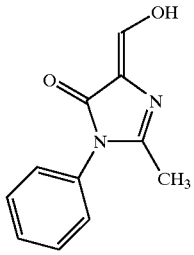
35
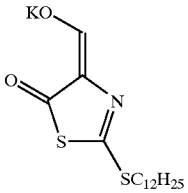
36
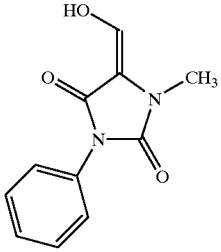
37
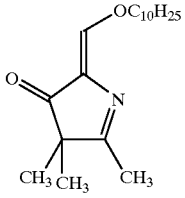
38
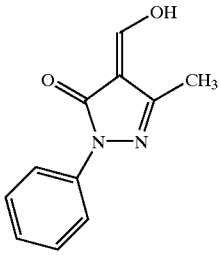
39
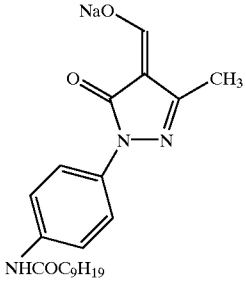

-continued
40
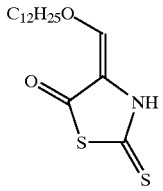
41
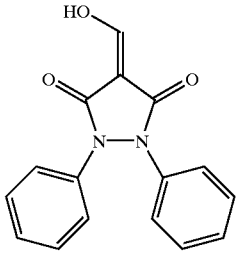
42
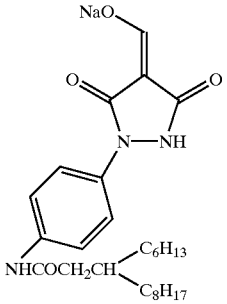
43
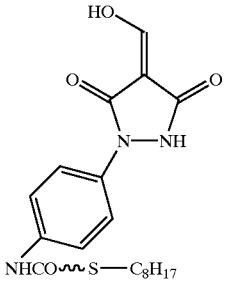
44
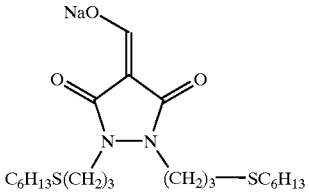
45
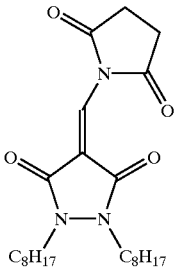
-continued
46
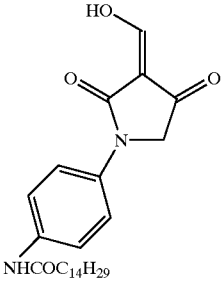
47
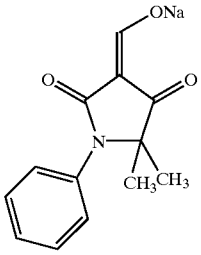
48
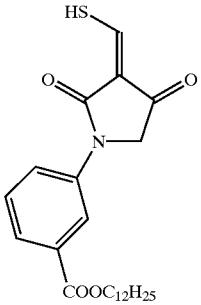
49
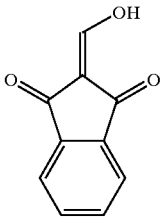
50
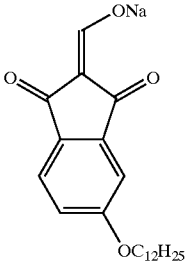
51
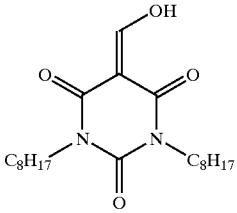

-continued
52
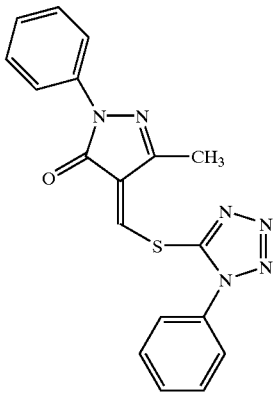
53
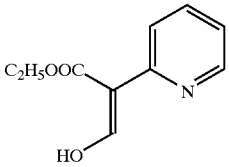
54
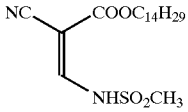
55
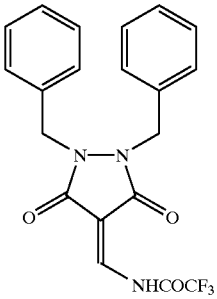
56
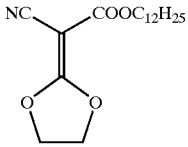
57
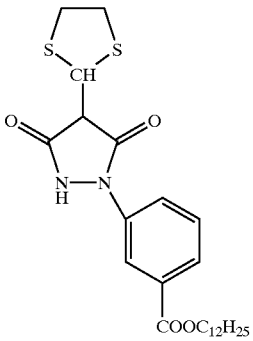
-continued
58
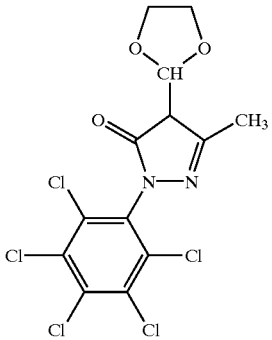
59
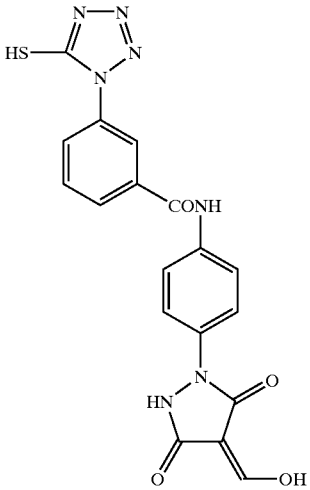
60
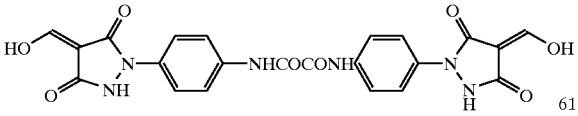
61
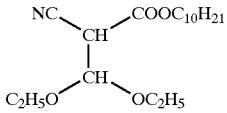
62
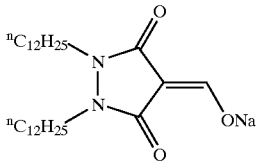
63
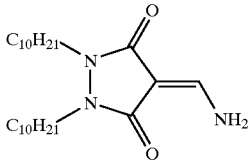
64
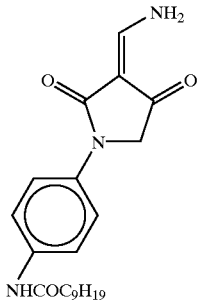

-continued

65

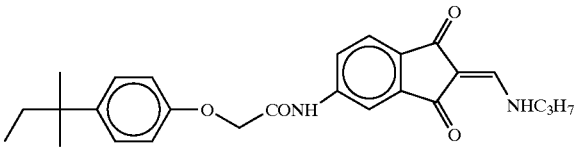

66

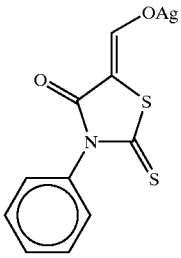

67

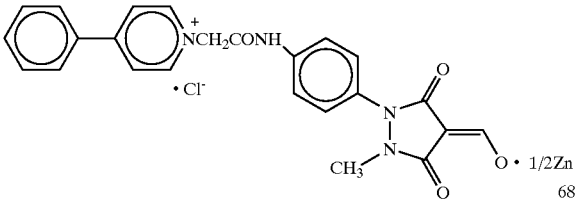

68

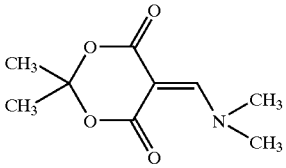

69

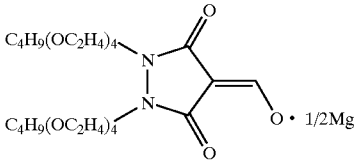

70

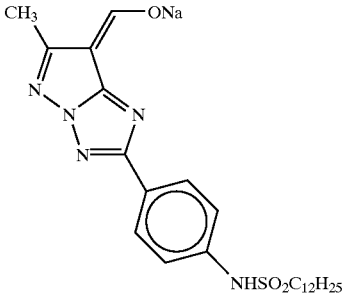

71

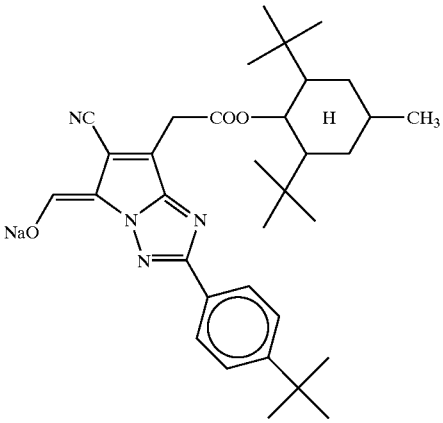

-continued

72

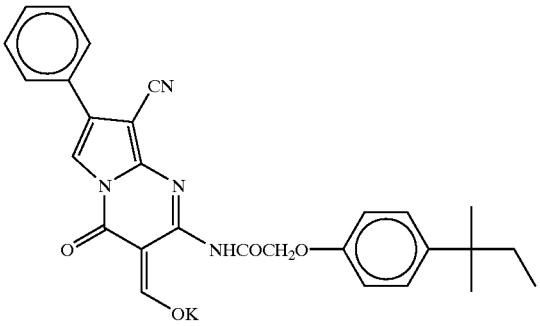

The addition amount of the compounds represented by the formulas (VII) to (IX) for use in the present invention is preferably from $1\times10^{-6}$ to 1 mole, more preferably from $1\times10^{-5}$ $5\times10^{-1}$ mole, most preferably from $2\times10^{-5}$ to $2\times10^{-1}$ mole, per mole of silver.

The compounds represented by the formulas (VII) to (IX) each may be used after dissolving it in water or an appropriate organic solvent such as an alcohol (e.g., methanol, ethanol, propanol, fluorinated alcohol), a ketone (e.g., acetone, methyl ethyl ketone), dimethylformamide, dimethyl sulfoxide or methyl cellosolve. Also, they may be dissolved by a known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, the compounds represented by the formulas (VII) to (IX) each may be used after dispersing the powder of the compounds in an appropriate solvent such as water by a method known as the solid dispersion method, using a ball mill, a colloid mill or an ultrasonic wave.

The compounds represented by the formulas (VII) to (IX) each may be added to a layer in the image-forming layer side on the support, namely, an image-forming layer, or any other layers on that side. However, the compounds are preferably added to an image-forming layer or a layer adjacent thereto.

The compounds represented by the formulas (VII) to (IX) may be used individually or in combination of two or more kinds of them. In addition to these compounds, any of the compounds mentioned in U.S. Pat. Nos. 5,545,515, 5,635,339 and 5,654,130, International Patent Publication WO97/34196, U.S. Pat. No. 5,686,228, JP-A-11-119372 or Japanese Patent Application Nos. 9-228881, 9-273935, 9-354107, 9-309813, 9-296174, 9-282564, JP-A-11-95365, JP-A-11-95366 and Japanese Patent Application No. 9-332388 may also be used in combination.

Furthermore, in the present invention, hydrazine derivatives disclosed in JP-A-10-339932 and JP-A-10-161270 may be used in combination. Further, the following hydrazine derivatives may also be used in such combination: the compounds represented by (Chem. 1) of JP-B-6-77138, specifically, compounds described at pages 3 and 4 of the publication; the compounds represented by the formula (I) of JP-B-6-93082, specifically, Compounds 1–38 described at pages 8 to 18 of the publication; the compounds represented by the formulas (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40 of the publication; the compounds represented by the formulas (1) and (2) of JP-A-6–289520, specifically, Compounds 1-1)

to 1-17) and 2-1) described at pages 5 to 7 of the publication; the compounds represented by (Chem. 2) and (Chem. 3) of JP-A-6-313936, specifically, compounds described at pages 6 to 19 of the publication; the compound. represented by (Chem. 1) of JP-A-6-313951, specifically, the compounds described at pages 3 to 5 of the publication; the compound represented by the formula (I) of JP-A-7-5610, specifically, Compounds I-1 to I-38 described at pages 5 to 10 of the publication; the compounds represented by the formula (II) of JP-A-7-77783, specifically, Compounds II-1 to II-102 described at pages 10 to 27 of the publication; the compounds represented by the formulas (H) and (Ha) of JP-A-7-104426, specifically, Compounds H-1 to H-44 described at pages 8 to 15 of the publication; the compounds characterized by having in the vicinity of the hydrazine group an anionic group or a nonionic group capable of forming an intramolecular hydrogen bond with a hydrogen atom of hydrazine, described in European Patent Publication EP713131A1, particularly, the compounds represented by the formulas (A) to (F), specifically, Compounds N-1 to N-30 described in the publication; the compound represented by the formula (1) described in European Patent Publication EP713131A1, specifically, Compounds D-1 to D-55 described in the publication; various hydrazine derivatives described at pages 25 to 34 of Kochi Gijutsu (Known Techniques), pages 1 to 207, Aztech (issued on Mar. 22, 1991); and Compounds D-2 and D-39 described in JP-A-62-86354 (pages 6 and 7).

The addition amount of these hydrazine derivatives is preferably from $1\times10^{-6}$ to 1 mole, more preferably from $1\times10^{-5}$ to $5\times10^{-1}$ mole, most preferably from $2\times10^{-5}$ to $2\times10^{-1}$ mole, per mol of silver.

These hydrazine derivatives may be used by dispersing them in the same manner as mentioned for the aforementioned compounds represented by the formulas (VII) to (IX).

The hydrazine derivatives may be added to any layers on the image-forming layer side on the support, i.e., the image-forming layer or other layers on that layer side. However, they are preferably added to an image-forming layer or a layer adjacent thereto.

Moreover, the acrylonitrile compounds disclosed in U.S. Pat. No. 5,545,515, more specifically the compounds CN-1 to CN-13 disclosed therein and so forth may also be used as the ultrahigh contrast agent.

In the present invention, a contrast accelerator may be used in combination with the above-described ultrahigh contrast agent so as to form an ultrahigh contrast image. Examples thereof include amine compounds described in U.S. Pat. No. 5,545,505, specifically, AM-1 to AM-5; hydroxamic acids described in U.S. Pat. No. 5,545,507, specifically, HA-1 to HA-11; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14.

Synthesis methods, addition methods, addition amounts and so forth of the aforementioned ultrahigh contrast agents and the contrast accelerators may be according to those described in the patent publications cited above.

When formic acid or a formic acid salt is used as a strongly fogging substance, it is preferably used on the side having the image-forming layer containing a photosensitive silver halide in an amount of 5 mmol or less, more preferably 1 mmol or less, per 1 mole of silver.

When a nucleating agent is used in the present invention, an acid formed by hydration of diphosphorus pentoxide or a salt thereof is preferably used together with the nucleating agent. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof may be used in a desired amount (coating amount per 1 $m^2$ of the photosensitive material) depending on the desired performance including sensitivity and fog. However, it can be used in an amount of preferably 0.1–500 $mg/m^2$, more preferably 0.5–100 $mg/m^2$.

The photothermographic material of the present invention may be provided with a surface protective layer, for example, to prevent adhesion of the image-forming layer. The surface protective layer is described in, for example, JP-A-11-65021, paragraphs 0119 to 0120.

Gelatin is preferred as the binder in the surface protective layer, and polyvinyl alcohol (PVA) is also preferably used. Examples of PVA includes, for example, completely saponified PVA-105 [having a polyvinyl alcohol (PVA) content of at least 94.0% by weight, a degree of saponification of 98.5±0.5 mole %, a sodium acetate content of 1.5% by weight or less, a volatile content of 5.0% by weight or less, a viscosity (4% by weight at 20° C.) of 5.6±10.4 mPa·s]; partially saponified PVA-205 [having a PVA content of 94.0% by weight, a degree of saponification of 88.0±1.5 mole %, a sodium acetate content of 1.0% by weight, a volatile content of 5.0% by weight, a viscosity (4% by weight at 20° C.) of 5.0±0.4 mPa·s]; denatured polyvinyl alcohols, MP-102, MP-202, MP-203, R-1130, R2105 (all from Kraray Co., Ltd.) and so forth. The application amount of the polyvinyl alcohol (per $m^2$ of the support) for protective layers is preferably 0.3 to 4.0 g/m , more preferably 0.3 to 2.0 $g/m^2$ (per one layer).

When the photothermographic material of the present invention is used for printing use is which dimensional change is critical, in particular, polymer latex is preferably used also in a protective layer or a back layer. Such latex is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. Specific example thereof include latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/ethylene (8.6 weight %)/2-hydroxyethyl methacrylate (5.1 weight %)/acrylic acid (2.0 weight %) copolymer and so forth. As for the binder of the protective layer, there may be used the combination of polymer latex disclosed in Japanese Patent Application No. 11-6872, and techniques disclosed in Japanese Patent Application No. 11-143058, paragraphs 0021–0025, Japanese Patent Application No. 11-6872, paragraphs 0027–0028, and Japanese Patent Application No. 11-199626, paragraphs 0023–0041.

The temperature for preparation of the coating solution for the image-forming layer may preferably be 30° C. to 65° C., more preferably 35° C. to 60° C., most preferably 35° C. to 55° C. The temperature of the coating solution immediately after the addition of the polymer latex may preferably be kept at 30° C. to 65° C. A reducing agent and a silver salt of an organic acid may preferably be mixed before the addition of polymer latex.

The coating solution for the image-forming layer is preferably a so-called thixotropic flow. Thixotropy means that viscosity of a fluid lowers with increase of shear rate. Any apparatus may be used for measurement of viscosity, and for example, RFS Fluid Spectrometer from Rheometrics Far East Co., Ltd. is preferably used and the measurement is performed at 25° C. Viscosity of the coating solution for the image-forming layer is preferably 400 mPa·s to 100,000 mPa·s, more preferably 500 mPa·s to 20,000 mPa·s, at a shear rate of 0.1 $sec^{-1}$. The viscosity is preferably 1 mPa·s to 200 mPa·s, more preferably 5 mPa·s to 80 mPa·s, at a shear rate of 1000 $sec^{-1}$.

Various systems exhibiting thixotropic property are known and, for example, described in "Lecture on Rheology", Kobunshi Kanko Kai; Muroi & Morino, "Polymer Latex", Kobunshi Knako Kai and so forth. A fluid is required to contain a large amount of fine solid microparticles to exhibit thixotropic property. For enhancing thixotropic property, it is effective that the fluids is added with a viscosity-increasing linear polymer, or fine solid microparticles to be contained have anisotropic shapes and an increased aspect ratio. Use of an alkaline viscosity-increasing agent or a surfactant is also effective for that purpose.

The photothermographic emulsion is provided as one or more layers on the support. When it is provided as a monolayer, the layer must contain a silver salt of an organic acid, silver halide, developing agent, binder and desired additional materials such as toning agent, coating aid and other auxiliary agents. When the layer is bilayer, the first emulsion layer (in general, the layer adjacent to the support) must contain a silver salt of an organic acid and silver halide, and the second emulsion layer or said two layers may contain the other ingredients. Another type of bilayer structure is also employable in which one layer is a single emulsion layer containing all necessary ingredients and the other layer is a protective top coat layer. Multicolor photothermographic material may contain these two layers for each color, or may contain all necessary ingredients in a single layer as described in U.S. Pat. No. 4,708,928. As for multicolor photothermographic materials containing multiple dyes, each emulsion layers are kept individually by using a functional or non-functional barrier layer between the adjacent photosensitive layers as described in U.S. Pat. No. 4,460,681.

In the image-forming layer, various types of dyes and pigments may be used to improve color tone, to prevent interference fringes generated during laser exposure, and to prevent irradiation. These techniques are detailed in International Patent Publication WO98/36322. Preferred dyes and pigments for the photothermographic material of the present invention include, for example, anthraquinone dyes, azomethine dyes, indoaniline dyes, azo dyes, indanthrone pigments of anthraquinone type (e.g., C.I. Pigment Blue 60 and so forth), phthalocyanine pigments (e.g., copper phthalocyanines such as C.I. Pigment Blue 15; metal-free phthalocyanines such as C.I. Pigment Blue 16), triarylcarbonyl pigments of printing lake pigment type, indigo, inorganic pigments (e.g., ultramarine, cobalt blue and so forth). Any methods are employed to add these dyes and pigments such as addition as a solution, an emulsion, or a dispersion of fine solid microparticles, or addition of a polymer mordant mordanted with these. The amount of these compounds to be used may vary depending on intended absorbance. In general, the compounds may preferably be used in an amount of 1 $\mu$g to 1 g per $m^2$ of the photothermographic material.

In the photothermographic material of the invention, an antihalation layer may be provided in a distant position from a light source relative to the photosensitive layer. The antihalation layer is described in JP-A-11-65021, paragraphs 0123 to 0124 and JP-A-11-223898.

In the photothermographic material of the present invention, a decoloring dye and a base precursor are preferably added to a non-photosensitive layer of the photothermographic material so that the non-photosensitive layer can function as a filter layer or an antihalation layer. Photothermographic materials generally have non-photosensitive layers in addition to the photosensitive layers. Depending on their positions, the non-photosensitive layers are classified into (1) a protective layer to be provided on a photosensitive layer (the opposite side of the support); (2) an intermediate layer to be provided between two or more of photosensitive layers or between a photosensitive layer and a protective layer; (3) an undercoat layer to be provided between a photosensitive layer and a support; (4) a backing layer to be provided on a side opposite to the photosensitive layer. The filter layer is provided in the photosensitive material as the layer (1) or (2). The antihalation layer is provided in the photosensitive material as the layer (3) or (4).

The decoloring dye and the base precursor are preferably added to the same non-photosensitive layer. They may be also added separately to adjacent two non-photosensitive layers. If desired, a barrier layer may be provided between the two non-photosensitive layers.

As methods to add a decoloring dye to a non-photosensitive layer, a method may be employed which comprises step of adding a solution, an emulsion, a solid microparticles dispersion of the dye, or the dye impregnated in a polymer to a coating solution for the non-photosensitive layer. The dye may also be added to the non-photosensitive layer by using a polymer mordant. These methods for addition are the same as those generally employed for the addition of dyes to ordinary photothermographic materials. Polymer latexes used for preparation of the dye impregnated in a polymer are described in U.S. Pat. No. 4,199,363, German Patent Laid-open Nos. 25,141,274, 2,541,230, European Patent Publication EP029104 and JP-B-53–41091. A method for emulsification by adding a dye to a solution in which a polymer is dissolved is described in International Patent Publication WO88/00723.

The amount of the decoloring dye may be determined depending on purpose of the use of the dye. In general, the dye is used in an amount to give an optical density (absorbance) of larger than 1.0 measured at an intended wavelength. The optical density is preferably 0.2 to 2. The amount of the dye to give such optical density may be generally from about 0.001 to about1 g/$m^2$, particularly preferably from about 0.01 to about 0.2 g/$m^2$.

Decoloring of dyes in that manner can lower optical density of the material to 0.1 or less. Two or more different decoloring dyes may be used in the thermodecoloring type recording materials or photothermographic materials. Similarly, two or more different base precursors may be used in combination.

The photothermographic material of the present invention is preferably a so-called single-sided photosensitive material comprising at least one photosensitive layer containing a silver halide emulsion on one side of support, and a backing layer on the other side.

The photothermographic material of the present invention may preferably contain a matting agent for improving the transferability of the material. Matting agents are described in JP-A-11-65021, paragraphs 0126 to 0127. The matting agent is added in an amount of preferably 1 to 400 mg/m$^2$, more preferably 5 to 300 mg/m$^2$, as the amount per 1 m$^2$ of the photosensitive material.

The matting degree of the surface of the emulsion layer is not particularly limited so long as the material is free from stardust defects. Beck's smoothness of the matted surface is preferably 30 seconds to 2000 seconds, more preferably 40 seconds to 1500 seconds.

The matting degree of the backing layer in the present invention is preferably falls 10 seconds to 1200 seconds, more preferably 20 seconds to 800 seconds, most preferably 40 seconds to 500 seconds as shown by the Beck's smoothness.

In the present invention, the matting agent may preferably be contained in the outermost surface layer, or in a layer functioning as an outermost surface layer, or in a layer near to the outer surface of the photothermographic material. The agent may also be preferably contained in a layer functioning as a protective layer.

The back layers that are applicable to the photothermographic material of the present invention are described in JP-A-11-65021, paragraphs 0128 to 0130.

A hardening agent may be added to the photosensitive layer, the protective layer, the back layer, and other layers. Examples of the hardening agent are described in T. H. James, "THE THEORY OF THE PHOTOGRAPHIC PROCESS, FOURTH EDITION", Macmillan Publishing Co., Inc., 1977, pp. 77–87. Polyvalent metal ions described on page 78 of the above article, polyisocyanates described in U.S. Pat. No. 4,281,060 and JP-A-6–208193; epoxy compounds described in U.S. Pat. No. 4,791,042; vinylsulfone compounds described in JP-A-62–89048 and so forth may preferably be used.

The hardening agent is added to coating solutions as a solution. Preferred addition time of the solution to the coating solution bf the protective layer resides in a period of from 180 minutes before the coating to just before the coating, preferably 60 minutes to 10 seconds before the coating. The method and conditions for mixing are not particularly limited so long as the effect of the present invention can be obtained satisfactorily. Specific examples of the mixing method include a method in which a mixing is performed in a tank designed so as to obtain a desired average residence time which is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

Surfactants that can be used in the present invention are described in JP-A-11-65021, paragraph 0132; usable solvents are described in the above patent document in paragraph 0133; usable supports are described in the above patent document in paragraph 0134; usable antistatic and electroconductive layers are described in the above patent document in paragraph 0135; and usable methods for forming color images are described in the above patent document in paragraph 0136.

The photothermographic material of the present invention preferably has a film surface pH of 6.0 or less, more preferably 5.5 or less before heat development. While the lower limit is not particularly limited, it is normally around 3. For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development. A method for measuring the film surface pH is described in Japanese Patent Application No. 11-87297, paragraph 0123.

As the transparent support of the photothermographic material of the present invention, preferably used is a polyester film, in particular, a polyethylene terephthalate film, subjected to a heat treatment in a temperature range of 130–185° C. in order to relax the internal distortion formed in the film during the biaxial stretching so that thermal shrinkage distortion occurring during the heat development is eliminated. In the case of a photothermographic material for medical use, the transparent support may be colored with a blue dye (for example, Dye-1 mentioned in the example of JP-A-8–240877), or may not be colored.

It is preferred that techniques for undercoating utilizing water-soluble polyester mentioned in JP-A-11-84574, styrene/butadiene copolymer mentioned in JP-A-10-186565, vinylidene chloride copolymer mentioned in Japanese Patent Application No. 11-106881, paragraphs 0063–0080and so forth are used for the support. As for an antistatic layer and undercoating, there can be used techniques disclosed in JP-A-56–143430, JP-A-56–143431, JP-A-58–62646, JP-A-56–120519, JP-A-11-84573, paragraphs 0040–0051, U.S. Pat. No. 5,575,973, JP-A-11-223898, paragraphs 0078–0084 and so forth.

The photothermographic material is preferably a monosheet type material (the monosheet uses no additional sheet as required by image receiving materials, and can form images directly on the material itself).

The photothermographic material may further contain an antioxidant, a stabilizer, a plasticizer, a ultraviolet absorber or a coating aid. Such additives may be added to any of photosensitive layers or non-photosensitive layers. For these additives, International Patent Publication WO98/36322, European Patent Publication EP803764A1, JP-A-10-186567, JP-A-10-18568 and so forth may be referred to.

The coating method for the preparation of the photothermographic material of the present invention is not particularly limited, and any coating methods may be employed. Specific examples thereof include various types of coating techniques, for example, extrusion coating, slide coating, curtain coating, dip coating, knife coating, flow coating, extrusion coating utilizing a hopper of the type described in U.S. Pat. No. 2,1681,294 and so forth. Preferred examples include extrusion coating and slide coating described in Stephen F. Kistler, Petert M. Schweizer, "LIQUID FILM COATING", published by CHAPMAN & HALL Co., Ltd., 1997, pp.399–536, and a most preferable example includes the slide coating. An example of the shape of a slide coater used for the slide coating is shown in FIG. 11*b,* 1, on page 427 of the aforementioned reference. If desired, two or more layers may be formed at the same time, for example, according to the methods described from page 399 to page 536 of the aforementioned reference, or the methods described in U.S. Pat. No. 2,761,791 and British Patent No. 837,095.

Figure 2:
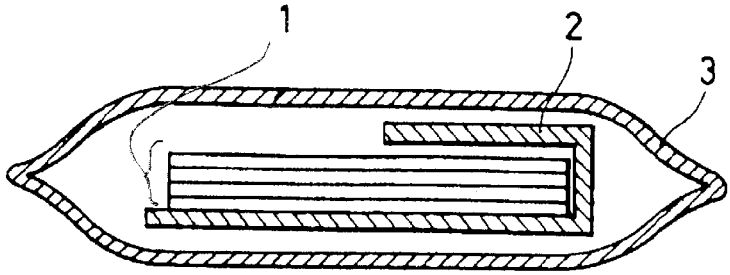
FIG. 2 shows an inner packaging material 2 containing stacked photothermographic material sheets 1 in a predetermined size, which is further packaged with an outer packaging material 3.
Figure 3:
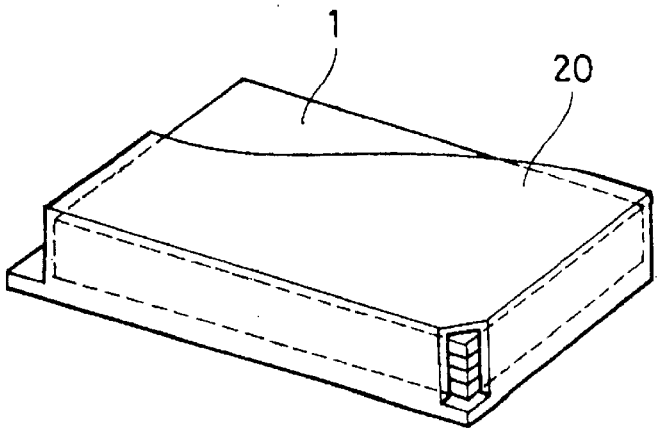
FIG. 3 shows stacked photothermographic material sheets 1 packaged with an inner packaging material 20.
Figure 4:
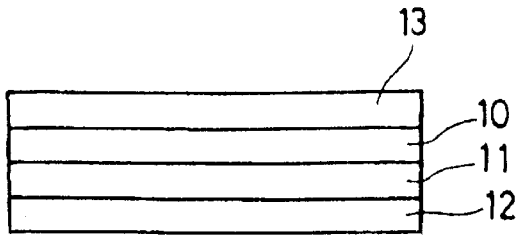
FIG. 4 is a side view of the photothermographic material having a support 10, an image-forming layer 11 and a surface protective layer 12 stacked in this order on one surface of the support, and a back layer 13 provided on the other side of the support.

Photothermographic materials may be cut into sheets of a predetermined size (half size, B4, A4, DK etc.), packaged with an inner packaging material and an outer packaging material as stacked multiple sheets, and shipped. In this case, the inner packaging material is preferably made of cardboard, polypropylene sheet, polyethylene sheet, laminated materials thereof etc. in order to keep the stacked state of the multiple photothermographic material sheets (e.g., 50–200 sheets) and prevent scratches and fold of the material. The material packaged with the inner packaging material is further packaged over the outer surface with the outer packaging material, which is laminated with, for example, Al, and has light shielding property and high gas barrier property. The state of the material thus packaged is shown in FIGS. 2 and 3. FIG. 3 shows a plurality of stacked photothermographic material sheets in a predetermined size packaged with an inner packaging material 20. Further, FIG. 2 shows the sheets. further packaged with an outer packaging material 3. As shown in FIG. 4, the photothermographic material 1 generally has a structure comprising a support 10, an image-forming layer 11 and a surface protective layer 12 stacked in this order on one surface of the support, and a back layer 13 provided on the other side of the support.

For the photothermographic material of the present invention, air space ratio within the outer packaging material is preferably 0.03–25%, more preferably 0.03–15%. The air space ratio within the outer packaging material is calculated by dividing air space volume in the outer packaging material with volume of the content in the outer packaging material and multiplying the quotient by 100. The air space volume is obtained by subtracting the volume formed by the photothermographic material and the volume of the inner packaging material from the inner volume of the outer packaging material.

Further, for the photothermographic material of the present invention, humidity in the outer packaging material is preferably 30–70%, more preferably 30–50%. If the photothermographic material is packaged so that the humidity in package is within the aforementioned range and shipped, performance change of the photothermographic material with time, in particular, density change around formed images, can further be suppressed, and thus stable performance can be obtained.

Other techniques that can be used for the production of the photothermographic material of the present invention are also described in European Patent Publications EP803764A1, EP883022A1, International Patent Publication WO98/36322, JP-A-56–62648, JP-A-58-62744, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-186572, JP-A-10-197974, JP-A-10-197982, JP-A-10-197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-125880, JP-A-11-129629, JP-A-11-133536, JP-A-11-133537, JP-A-11-133538, JP-A-11-133539, JP-A-11-133542 and JP-A-11-133543.

The photothermographic material of the present invention may be developed in any manner. Usually, an imagewise exposed photothermographic material is developed by heating. The temperature for the development is preferably 80° C. to 250° C., more preferably 100° C. to 140° C. The development time is preferably 1 to 180 seconds, more preferably 10 to 90 seconds, most preferably 10 to 40 seconds.

For thermal development for the material, a plate heater system is preferred. For heat development by the plate heater system, the method described in JP-A-11-133572 is preferred, which uses a heat development apparatus wherein a photothermographic material on which a latent image is formed is brought into contact with a heating means in a heat development section to obtain a visible image, and wherein the heating means comprises a plate heater, and a plurality of presser rollers are disposed facing to one surface of the plate heater, and wherein heat development of the photothermographic material is attained by passing the material between the presser rollers and the plate heater. The plate heater is preferably sectioned into 2 to 6 stages, and the temperature of the top stage is preferably kept lower by approximately 1 to 10° C. than that of the others stages. Such a method is also described in JP-A-54-30032. The plate heater system can remove moisture and organic solvent contained in the photothermographic material out of the material, and prevent change in shape of the support of the photothermographic material by rapid heating of the material.

The photothermographic material of the present invention can be exposed by any means. As light source of exposure, laser rays are preferred. As the laser used in the present invention, gas lasers ($Ar^+$, He—Ne), YAG lasers, dye lasers, semiconductor lasers and so forth are preferred. A comb nation of semiconductor laser and second harmonic generating device may also be used. Preferred examples include gas and semiconductor lasers for red to infrared emission.

Single mode lasers can be used as the laser rays, and the technique disclosed in JP-A-11-65021, paragraph 0140, can be used.

The laser output is preferably at least 1 mW, more preferably at least 10 mW. Even more preferred is high output of at least 40 mW. If desired, a plurality of lasers may be combined. The diameter of a laser beam may be between about 30 and 200 pm based on the level of $1/e^2$ spot size of a Gaussian beam.

An example of a laser imager provided with a light exposure section and a heat development section is Fuji Medical Dry Laser Imager FM-DP L. FM-DP L is described in Fuji Medical Review, No. 8, pages 39–55, and the techniques described therein can of course be used for laser imagers for the photothermographic material of the present invention.

The photothermographic material of the invention forms a monochromatic image based on silver image, and is preferably used as photothermographic materials for use in medical diagnosis, industrial photography, printing and COM. It should be understood that, in such applications, the monochromatic images formed can be duplicated on duplicating films, MI-Dup, from Fuji Photo Film for medical diagnosis; and for printing, the images can be used as a mask for forming reverse images on printing films such as DO-175 and PDO-100 from Fuji Photo Film, or on offset printing plates. Further, it can be used as a photothermographic material for laser imagers in "AD network", which is proposed by Fuji Medical System as a network system that conforms to the DICOM standard.

EXAMPLES

The present invention will be specifically explained with reference to the following examples. The materials, regents, ratios, procedures and so forth shown in the following examples can be optionally changed so long as such change does not depart from the spirit of the present invention. Therefore, the scope of the present invention is not limited to the following examples.

Example 1

Structures of the compounds used in Example 1 are shown below.

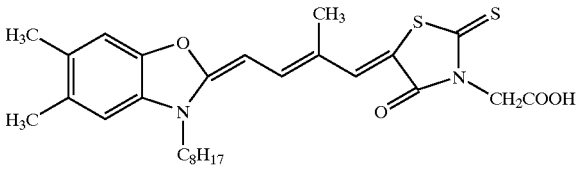

Spectral sensitizing dye A

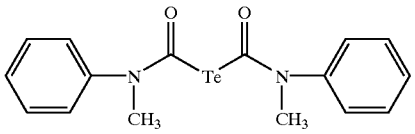

Tellurium sensitizer B

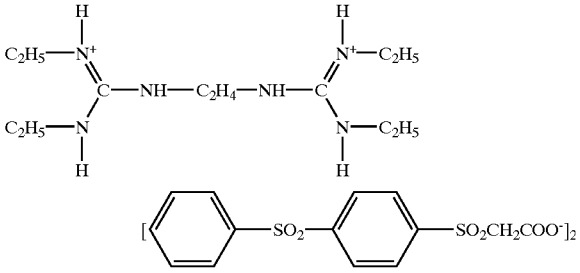

Base precursor compound 11

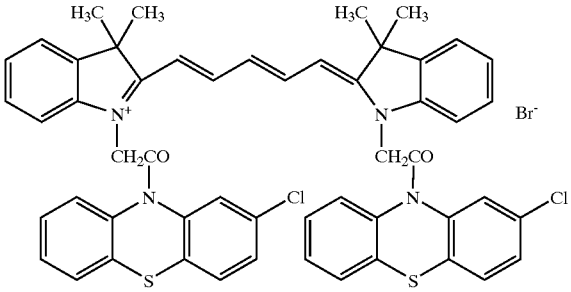

Cyanine dye compound 13

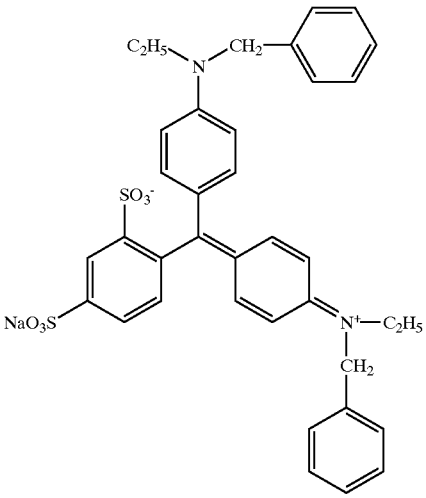

Blue dye compound 14

<<Preparation of PET Support>>

Using terephthalic acid and ethylene glycol, PET having an intrinsic viscosity IV of 0.66 (measured in phenol/tetrachloroethane=6/4 (weight ratio) at 25° C.) was obtained in a conventional manner The PET was pelletized, and the pellets were dried at 130° C. for 4 hours, melted at 300° C., extruded from a T-die, and quenched to prepare an unstretched film having such a thickness that the film thickness after thermal fixation should become 175 μm.

The film was stretched along the longitudinal direction by 3.3 times using rollers having different peripheral speeds and then stretched along the transverse direction by 4.5 times using a tenter. In this case, the temperatures were 110° C. and 130° C., respectively. Thereafter, the film was subjected to thermal fixation at 240° C. for 20 seconds and relaxed by 4% along the transverse direction at the same temperature. Then, after chucks of the tenter were released, the both edges of the film were knurled, and the film was rolled up at 4 kg/cm$^2$ to provide a roll of the film having a thickness of 175 μm.

<<Surface Corona Discharging Treatment>>

Using a solid state corona discharging treatment machine Model 6KVA manufactured by Piller Inc., both surfaces of the support were treated at room temperature at 20 m/minute. In this case, from the read out values of the electric current and voltage, it was seen that the treatment of 0.375 kV·A·minute/m$^2$ was applied to the support. The treated frequency in this case was 9.6 kHz and the gap clearance between the electrode and the dielectric roll was 1.6 mm.

<<Preparation of Undercoated Support>>

(1) Preparation of Coating Solutions for Undercoat Layers

| Formulation 1 (for undercoat layer on image-forming layer side) | |
|---|---|
| Pesresin A-515GB made by Takamatsu Yushi K.K. (30 weight % solution) | 234 g |
| Polyethylene glycol monononylphenyl ether (mean ethylene oxide number = 8.5, 10 weight % solution) | 21.5 g |
| MP-1000 made by Soken Kagaku K.K. (polymer microparticles, mean particle size: 0.4 μm) | 0.91 g |
| Distilled water | 744 ml |

| Formulation 2 (for 1st layer on back surface) | |
|---|---|
| Butadiene-styrene copolymer latex (solid content: 40% by weight, weight ratio of butadiene/styrene = 32/68) | 158 g |
| 2,4-Dichloro-6-hydroxy-S-triazine sodium salt (8 weight % aqueous solution) | 20 g |
| 1 weight % Aqueous solution of sodium laurylbenzenesulfonate | 10 ml |
| Distilled water | 854 ml |

| Formulation 3 (for 2nd layer on back surface side) | |
|---|---|
| $SnO_2$/SbO (weight ratio: 9/1, mean particle size: 0.038 μm, 17 weight % dispersion) | 84 g |
| Gelatin (10% aqueous solution) | 89.2 g |
| Metorose TC-5 made by Shin-Etsu Chemical Co., Ltd. (2% aqueous solution) | 8.6 g |
| MP-1000 (polymer microparticles) made by Soken Kagaku K.K. | 0.01 g |
| 1 weight % Aqueous solution of sodium dodecylbenzenesulfonate | 10 ml |

-continued

| Formulation 3 (for 2nd layer on back surface side) | |
|---|---|
| NaOH (1%) | 6 ml |
| Proxel (made by ICI Co.) | 1 ml |
| Distilled water | 805 ml |

<<Preparation of Undercoated Support>>

After applying the aforementioned corona discharging treatment to both surfaces of the aforementioned biaxially stretched polyethylene terephthalate support having a thickness of 175 μm, one surface (photosensitive layer side) thereof was coated with the undercoating solution of Formulation 1 by a wire bar in a wet coating amount of 6.6 ml/m$^2$ (per one surface) and dried at 180° C. for 5 minutes. Then, the back surface thereof was coated with the undercoating solution of Formulation 2 by a wire bar in a wet coating amount of 5.7 ml/m$^2$ and dried at 180° C. for 5 minutes. Further, the back surface thus coated was coated with the undercoating solution of Formulation 3 by a wire bar in a wet coating amount of 7.7 ml/m$^2$ and dried at 180° C. for 6 minutes to prepare an undercoated support.

<<Preparation of Coating Solution for Back Surface>>

(1) Preparation of Solid Microparticle Dispersion (a) of Base Precursor 64 g of Base precursor compound 11, 28 g of diphenylsulfone and 10 g of a surface active agent, Demor N (manufactured by Kao Corporation), were mixed with 220 ml of distilled water, and the mixture was beads-dispersed using a sand mill (¼ Gallon Sand Grinder Mill, manufactured by Imex Co.) to obtain Solid microparticle dispersion (a) of the base precursor compound having a mean particle size of 0.2 μm.

(2) Preparation of Dye Solid Microparticle Dispersion 9.6 g of Cyanine dye compound 13 and 5.8 g of sodium p-dodecylbenzenesulfonate were mixed with 305 ml of distilled water and the mixture was beads-dispersed using a sand mill (¼ Gallon Sand Grinder Mill, manufactured by Imex Co.) to obtain a dye solid microparticle dispersion having a mean particle size of 0.2 μm.

(3) Preparation of Coating Solution for Antihalation Layer 17 g of gelatin, 9.6 g of polyacrylamide, 70 g of the aforementioned Solid microparticle dispersion (a) of the base precursor, 56 g of the aforementioned dye solid microparticle dispersion, 1.5 g of polymethyl methacrylate microparticles (mean particle size 6.5 μm), 0.03 g of benzoisothiazolinone, 2.2 g of sodium polyethylenesulfonate, 0.2 g of Blue dye compound 14 and 844 ml of water were mixed to prepare a coating solution for antihalation layer.

<<Preparation of Coating Solution for Back Surface Protective Layer>>

In a container kept at 40° C., 50 g of gelatin, 0.2 g of sodium polystyrenesulfonate, 2.4 g of N,N-ethylenebis (vinylsulfonacetamide), 1 g of sodium t-octylphenoxyethoxyethanesulfonate, 30 mg of benzoisothiazolinone, 37 mg of N-perfluorooctylsulfonyl-N-propylalanine potassium salt, 0.15 g of polyethylene glycol mono(N-perfluorooctylsulfonyl-N-propyl-2-aminoethyl) ether [average polymerization degree of ethylene oxide: 15], 32 mg of $C_8F_{17}SO_3K$, 64 mg of $C_8F_{17}SO_2N(C_3H_7)(CH_2CH_2O)_4(CH_2)_4—SO_3Na$, 8.8 g of an acrylic acid/ethyl acrylate copolymer (copolymerization ratio (by weight): 5/95), 0.6 g of Aerosol OT (manufactured by American Cyanamid Company), 1.8 g (as liquid paraffin) of a liquid paraffin emulsion and 950 ml of water were mixed to form a coating solution for a back surface protective layer.

<<Preparation of Silver Halide Emulsion 1>>

1421 ml of distilled water was added with 8.0 ml of a 1 weight % potassium bromide solution, and further added with 8.2 ml of 1 mol/L nitric acid and 20 g of phthalized gelatin. Separately, Solution A was prepared by adding distilled water to 37.04 g of silver nitrate to dilute it to 159 ml, and Solution B was prepared by diluting 32.6 g of potassium bromide with distilled water to a volume of 200 ml. To the aforementioned mixture maintained at 37° C. and stirred in a titanium-coated stainless steel reaction vessel, the whole volume of Solution A was added by the control double jet method over 1 minute at a constant flow rate while pAg was maintained at 8.1. Solution B was also added by the control double jet method. Then, the mixture was added with 30 ml of 3.5 weight % aqueous hydrogen peroxide solution, and further added with 36 ml of a 3 weight % aqueous solution of benzimidazole. Separately, Solution A2 was prepared by diluting Solution A with distilled water to a volume of 317.5 ml, and Solution B2 was prepared by dissolving tripotassium hexachloroiridate in Solution B in such an amount that its final concentration should become $1\times10^{-4}$ mole per mole of silver, and diluting the obtained solution with distilled water to a volume twice as much as the volume of Solution B, 400 ml. The whole volume of Solution A2 was added to the mixture again by the control double jet method over 10 minutes at a constant flow rate while pAg was maintained at 8.1. Solution B2 was also added by the control double jet method. Then, the mixture was added with 50 ml of a 0.5 weight % solution of 2-mercapto-5-methylbenzimidazole in methanol. After pAg was raised to 7.5 with silver nitrate, the mixture was adjusted to pH 3.8 using 0.5 mol/L sulfuric acid, and the stirring was stopped. Then, the mixture was subjected to precipitation, desalting and washing with water, added with 3.5 g of deionized gelatin and 1 mol/L sodium hydroxide to be adjusted to pH 6.0 and pAg of 8.2 to form a silver halide dispersion.

The grains in the completed silver halide emulsion were pure silver bromide grains having a mean diameter as spheres of 0.053 μm and a variation coefficient of 18% for mean diameter as spheres. The grain size and others were obtained from averages for 1000 grains by using an electron microscope. The [100] face ratio of these grains was determined to be 85% by the Kubelka-Munk method.

The aforementioned emulsion was added with 0.035 g of benzoisothiazolinone (added as a 3.5 weight % methanol solution of the compound) with stirring at 38° C., and after 40 minutes since then, added with the solid dispersion (an aqueous gelatin solution) of Spectral sensitizing dye A in an amount of $5\times10^{-3}$ mole per mole of silver. After 1 minutes, the mixture was warmed to 47° C., and after 20 minutes, added with $3\times10^{-5}$ mole of sodium benzenethiosulfonate per mole of silver. Further after 2 minutes, the mixture was added with Tellurium sensitizer B in an amount of $5\times10^{-5}$ mole per mole of silver followed by ripening for 90 minutes. Immediately before finishing the ripening, the mixture was added with 5 ml of a 0.5 weight % methanol solution of N,N'-dihydroxy-N"-diethylmelamine, and after lowering the temperature to 31° C., added with 5 ml of a 3.5 weight % methanol solution of phenoxyethanol, $7\times10^{-3}$ mole of 5-methyl-2-mercaptobenzimidazole per mole of silver, and $6.4\times10^{-3}$ mole of 1-phenyl-2-heptyl-5-mercapto-1,3,4-triazole per mole of silver to prepare Silver halide emulsion 1.

<<Preparation of Silver Halide Emulsion 2>>

In the same manner as the preparation of Silver halide emulsion 1 except that the liquid temperature upon forming the grains was changed from 37° C. to 50° C., a pure silver bromide cubic grain emulsion having a mean grain size of 0.08 μm as spheres and a variation coefficient of 15% for size as spheres was prepared. Further, as in the case of Silver halide emulsion 1, the steps of precipitation, desalting, washing with water and dispersion were performed. Furthermore, in the same manner as in the case of Silver halide emulsion 1 except that the addition amount of Spectral sensitizing dye A was changed to $4.5\times10^{-3}$ mole per mole of silver, spectral sensitization, chemical sensitization and addition of 5-methyl-2-mercaptobenzimidazole and 1-phenyl-2-heptyl-5-mercapto-1,3,4-traizole were performed to obtain Silver halide emulsion 2.

<<Preparation of Silver Halide Emulsion 3>>

In the same manner as the preparation of Silver halide emulsion 1 except that the liquid temperature upon forming the grains was changed from 37° C. to 27° C., a pure silver b.romide cubic grain emulsion having a mean grain size of 0.038 μm as spheres and a variation coefficient of 20% for size as spheres was prepared. Further, as in the case of Silver halide emulsion 1, the steps of precipitation, desalting, washing with water and dispersion were performed. Further, in the same manner as in the case of Silver halide emulsion 1 except that the addition amount of Spectral sensitizing dye A was changed to $6\times10^{-3}$ mole per mole of silver, spectral sensitization, chemical sensitization, and addition of 5-methyl-2-mercaptobenz-imidazole and 1-phenyl-2-heptyl-5-mercapto-1,3,4-traizole were performed to obtain Silver halide emulsion 3.

<<Preparation of Mixed Emulsion A for Coating Solution>>

70% by weight of Silver halide emulsion 1, 15% by weight of Silver halide emulsion 2 and 15% by weight of Silver halide emulsion 3 were mixed and added with benzothiazolium iodide in an amount of $7\times10^{-3}$ mole per mole of silver as a 1 weight % aqueous solution to form Mixed emulsion A for coating solution.

<<Preparation of Scaly Fatty Acid Silver Salt>>

87.6kg of behenic acid (Edenor C22-85R, trade name, manufactured by Henkel Co.), 423 L of distilled water, 49.2 L of a 5 mol/L aqueous solution of NaOH, and 120 L of tert-butanol were mixed and allowed to react with stirring at 75° C. for one hour to obtain a solution of sodium behenate. Separately, 206.2 L of an aqueous solution containing 40.4 kg of silver nitrate (pH 4.0) was prepared and kept at 10° C. A mixture of 635 L of distilled water and 30 L of tert-butanol contained in a reaction vessel kept at 30° C. was added with the whole amount of the aforementioned sodium behenate solution and the whole amount of the aqueous silver nitrate solution at constant flow rates over the periods of 62 minutes and 10 seconds, and 60 minutes, respectively. In this case, they were added in such a manner that only the aqueous silver nitrate solution was added for 7 minutes and 20 seconds after starting the addition of the aqueous silver nitrate solution, and for 9 minutes and 30 seconds after finishing the addition of the aqueous silver nitrate solution, only the sodium behenate solution was added. In this operation, the outside temperature was controlled so that the temperature in the reaction vessel was 30° C. and the liquid temperature is constant. The piping of the addition system for the sodium behenate solution was warmed by steam trace and the steam opening was controlled such that the liquid temperature at the outlet orifice of the addition nozzle should be 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions are controlled at heights for not contacting with the reaction mixture.

After finishing the addition of the sodium behenate solution, the mixture was left with stirring for 20 minutes at the same temperature and then the temperature was decreased to 25° C. Thereafter, the solid content was recovered by centrifugal filtration and the solid content was washed with water until electric conductivity of the filtrate became 30 μS/cm. Thus, a fatty acid silver salt was obtained. The solid content was stored as a wet cake without being dried.

When the shape of the obtained silver behenate grains was evaluated by an electron microscopic photography, the grains were scaly crystals having a=0.14 μm, b=0.4 μm, and c=0.6 μm in mean values, a mean aspect ratio of 5.2, a mean diameter as spheres of 0.52 μm, and a variation coefficient of 15% for mean diameter as spheres (a, b and c have the meanings defined in the present specification).

To the wet cake corresponding to 100 g of the dry solid content was added with 7.4 g of polyvinyl alcohol (PVA-217, trade name, average polymerization degree: 1700) and water to make the total amount 385 g, and the mixture was pre-dispersed by a homomixer.

Then, the pre-dispersed stock dispersion was treated three times by using a dispersing machine (Microfluidizer-M-110S-EH; trade name, manufactured by Microfluidex International Corporation, using GLOZ interaction chamber) with a pressure controlled to be 1750 kg/cm$^2$ to obtain a silver behenate dispersion. During the cooling operation, a dispersion temperature of 18° C. was achieved by providing coiled heat exchangers fixed before and after the interaction chamber and controlling the temperature of the refrigerant.

<<Preparation of 25 Weight % Dispersion of Reducing Agent>>

10 kg of 1,1-bis(2-hydroxy-3,5-dimethylphenyl)-3,5,5-tri-methylhexane and 10 kg of a 20 weight % aqueous solution of denatured polyvinyl alcohol (Poval MP203, manufactured by Kuraray Co. Ltd.) were added with 16 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 3 hours and 30 minutes. Then, the slurry was added with 0.2 g of benzothiazolinone sodium salt and water so that the concentration of the reducing agent became 25% by weight to obtain a reducing agent dispersion. The reducing agent particles contained in the reducing agent dispersion obtained as described above had a median diameter of 0.40 μm and the maximum particle size of 1.8 μm or shorter. The obtained reducing agent dispersion was filtered through a polypropylene filter having a pore size of 10.0 μm to remove dusts and so forth, and stored.

<<Preparation of 10 Weight % Dispersion of Mercapto Compound>>

5 kg of 1-phenyl-2-heptyl-5-mercapto-1,3,4-triazole and 5 kg of a 20 weight % aqueous solution of denatured polyvinyl alcohol (Poval MP203, manufactured by Kuraray Co., Ltd.) were added with 8.3 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 6 hours. Then, the slurry was added with water so that the concentration of the mercapto compound became 10 weight % to obtain a mercapto compound dispersion. The mercapto compound particles contained in the mercapto compound dispersion obtained as described above had a median diameter of 0.40 μm and the maximum particle size of 2.0 μm or less. The mercapto compound dispersion was filtered through a polypropylene filter having a pore size of 10.0 μm to remove dusts and so forth, and stored. The dispersion was filtered through a polypropylene filter having a pore size of 10.0 μm immediately before use.

<<Preparation of 20 weight % Dispersion of Organic Polyhalogenated Compound >>

5 kg of tribromomethylnaphthylsulfone, 2.5 kg of a 20 weight % aqueous solution of denatured polyvinyl alcohol (Poval MP203, manufactured by Kuraray Co., Ltd.) and 213 g of 20 weight % aqueous solution of sodium triisopropylnaphthalenesulfonate were added with 10 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 5 hours. Then, the slurry was added with 0.2 g of benzisothiazolinone sodium salt and water so that the concentration of the organic polyhalogenated compound became 20 weight % to obtain an organic polyhalogenated compound dispersion. The organic polyhalogenated compound particles contained in the polyhalogenated compound dispersion obtained as described above had a median diameter of 0.36 μm and the maximum particle size of 2.0 μm or less. The obtained organic polyhalogenated compound dispersion was filtered through a polypropylene filter having a pore size of 3.0 μm to remove dusts and so forth, and stored.

<<Preparation of 25 Weight % Dispersion of Organic Polyhalogenated Compound 2>>

A dispersion was prepared in the same manner as the preparation of the 20 weight % dispersion of organic polyhalogenated compound 1 except that 5 kg of N-butyl-3-tribromomethanesulfonylbenzamide was used instead of 5 kg of tribromomethylnaphthylsulfone, diluted so that the concentration of the organic polyhalogenated compound became 25 weight %, and filtered. The organic polyhalogenated compound particles contained in the organic polyhalogenated compound dispersion obtained as described above had a median diameter of 0.39 μm and the maximum particle size of 2.2 μm or less. The obtained organic polyhalogenated compound dispersion was filtered through a polypropylene filter having a pore size of 3.0 μm to remove dusts and so forth, and stored.

<<Preparation of 30 Weight % Dispersion of Organic Polyhalogenated Compound 3>>

A dispersion was prepared in the same manner as the preparation of the 20 weight % dispersion of organic polyhalogenated compound 1 except that 5 kg of tribromomethylphenylsulfone was used instead of 5 kg of tribromomethylnaphthylsulfone and the amount of the 20 weight % aqueous solution of MP203 was changed to 5 kg, diluted so that the concentration of the organic polyhalogenated compound became 30 weight %, and filtered. The organic polyhalogenated compound particles contained in the organic polyhalogenated compound dispersion obtained as described above had a median diameter of 0.41 μm and the maximum particle size of 2.0 μm or less. The obtained organic polyhalogenated compound dispersion was filtered through a polypropylene filter having a pore size of 3.0 μm to remove dusts and so forth, and stored. The dispersion was stored at 10° C. or less until use.

<<Preparation of 5 Weight % Solution of Phthalazine Compound>>

8 kg of denatured polyvinyl alcohol (Poval MP-203, manufactured by Kuraray Co., Ltd.) was dissolved in 174.57 kg of water and then added with 3.15 kg of 20 weight % aqueous solution of sodium triisopropylnaphthalenesulfonate and 14.28 kg of 70 weight % aqueous solution of 6-isopropylphthalazine to obtain a 5 weight % solution of 6-isopropylphthalazine.

<<Preparation of 20 Weight % Dispersion of Pigment>>

64 g of C.I. Pigment Blue 60 and 6.4 g of Demor N manufactured by Kao Corporation were added with 250 g of water and mixed sufficiently to provide slurry. Then, 800 g of zirconia beads having a mean diameter of 0.5 mm were placed in a vessel together with the slurry and the slurry was dispersed by a dispersing machine (¼G Sand Grinder Mill; manufactured by Imex Co.) for 25 hours to obtain a pigment dispersion. The pigment particles contained in the pigment dispersion obtained as described above had a mean particle size of 0.21 μm.

<<Preparation of 40 Weight % SBR Latex>>

SBR latex purified by ultrafiltration (UF) was obtained as follows.

The SBR latex mentioned below diluted by 10 times with distilled water was diluted and purified by using an UF-purification module FS03-FC-FUYO3A1 (manufactured by Daisen Membrane System K.K.) until the ion conductivity became 1.5 ms/cm, and added with Sandet-BL (manufactured by SANYO CHEMICAL INDUSTRIES, LTD.) to a concentration of 0.22% by weight. Further, the latex was added with NaOH and $NH_4OH$ so that the ratio $Na^-$ ion:$NH_4^-$ ion became 1:2.3 (molar ratio) to adjust pH to 8.4. At this point, the concentration of the latex was 40% by weight.

(SBR latex: a latex of —St(68)—Bu(29)—AA(3)—, wherein the numerals in the parentheses indicate the contents in terms of % by weight, St represents styrene, Bu represents butadiene and AA represents acrylic acid).

The latex had the following characteristics: mean particle size of 0.1 μm, concentration of 45%, equilibrated moisture content of 0.6% by weight at 25° C. and relative humidity 60%, and ion conductivity of 4.2 mS/cm (measured for the latex stock solution (40%) at 25° C. by using a conductometer, CM-30 ,-manufactured by Toa Electronics, Ltd.), pH 8.2.

<<Preparation of Coating Solution for Image-forming Layer>>

1.1 g of the 20 weight % aqueous dispersion of the pigment obtained above, 103 g of the organic acid silver salt dispersion, 5 g of the 20 weight % aqueous solution of polyvinyl alcohol, PVA-205 (manufactured by Kuraray Co., Ltd.), 25 g of the 25 weight % dispersion of the reducing agent, 13.2 g in total of the dispersions of organic polyhalogenated compounds 1 to 3 (weight ratio=2:5:2), 6.2 g of the 10 weight % dispersion of mercapto compound, 106 g of the 40 weight % SBR latex purified by ultrafiltration (UF) and undergone pH adjustment, and 18 ml of the 5 weight % solution of the phthalazine compound were combined, added with 10 g of Silver halide emulsion A, and mixed sufficiently to prepare a coating solution for image-forming layer (photosensitive layer, emulsion layer). The coating solution was fed as it was to a coating die in such a feeding amount giving a coating amount of 70 ml/$m^2$ and coated.

The viscosity of the coating solution for emulsion layer described above was measured by a B-type viscometer manufactured by Tokyo Keiki K.K. and found to be 85 [mPa·s] at 40° C. (Rotor No. 1, 60 rpm).

The viscosity of the coating solution was measured at 25° C. by an RFS fluid spectrometer produced by Rheometric Far East Co., Ltd., and found to be 1500, 220, 70, 40 and 20 [mPa·s] at shear rates of 0.1, 1, 10, 100 and 1000 [1/second], respectively.

<<Preparation of Coating Solution for Intermediate Layer on the Emulsion Layer Surface>>

772 g of an aqueous solution of 10% by weight polyvinyl alcohol, PVA-205 (manufactured by Kuraray Co., Ltd.), 5.3 g of the 20 weight % dispersion of the pigment, and 226 g of a 27.5 weight % latex of methyl methacrylate/styrene/butyl acrylate/hydroxyethyl methacrylate/acrylic acid copolymer (copolymerization ratio (by weight): 64/9/20/5/2) were added with 2 ml of a 5 weight % aqueous solution of Aerosol OT (manufactured by American Cyanamid Company), 10.5 ml of a 20 weight % aqueous solution of phthalic acid diammonium salt and water in such an amount giving a total amount of 880 g to form a coating solution for intermediate layer. This coating solution was fed to a coating die in such an amount that gave a coating amount of 10 ml/m$^2$.

The viscosity of the coating solution measured by a B-type viscometer at 40° C. (Rotor No. 1, 60 rpm) was 21 [mPa·s].

<<Preparation of Coating Solution for 1st Protective Layer on Emulsion Layer Surface>>

64 g of inert gelatin was dissolved in water, added with 80 g of a 27.5 weight % latex solution of methyl methacrylate/styrene/butyl acrylate/hydroxyethyl methacrylate/acrylic acid copolymer (copolymerization ratio (by weight): 64/9/20/5/2), 23 ml of a 10 weight % methanol solution of phthalic acid, 23 ml of a 10 weight % aqueous solution of 4-methylphthalic acid, 28 ml of 0.5 mol/L sulfuric acid, 5 ml of a 5 weight % aqueous solution of Aerosol OT (manufactured by American Cyanamid Company), 0.5 g of phenoxyethanol, 0.1 g of benzoisothiazolinone, and water in such an a mount that gave a total amount of 750 g to form a coating solution. The coating solution was mixed with 26 ml of 4 weight % chromium alum by a static mixer immediately before coating, and fed to a coating die in such an amount that gave a coating amount of 18.6 ml/m$^2$.

The viscosity of the coating solution measured by a B-type viscometer (Rotor No. 1, 60 rpm) at 40° C. was 17 [mPa·s].

<<Preparation of Coating Solution for 2nd Protective Layer on Emulsion Layer Surface>>

80 g of inert gelatin was dissolved in water, added with 102 g of a 27.5 weight % latex solution of methyl methacrylate/styrene/butyl acrylate/hydroxyethyl methacrylate/acrylic acid copolymer (copolymerization ratio (by weight): 64/9/20/5/2), 3.2 ml of a 5 weight % solution of N-perfluorooctylsulfonyl-N-propylalanine potassium salt, 32 ml of a 2 weight % aqueous solution of polyethylene glycol mono(N-perfluorooctylsulfonyl-N-propyl-2-aminoethyl) ether [average polymerization degree of ethylene oxide=15], 23 ml of a 5 weight % aqueous solution of Aerosol OT (manufactured by American Cyanamid Company), 4 g of polymethyl methacrylate microparticles (mean particle size: 0.7 $\mu$m), 21 g of polymethyl methacrylate microparticles (mean particle size: 6.4 mn), 1.6 g of 4-methylphthalic acid, 4.8 g of phthalic acid, 44 ml of 0.5 mol/L sulfuric acid, 10 mg of benzoisothiazolinone and water in such an amount that gave a total amount of 650 g. The mixture was further mixed with 445 ml of an aqueous solution containing 4 weight % chromium alum and 0.67 weight % of phthalic acid by a static mixer immediately before coating to form a coating solution for surface protective layer, which was fed to a coating die in such an amount that gave a coating amount of 8.3 ml/m$^2$.

The viscosity of the coating solution measured by a B-type viscometer (Rotor No. 1, 60 rpm) at 40° C. was 9 [mPa·s].

<<Preparation of Photothermographic Material>>

On the back side of the aforementioned support having an undercoat layer, the coating solution for antihaltion layer and the coating solution for back surface protective layer were simultaneously applied as stacked layers so that the applied solid content amount of the solid microparticle dye in the antihalation layer became 0.04 g/m$^2$, and the applied amount of gelatin in the protective layer becomes 1.7 g/m$^2$, and dried to form an antihalation back layer.

Then, on the side opposite to the back side, an image-forming layer (coated silver amount of the silver halide was 0.14 g/m$^2$), intermediate layer, first protective layer, and second protective layer were simultaneously applied in this order from the undercoat layer by the slide bead application method as stacked layers to form Sample 001 of photothermographic material.

The coating was performed at a speed of 160 m/min. The gap between the tip of coating die and the support was set to be 0.14 to 0.28 mm, and the coated width was controlled so that it spread by 0.5 mm each at both sides compared with the projecting slit width of the coating solution. The pressure in the reduced pressure chamber was adjusted to be lower than the atmospheric pressure by 392 Pa. In this case, handling, temperature and humidity were controlled so that the support was not electrostatically charged and electrostatic charge was further eliminated by ionized wind immediately before the coating. In the subsequent chilling zone, the material was blown with air showing a dry-bulb temperature of 18° C. and a wet-bulb temperature of 12° C. for 30 seconds to cool the coating solutions. Then, in the floating type drying zone in a coiled shape, the material was blown with drying air showing a dry-bulb temperature of 30° C. and a wet-bulb temperature of 18° C. for 200 seconds. Subsequently, the material was passed through a drying zone of 70° C. for 20 seconds, and then another drying zone of 90° C. for 10 seconds, and cooled to 25° C. to evaporate the solvent in the coating solution. The average wind velocities of the wind applied to the coated layer surface in the chilling zone and the drying zones were 7 m/sec.

The prepared photothermographic material showed matting degrees of 55 seconds for the image-forming layer side, and 130 seconds for the back surface, in terms of Beck's smoothness.

Samples 102 to 123 were prepared wherein coating amounts of a phenolic reducing agent (compound of the formula (I)) and a compound satisfying at least one of the requirements A and B were adjusted as shown in Table 1 so that they gave development density substantially the same as that of the aforementioned Sample 101, and evaluated for image storability. When these samples were prepared, the phenolic reducing agents (compound of the formula (I)) were used instead of 1,1-bis(2-hydroxy-3,5-dimethylphenyl) -3,5,5-trimethylhexane used for the aforementioned 25% dispersion of reducing agent.

Compound (II-2) of Sample 102 was incorporated as the following dispersion after forming the image-forming layer. As for the amount used, it was used in an amount equimolar to the reducing agent. As for Samples 103–123, each of the compounds mentioned in Table 1 was dispersed in the same manner, and used in the amount mentioned in Table 1 (represented as a relative mole % based on the amount of Compound (II-2), which is taken as 100%).

<<Preparation of Dispersion of Compound II-2>>

1 kg of Compound II-2 and 1 kg of a 20 weight % aqueous solution of denatured polyvinyl alcohol (Poval MP203, manufactured by Kuraray Co., Ltd.) were added with 1.6 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 3 hours and 30 minutes. Then, the slurry was added with 0.2 g of benzisothiazolinone sodium salt and water so that the concentration of the phosphoryl compound became 25 weight % to obtain solid microparticle dispersion of the phosphoryl compound. The phosphoryl compound particles contained in the dispersion obtained as described above had a median diameter of 0.45 μm and the maximum particle size of 2.0 μm or shorter. The obtained dispersion was filtered through a polypropylene filter having a pore size of 10.0 μm to remove dusts and so forth, and stored.

Image storability of the samples was evaluated by storing each photosensitive material after heat development at 60° C. and relative humidity of 50% for one day, and measuring change of densities Δ Dmin in blank portions before and after the storage. The results are shown in Table 1.

TABLE 1

| Sample No. | Reducing agent of formula (I) Type | Coated amount (relative mol %) | Compound used in combination with reducing agent Type | Coated amount (relative mol %) | Image storability ΔDmin | Note |
|---|---|---|---|---|---|---|
| 101 | (I-1) | 100 | — | — | 0.127 | Comparative |
| 102 | (I-1) | 100 | (II-2) | 100 | 0.026 | Invention |
| 103 | (I-2) | 80 | (II-2) | 80 | 0.021 | Invention |
| 104 | (I-3) | 50 | (II-2) | 50 | 0.035 | Invention |
| 105 | (I-4) | 65 | (II-2) | 65 | 0.033 | Invention |
| 106 | (I-7) | 90 | (II-2) | 90 | 0.032 | Invention |
| 107 | (I-7) | 90 | (2) | 90 | 0.094 | Invention |
| 108 | (I-1) | 100 | (2) | 100 | 0.091 | Invention |
| 109 | (I-1) | 100 | (6) | 100 | 0.037 | Invention |
| 110 | (I-1) | 100 | (8) | 100 | 0.063 | Invention |
| 111 | (I-1) | 100 | (11) | 100 | o.051 | Invention |
| 112 | (I-1) | 100 | (13) | 100 | 0.043 | Invention |
| 113 | (I-1) | 100 | (15) | 100 | 0.047 | Invention |
| 114 | (I-1) | 100 | (16) | 100 | 0.059 | Invention |
| 115 | (I-1) | 100 | (17) | 100 | 0.062 | Invention |
| 116 | (I-1) | 100 | (II-51) | 100 | 0.069 | Invention |
| 117 | (I-1) | 100 | (II-4) | 100 | 0.049 | Invention |
| 118 | (I-1) | 100 | (II-8) | 100 | 0.018 | Invention |
| 119 | (I-1) | 100 | (II-26) | 100 | 0.084 | Invention |
| 120 | (I-1) | 100 | (23) | 100 | 0.047 | Invention |
| 121 | (I-1) | 100 | (24) | 100 | 0.056 | Invention |
| 122 | (I-1) | 100 | (29) | 100 | 0.040 | Invention |
| 123 | (I-1) | 100 | p-Methoxybenzonitrile | 100 | 0.165 | Comparative |

*Kf = 9.8 ± 0.4

As clearly seen from the results shown in Table 1, the image storability was markedly improved by the combinations according to the present invention.

Example 2

Photothermographic materials were obtained in the same manner as in Example 1 except that Silver halide emulsions 1–3, Mixed emulsion A for coating, the solid fine particle dispersion of reducing agent, the 25 weight % dispersion of organic polyhalogenated compound 2, the 30 weight % dispersion of organic polyhalogenated compound 3 and the coating solution for image-forming layer used in Example 1 were replaced with those prepared by the following methods and a phosphoryl compound dispersion was used.

<<Preparation of Silver Halide Emulsion 1>>

1421 ml of distilled water was added with 3.1 ml of a 1 weight % potassium bromide solution, and further added with 3.5 ml of 1 mol/L nitric acid and 31.7 g of phthalized gelatin. Separately, Solution A was prepared by adding distilled water to 22.22 g of silver nitrate to dilute it to 95.4 ml, and Solution B was prepared by diluting 15.9 g of potassium bromide with distilled water to a volume of 97.4 ml. To the aforementioned mixture maintained at 34° C. and stirred in a titanium-coated stainless steel reaction vessel, the whole volume of Solution A and Solution B was added over 45 seconds at a constant flow rate while. Then, the mixture was added with 10 ml of 3.5 weight % aqueous hydrogen peroxide solution, and further added with 10.8 ml of a 10 weight % aqueous solution of benzimidazole. Separately, Solution C was prepared by adding distilled water to 51.86 g of silver nitrate to dilute it to 317.5 ml, and Solution D was prepared by diluting 45.8 g of potassium bromide with distilled water to a volume of 400 ml. The whole volume of Solution C was added to the mixture over 20 minutes at a constant flow rate. Solution D was added by the control double jet method while pAg was maintained at 8.1. Hexachloroiridic acid (III) potassium salt in such an amount that its concentration should become $1\times10^{-4}$ mole per mole of silver was added at one time 10 minutes after the addition of Solutions C and D was started. Further, an aqueous solution of potassium iron(II) hexacyanide in such an amount that its concentration should become $3\times10^{-4}$ mole per mole of silver was added at one time 5 seconds after the addition of Solution C was completed. Then, the mixture was adjusted to pH 3.8 using 0.5 mol/L sulfuric acid, and the stirring was stopped. Then, the mixture was subjected to precipitation, desalting and washing with water, adjusted to pH 5.9 with 1 mol/L sodium hydroxide to form a silver halide dispersion having pAg of 8.0.

The aforementioned silver halide dispersion was added with 5 ml of a 0.34 weight % methanol solution of 1,2-benzisothiazolin-3-one with stirring at 38° C., and after 40 minutes since then, added with a methanol solution of Spectral sensitizing dye A in an amount of $1\times10^{-3}$ mole per mole of silver. After 1 minutes, the mixture was warmed to 47° C., and after 20 minutes, added with $7.6\times10^{-5}$ mole of sodium benzenethiosulfonate per mole of silver. Further after 5 minutes, the mixture was added with Tellurium sensitizer B as a methanol solution in an amount of $1.9\times10^{-5}$ mole per mole of silver followed by ripening for 91 minutes. The mixture was added with 1.3 ml of a 0.8 weight % methanol solution of N,N'-dihydroxy-N"-diethyl-melamine, and 4 minutes later, added with $3.7\times10^{-3}$ mole per mole of silver of 5-methyl-2-mercaptobenzimidazole and $4.9\times10^{-3}$ mole per mole of silver of 1-phenyl-2-heptyl-5-mercapto-1,3,4-triazole as a methanol solution to prepare Silver halide emulsion 1.

The grains in the prepared silver halide emulsion were pure silver bromide grains having a mean diameter as spheres of 0.046 μm and a variation coefficient of 20% for mean diameter as spheres. The grain size and others were obtained from averages for 1000 grains by using an electron microscope. The [100] face ratio of these grains was determined to be 80% by the Kubelka-Munk method.

<<Preparation of Silver Halide Emulsion 2>>

In the same manner as the preparation of Silver halide emulsion 1 except that the liquid temperature upon forming the grains was changed from 34° C. to 49° C., addition time of Solution C was changed to 30 minutes and potassium iron (II) hexacyanide was not used, Silver halide emulsion 2 was prepared. Further, as in the case of Silver halide emulsion 1, the steps of precipitation, desalting, washing with water and dispersion were performed. Furthermore, in the same manner as in the case of Silver halide emulsion 1 except that the addition amount of Spectral sensitizing dye A was changed to $7.5\times10^{-3}$ mole per mole of silver and the addition amount of 1-phenyl-2-heptyl-5-mercapto-1,3,4-triazole was changed to $3.3\times10^{-3}$ mole of per mole of silver, spectral sensitization, chemical sensitization, and addition of 5-methyl-2-mercaptobenzimidazole and 1-phenyl-2-heptyl-5-mercapto-1,3,4-traizole were performed to obtain Silver halide emulsion 2. Emulsion grains of Silver halide emulsion 2 were pure silver bromide cubic grains having a mean grain size of 0.080 μm as spheres and a variation coefficient of 20% for diameter as spheres.

<<Preparation of Silver Halide Emulsion 3>>

In the same manner as the preparation of Silver halide emulsion 1 except that the liquid temperature upon forming the grains was changed from 34° C. to 27° C., Silver halide emulsion 3 was prepared. Further, as in the case of Silver halide emulsion 1, the steps of precipitation, desalting, washing with water and dispersion were performed. Furthermore, in the same manner as in the case of Silver halide emulsion 1 except that the addition amount of Spectral sensitizing dye A solid dispersion (gelatin aqueous solution) was changed to $6\times10^{-3}$ mole per mole of silver and the addition amount of Tellurium sensitizer B was changed to $5.2\times10^{-4}$ mole per mole of silver, Silver halide emulsion 3 was obtained. Emulsion grains of Silver halide emulsion 3 were pure silver bromide cubic grains having a mean grain size of 0.038 μm as spheres and a variation coefficient of 20% for diameter as spheres.

<<Preparation of Mixed Emulsion A for Coating Solution>>

70% by weight of Silver halide emulsion 1, 15% by weight of Silver halide emulsion 2 and 15% by weight of Silver halide emulsion 3 were mixed and added with benzotbiazolium iodide in an amount of $7\times10^{-3}$ mole per mole of silver as a 1 weight % aqueous solution to form Mixed emulsion A for coating solution.

<<Preparation of Solid Microparticle Dispersion of Reducing Agent>>

10 kg of 1,1-bis(2-hydroxy-3,5-dimethylphenyl)-3,5,5-tri-methylhexane as a reducing agent and 10 kg of a 20 weight % aqueous solution of denatured polyvinyl alcohol (Poval MP203, manufactured by Kuraray Co., Ltd.) were added with 16 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 3 hours and 30 minutes. Then, the slurry was added with 0.2 g of benzothiazolinone sodium salt and water so that the concentration of the reducing agent became 25 weight % to obtain a solid microparticule dispersion of reducing agent. The reducing agent particles contained in the dispersion obtained as described above had a median diameter of 0.42 μm and the maximum particle size of 2.0 μm or less. The obtained reducing agent dispersion was filtered through a polypropylene filter having a pore size of 10.0 μm to remove dusts and so forth, and stored.

<<Preparation of Dispersion of Phosphoryl Compound>>

1 kg of triphenylphosphine oxide as a phosphoryl compound and 1 kg of a 20 weight % aqueous solution of denatured polyvinyl alcohol (Poval MP203, manufactured by Kuraray Co., Ltd.) were added with 1.6 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 3 hours and 30 minutes. Then, the slurry was added with 0.2 g of benzothiazolinone sodium salt and water so that the concentration of the phosphoryl compound became 25% by weight to obtain a solid microparticle dispersion of phosphoryl compound. The phosphoryl compound particles contained in the dispersion obtained as described above had a median diameter of 0.45 μm and the maximum particle size of 2.0 μm or less. The obtained reducing agent dispersion was filtered through a polypropylene filter having a pore size of 10.0 μm to remove dusts and so forth, and stored.

<<Preparation of 25 Weight % Dispersion of Organic Polyhalogenated Compound 2>>

A dispersion was prepared in the same manner as the preparation of the 20 weight % dispersion of organic polyhalogenated compound 1 except that 5 kg of tribromomethyl (4-(2,4,6-trimethylphenyl-sulfonyl)phenyl)sulfone was used instead of 5 kg of tribromomethyl-naphthylsulfone, diluted so that the concentration of the organic polyhalogenated compound became 25 weight %, and filtered. The organic polyhalogenated compound particles contained in the organic polyhalogenated compound dispersion obtained as described above had a median diameter of 0.38 μm and the maximum particle size of 2.0 μm or less. The obtained organic polyhalogenated compound dispersion was filtered through a polypropylene filter having a pore size of 3.0 μm to remove dusts and so forth, and stored.

<<Preparation of 30 Weight % Dispersion of Organic Polyhalogenated Compound 3>>

A dispersion was prepared in the same manner as the preparation of the 20 weight % dispersion of organic polyhalogenated compound 1 except that 5 kg of tribromomethylphenylsulfone was used instead of 5 kg of tribromomethylnaphthylsulfone and the amount of the 20 weight % aqueous solution of MP203 was changed to 5 kg, diluted so that the concentration of the organic polyhalogenated compound became 30 weight %, and filtered. The organic polyhalogenated compound particles contained in the organic polyhalogenated compound dispersion obtained as described above had a median diameter of 0.41 μm and the maximum particle size of 2.0 μm or less. The obtained organic polyhalogenated compound dispersion was filtered through a polypropylene filter having a pore size of 3.0 μm to remove dusts and so forth, and stored. The dispersion was stored at 10° C. or less until use.

<<Preparation of Coating Solution for Image-forming Layer (Photosensitive Layer)>>

1.1 g of the 20 weight % dispersion of pigment, 103 g of the dispersion of silver salt of an organic acid, 5 g of the 20 weight % aqueous solution of polyvinyl alcohol (PVA-205, Kuraray Co., Ltd.), 25 g of the 25 weight % dispersion of reducing agent, 9.4 g of dispersion of phosphoryl compound, 16.3 g in total of Polyhalogenated compound dispersion 1, 2 and 3 (weight ratio=5:1:3), 6.2 g of the 10% dispersion of mercapto compound, 106 g of 40 weight % SBR latex subjected to purification by ultrafiltration (UF) and pH adjustment and 18 ml of the 5 weight % solution of phthalazine compound, which were obtained above, were added to 10 g of Mixed emulsion A of silver halide, and mixed sufficiently to prepare a coating solution for image-forming layer. The coating solution was fed as it was to a coating dye in such an amount that the coated amount should be 70 ml/$m^2$.

<<Preparation of Photothermographic Material>>

A sample of the photothermographic material, Sample 202, was prepared in the same manner as in Example 1 except that the aforementioned materials were used.

Samples 201 and 203–218 were prepared in the same manner as Sample 202 except that the kind and amount of the reducing agent and the amount of the phosphoryl compound were changed as shown in Table 2.

Further, Samples 301–316 were similarly prepared by changing the kinds and amounts of the reducing agent and the phosphoryl compound to those mentioned in Table 3.

When a sample was prepared by using a reducing agent different from that of Sample 202, another reducing agent was used instead of 1,1-bis(2-hydroxy-3,5-dimethylphenyl)-3,5,5-trimethylhexane used for the aforementioned 25 weight % dispersion of reducing agent.

Image storability of the samples was evaluated by storing each photosensitive material after heat development at 60° C. and relative humidity of 50% for one day, and measuring change of densities Δ min in blank portions before and after the storage. The results are shown in Tables 2 and 3.

<<Evaluation of Photographic Performance>>

Each photographic material was light-exposed and heat-developed (about 120° C.) by using Fuji Medical Dry Laser Imager FM-DP L (provided with a semiconductor laser of 660 nm, maximum output: 60 mW (IIIB)), and the obtained image was evaluated by using a densitometer. The results are shown in Tables 2 and 3.

TABLE 2

| Sample | Reducing agent | Coated amount | Phosphoryl compound | Coated amount | Heat developability | | Image storability | |
|---|---|---|---|---|---|---|---|---|
| No. | (I) | (relative mol %) | (II) | (relative mol %) | Dmin | Dmax | ΔDmin | Note |
| 201 | (I-1) | 100 | — | — | 0.155 | 3.72 | 0.119 | Comparative |
| 202 | (I-1) | 100 | (II-2) | 50 | 0.152 | 3.71 | 0.055 | Invention |
| 203 | (I-1) | 100 | (II-2) | 100 | 0.150 | 3.70 | 0.032 | Invention |
| 204 | (I-1) | 100 | (II-2) | 150 | 0.149 | 3.65 | 0.019 | Invention |
| 205 | (I-2) | 80 | — | — | 0.153 | 3.71 | 0.098 | Comparative |
| 206 | (I-2) | 80 | (II-2) | 40 | 0.150 | 3.70 | 0.043 | Invention |
| 207 | (I-2) | 80 | (II-2) | 80 | 0.149 | 3.70 | 0.029 | Invention |
| 208 | (I-2) | 80 | (II-2) | 120 | 0.148 | 3.68 | 0.017 | Invention |
| 209 | (I-3) | 50 | — | — | 0.161 | 3.74 | 0.175 | Comparative |
| 210 | (I-3) | 50 | (II-2) | 25 | 0.151 | 3.73 | 0.092 | Invention |
| 211 | (I-3) | 50 | (II-2) | 50 | 0.149 | 3.72 | 0.060 | Invention |
| 212 | (I-3) | 50 | (II-2) | 75 | 0.148 | 3.71 | 0.040 | Invention |
| 213 | (I-3) | 50 | (II-2) | 100 | 0.148 | 3.69 | 0.026 | Invention |
| 214 | (I-4) | 65 | — | — | 0.157 | 3.76 | 0.194 | Comparative |
| 215 | (I-4) | 65 | (II-2) | 33 | 0.150 | 3.75 | 0.088 | Invention |
| 216 | (I-4) | 65 | (II-2) | 65 | 0.148 | 3.74 | 0.047 | Invention |
| 217 | (I-4) | 65 | (II-2) | 98 | 0.146 | 3.72 | 0.032 | Invention |
| 218 | (I-4) | 65 | (II-2) | 130 | 0.145 | 3.70 | 0.019 | Invention |

TABLE 3

| Sample | Reducing agent | Coated amount | Phosphoryl compound | Coated amount | Heat developability | | Image storability | |
|---|---|---|---|---|---|---|---|---|
| No. | (I) | (relative mol %) | (II) | (relative mol %) | Dmin | Dmax | ΔDmin | Note |
| 301 | (I-7) | 90 | — | 90 | 0.153 | 3.75 | 0.139 | Comparative |
| 302 | (I-7) | 90 | (II-1) | 90 | 0.148 | 3.68 | 0.017 | Invention |
| 303 | (I-7) | 90 | (II-6) | 90 | 0.148 | 3.70 | 0.023 | Invention |
| 304 | (I-7) | 90 | (II-8) | 90 | 0.149 | 3.71 | 0.026 | Invention |
| 305 | (I-7) | 90 | (II-2) | 90 | 0.150 | 3.71 | 0.030 | Invention |
| 306 | (I-7) | 90 | (II-22) | 90 | 0.150 | 3.73 | 0.043 | Invention |
| 307 | (I-7) | 90 | (II-25) | 90 | 0.152 | 3.74 | 0.051 | Invention |
| 308 | (I-7) | 90 | (II-24) | 90 | 0.153 | 3.74 | 0.063 | Invention |
| 309 | (I-9) | 60 | — | 60 | 0.157 | 3.77 | 0.165 | Comparative |
| 310 | (I-9) | 60 | (II-1) | 60 | 0.146 | 3.70 | 0.022 | Invention |

TABLE 3-continued

| Sample No. | Reducing agent (I) | Coated amount (relative mol %) | Phosphoryl compound (II) | Coated amount (relative mol %) | Heat developability Dmin | Heat developability Dmax | Image storability ΔDmin | Note |
|---|---|---|---|---|---|---|---|---|
| 311 | (I-9) | 60 | (II-6) | 60 | 0.148 | 3.72 | 0.026 | Invention |
| 312 | (I-9) | 60 | (II-8) | 60 | 0.147 | 3.74 | 0.032 | Invention |
| 313 | (I-9) | 60 | (II-2) | 60 | 0.149 | 3.74 | 0.039 | Invention |
| 314 | (I-9) | 60 | (II-22) | 60 | 0.151 | 3.75 | 0.047 | Invention |
| 315 | (I-9) | 60 | (II-25) | 60 | 0.153 | 3.75 | 0.063 | Invention |
| 316 | (I-9) | 60 | (II-24) | 60 | 0.154 | 3.76 | 0.076 | Invention |

As clearly seen from the results shown in Table 2, by using a reducing agent of the formula (I) and a compound having a phosphoryl group in combination, fog (Dmax) after heat development can be suppressed and increase of Dmin after image storage can be markedly reduced without substantially reducing development density (Dmax) Because (I-3) and (I-4) are highly active, their amounts can be markedly reduced as shown in Table 2. Such highly active reducing agents give strong fog and hence degrade image stability after the treatment. However, by using a phosphoryl compound in combination according to the present invention, the fog can be suppressed, and image stability after the treatment can be markedly improved at the same time.

From the results shown in Table 3, it is also clear that the combination of a reducing agent and a phosphoryl compound is effective for suppression of fog and improvement of image storability.

Example 3

Structures of the compounds used in Example 3 are shown below.

Compound G

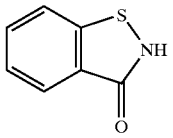

Dye A

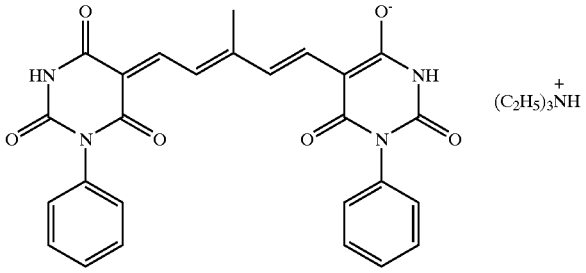

Compound A

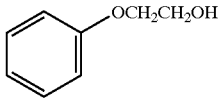

Sensitizing dye A

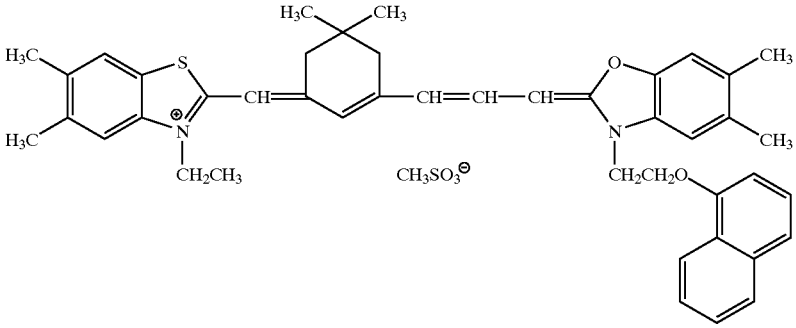

-continued

Compound B

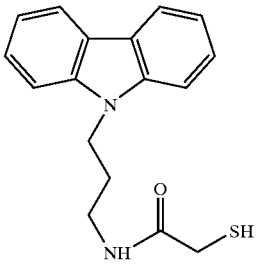

Nucleating agent A

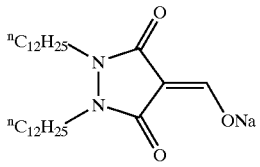

Polyhalogenated compound A

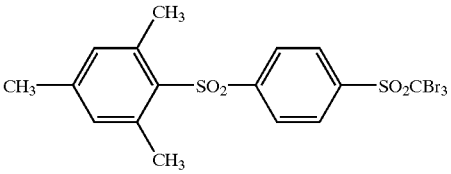

Polyhalogenated compound B

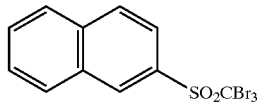

Compound C

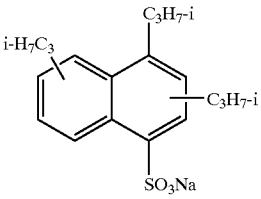

Compound Z

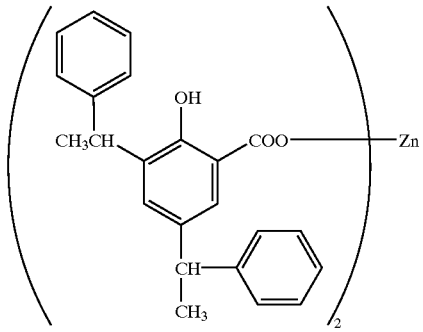

Compound D

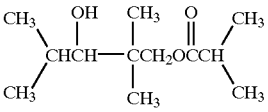

Compound E

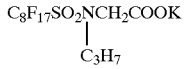

Compound S

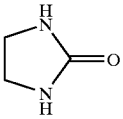

Compound F

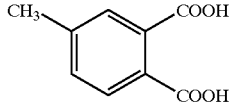

<<Preparation of PET Support>>

Using terephthalic acid and ethylene glycol, PET having an intrinsic viscosity IV of 0. 66 (measured in phenol/tetrachloroethane=6/4 (weight ratio) at 25° C.) was obtained in a conventional manner. The PET was pelletized, and the pellets were dried at 130° C. for 4 hours, melted at 300° C., extruded from a T-die, and quenched to prepare an unstretched film having such a thickness that the film thickness after thermal fixation should become 120 μm.

The film was stretched along the longitudinal direction by 3.3 times using rollers having different peripheral speeds and then stretched along the transverse direction by 4.5 times using a tenter. In this case, the temperatures were 110° C. and 130° C., respectively. Thereafter, the film was subjected to thermal fixation at 240° C. for 20 seconds and relaxed by 4% along the transverse direction at the same temperature. Then, after chucks of the tenter were released, the both edges of the film were knurled, and the film was rolled up at 4.8 kg/cm$^2$ to provide a roll of PET support having a width of 2.4 m, length of 3500 m and thickness of 120 μm.

<<Coating of Undercoat>>

Undercoat layer (a) and Undercoat layer (b) having the following compositions were applied successively on both sides of the PET support obtained above, and each dried at 180° C. for 4 minutes. Thickness of Undercoat layer (a) was 2.0 μm.

| | |
|---|---|
| (1) Composition of Undercoat layer (a) | |
| Polymer latex (A) (core shell type latex comprising 90 wt % of core and 10 wt % of shell, core: vinylidene chloride/methyl acrylate/methyl methacrylate/acrylonitrile/acrylic acid = 93/3/3/0.9/0.1 (wt %), shell: vinylidene chloride/methyl acrylate/methyl methacrylate/acrylonitrile/acrylic acid = 88/3/3/3/3 (wt %), weight average molecular weight; 38000) | 3.0 g/m$^2$ as solid content |
| 2,4-Dichloro-6-hydroxy-S-triazine | 23 mg/m$^2$ |
| Matting agent (polystyrene, mean diameter; 2.4 μm) | 1.5 mg/m$^2$ |
| (2) Composition of Undercoat layer (b) | |
| Deionized gelatin ($Ca^{2+}$ content; 0.6 ppm, jelly strength; 230 g) | 50 mg/m$^2$ |

<<Formation of Back Layer>>

The following electroconductive layer and protective layer were successively applied to one side of the PET support provided with the two undercoat layers obtained above, and each dried at 180° C. for 4 minutes to prepare a back layer.

| (1) Composition of electroconductive layer | |
|---|---|
| Julimer ET-410 (Nihon Junyaku Co., Ltd.) | 96 mg/m$^2$ |
| Alkali-treated gelatin (molecular weight; about 10000, $Ca^{2+}$ content; 30 ppm) | 42 mg/m$^2$ |
| Deionized gelatin ($Ca^{2+}$ content; 0.6 ppm) | 8 mg/m$^2$ |
| Compound G | 0.2 mg/m$^2$ |
| Polyoxyethylene phenyl ether | 10 mg/m$^2$ |
| Sumitex Resin M-3 (water-soluble melamine resin, Sumitomo Chemical Co., Ltd.) | 18 mg/m$^2$ |
| Dye A | Amount giving optical density of 1.2 at 783 nm |
| $SnO_2$/Sb (weight, ratio: 9/1, acicular grains, short axis/long axis = 20–30, Ishihara Sangyo Kaisha, Ltd.) | 160 mg/m$^2$ |
| Matting agent (Polymethyl methacrylate, mean particle size: 5 μm) | 7 mg/m$^2$ |
| (2) Composition of protective layer | |
| Polymer latex (B) (copolymer of methyl methacrylate/styrene/2-ethylhexyl acrylate/2-hydroxyethylethyl methacrylate/acrylic acid = 59/9/26/5/1 (wt %)) | 1000 mg/m$^2$ as solid content |
| Polystyrenesulfonate (molecular weight: 1000–5000) | 2.6 mg/m$^2$ |
| Cellosol 524 (Chukyo Yushi Co., Ltd.) | 25 mg/m$^2$ |
| Sumitex Resin M-3 (water-soluble melamine compound, Sumitomo Chemical Co., Ltd.) | 218 mg/m$^2$ |

<<Heat Treatment During Transportation>>

(1) Heat Treatment

The PET support with back layers and undercoat layers prepared as described above was subjected to heat treatment by introducing it into a heat treatment zone having a total length of 200 m set at 160° C., and transporting it at a tension of 3 kg/cm$^2$ and a transportation speed of 20 m/minute.

(2) Post-heat Treatment

Following the aforementioned heat treatment, the support was passed through a zone at 40° C. for 15 seconds, and rolled up. The rolling up tension for this operation was 10 kg/cm$^2$.

<<Preparation of Coating Solution for Image-forming Layer>>

(1) Preparation of organic acid silver salt dispersion

Behenic acid (87.6 g, product name: Edenor C22–85R, Henkel Corp.), distilled water (423 ml), 5 mol/L NaOH aqueous solution (49.2 ml) and tert-butyl alcohol (120 ml) were mixed and allowed to react at 75° C. for 1 hour with stirring to prepare a sodium behenate solution. Separately, an aqueous solution of (206.2 ml) of silver nitrate (40.4 g) was prepared and maintained at 10° C. A reaction vessel containing distilled water (635 ml) and tert-butyl alcohol (30 ml) were maintained at 30° C., and added with the whole volumes of the sodium behenate solution and the aqueous silver nitrate solution at constant flow rates over 62 minutes and 10 seconds, and 60 minutes, respectively. This operation was designed so that only the aqueous silver nitrate solution was added for 7 minutes and 20 seconds after starting the addition of the aqueous silver nitrate solution. Then, addition of the sodium behenate solution was started so that only the sodium behenate solution was added for 9 minutes and 30 seconds after the completion of the addition of the aqueous silver nitrate solution. During this procedure, the internal temperature of the reaction vessel was maintained at 30° C., and controlled so that the mixture temperature was not raised. Piping of the sodium behenate solution addition system was warmed by a steam tracing, and steam amount was controlled so that the solution temperature at the outlet of addition nozzle tip became 75° C. Further, piping of the aqueous silver nitrate solution addition system consisted of a double pipe system, and was cooled by circulating cooled water outside the double pipe. The addition points of the sodium behenate solution and the aqueous silver nitrate solution were symmetrically located with respect to a stirring axis, and the heights thereof were controlled so as not to contact with the reaction mixture.

After the completion of the addition of the sodium behenate solution, the mixture was left at that temperature for 20 minutes with stirring so that the temperature of the mixture was lowered to 25° C. Thereafter, the solid content was separated by centrifugal filtration, and washed with water until the conductivity of the filtrate became 30 μS/cm. The solid content obtained as described above was not dried but stored as a wet cake.

The shape of the obtained silver behenate grains was analyzed by electron microphotography. The obtained grains were scale crystals having an average projected area diameter of 0.52 μm, an average grain thickness of 0.14 μm, and a variation coefficient of 15% for average diameter as spheres.

To the wet cake corresponding to 100 g of dry solid content, 7.4 g of polyvinyl alcohol (trade name: PVA-217, average polymerization degree: about 1700) and water were added to make the total amount 385 g, and the resulting mixture was preliminarily dispersed in a homomixer. Then, the preliminarily dispersed stock solution was treated three times in a dispersing machine (trade name: Microfluidizer M-110S-EH, manufactured by Microfluidex International Corporation, using G10Z interaction chamber) under a pressure controlled to be 1,750 kg/cm$^2$ to obtain a silver behenate dispersion as organic acid silver salt dispersion. During the cooling operation, a desired dispersion temperature was established by providing coiled heat exchangers fixed before and after the interaction chamber and controlling the temperature of the refrigerant.

The silver behenate grains contained in the silver behenate dispersion obtained as described above were grains having a volume weighted mean diameter of 0.52 μm, and a variation coefficient of 15%. The grain size was measured by Master Sizer X manufactured by Malvern Instruments Ltd. Further, when the grains were evaluated by electron microphotography, they were grains having a ratio of long axis length and short axis length of 1.5, a grain thickness of 0.14 μm, and an average aspect ratio (ratio of circular diameter of projected area of grain and grain thickness) of 5.1.

(2) Preparation of Photosensitive Silver Halide Emulsion

In 700 ml of water, alkali-treated gelatin (calcium content: 2700 ppm or less, 11 g), potassium bromide (30 mg) and sodium benzenethiosulfonate (10 mg) were dissolved. After the solution was adjusted-to pH 5.0 at a temperature of 40° C., 159 ml of an aqueous solution containing silver nitrate (18.6 g) and an aqueous solution containing 1 mol/l of potassium bromide, $5\times10^{-6}$ mol/l of $(NH_4)_2RhCl_5(H_2O)$ and $2\times10^{-5}$mol/l of $K_3IrCl_6$ were added by the control double jet method over 6 minutes and 30 seconds while pAg was maintained at 7.7. Then, 476 ml of an aqueous solution containing silver nitrate (55.5 g) and an aqueous solution containing 1 mol/l of potassium bromide and $2\times10^{-5}$ mol/l of $K_3IrCl_6$ were added by the control double jet method over 28 minutes and 30 seconds while pAg was maintained at 7.7.

Then, the pH was lowered to cause coagulation precipitation to effect desalting, Compound A (0.17 g) and low molecular weight gelatin having an average molecular weight of 15,000 (calcium content: 20 ppm or less, 51.1 g) were added, and pH and pAg were adjusted to 5.9 and 8.0, respectively. The grains obtained were cubic grains having an average grain size of 0.08 μm, a variation coefficient of 9% for projected area and a [100] face ratio of 90%.

The temperature of the photosensitive silver halide grains obtained as described above was raised to 60° C., and added with sodium benzenethiosulfonate (76 μmol per mole of silver). After 3 minutes, triethylthiourea (71 μmol) was further added, the grains were ripened for 100 minutes, then added with $5\times10^{-4}$ mol/l of 4-hydroxy-6-methyl-1,3,3a,7-tetrazaindene, and cooled to 40° C. Then, Sensitizing Dye A and Compound B were added in amounts of $12.8\times10^{-4}$ mol and $6.4\times10^{-3}$ mol per mole of the photosensitive silver halide with stirring while the emulsion was maintained at 40° C. After 20 minutes, the emulsion was quenched to 30° C. to complete the preparation of photosensitive silver halide emulsion.

(3) Preparation of Solid Microparticle Dispersion of Ultrahigh Contrast Agent

An ultrahigh contrast agent (Nucleating agent A, 10 g) was added with polyvinyl alcohol (2.5 g, PVA-217, produced by Kuraray Co., Ltd.) and water (87.5 g), and the mixture was thoroughly stirred to form slurry. The slurry was left for 3 hours. Then, 0.5-mm zirconia beads (240 g) were prepared and put together with the slurry into a vessel. The contents in the vessel were dispersed in a dispersing machine (¼G Sand Grinder Mill, manufactured by Imex Co.) for 10 hours to prepare a solid microparticle dispersion. In this dispersion, 80 wt % of the microparticles had a particle size of from 0.1 to 1.0 μm, and the average particle size was 0.5 μm.

(4) Preparation of Solid Microparticle Dispersion of Reducing Agent

To 1,1-bis(2-hydroxy-3,5-dimethylphenyl)-3,5,5-trimethylhexane (25 g), a 20 weight % aqueous solution of MP Polymer (25 g, MP-203, produced by Kuraray Co., Ltd.), Safinol 104E (Nisshin Kagaku Co., Ltd., 0.1 g), methanol (2 g) and water (48 ml) were added, and the mixture was thoroughly stirred to form slurry. The resulting slurry was left for 3 hours. Then, 1-mm zirconia beads (360 g) were prepared and put together with the slurry into a vessel. The contents in the vessel were dispersed in a dispersing machine (¼G Sand Grinder Mill, manufactured by Imex Co.) for 3 hours to prepare a solid microparticle dispersion of reducing agent. In this dispersion, 80 weight % of the grains had a particle size of from 0.3 to 1.0 μm.

(5) Preparation of Solid Microparticle Dispersion of Polyhalogenated Compound

Polyhalogenated compound A (30 g) was added with MP Polymer (4 g, MP-203, produced by Kuraray Co., Ltd.), Compound C (0.25 g) and water (66 g), and the mixture was thoroughly stirred to form slurry. Then, 0.5-mm zirconia silicate beads (200 g) were put together with the slurry into a vessel. The contents in the vessel were dispersed in a dispersing machine (1/16G Sand Grinder Mill, manufactured by Imex Co.) for 5 hours to prepare a dispersion of Polyhalogenated compound A. In this dispersion, 80 weight % of the microparticles had a particle size of from 0.3 to 1.0 μm.

A solid microparticle dispersion of Polyhalogenated compound B was also prepared in the same manner as that for Polyhalogenated compound A. The microparticles in this dispersion had a similar particle size.

(6) Preparation of Solid Microparticle Dispersion of Zinc Compound

Compound Z (30 g) was added with MP Polymer (3 g, MP-203, produced by Kuraray Co., Ltd.) and water (87 ml), and the mixture was thoroughly stirred to form slurry. The slurry was left for 3 hours. Then, the slurry was treated in the same manner as the preparation of the solid microparticle dispersion of reducing agent mentioned in the above (4) to prepare a solid microparticle dispersion of zinc compound (Compound Z). In this dispersion, 80 weight % of the microparticles had a particle size of from 0.3 to 1.0 μm.

(7) Preparation of Coating Solution for Image-forming Layer

The following components were added to the dispersion of silver salt of an organic acid (silver behenate) prepared in the above (1) in the specified amounts per 1 mole of silver in the dispersion, and added with water to prepare a coating solution for image-forming layer.

| | |
|---|---|
| Photosensitive silver halide emulsion obtained in the above (2) | 0.05 mole as Ag |
| Solid microparticle dispersion of nucleating agent obtained in the above (3) | 17.1 g as solid |
| Solid microparticle dispersion of reducing agent obtained in the above (4) | 166 g as solid |
| Polyhalogenated compound dispersion A obtained in the above (5) | 0.06 mole as solid |
| Polyhalogenated compound dispersion B obtained in the above (5) | 0.02 mole as solid |
| Solid microparticle dispersion of zinc compound obtained in the above (6) | 10.5 g as solid |
| Binder: LACSTAR 3307B (SBR latex, produced by Dai-Nippon Ink & Chemicals, Inc., glass transition temperature: 17° C.) | 470 g as solid |
| Sodium ethanethiosulfonate | 2.2 mmole |
| 5-Methylbenzotriazole | 1.36 g |
| Polyvinyl alcohol (PVA-235, Kuraray Co., Ltd.) | 12.1 g |
| 6-Isopropylphthalazine | 16.5 g |
| Sodium dihydrogenorthophosphate dihydrate | 0.37 g |
| Dye A | Amount giving optical density of 0.3 at 783 nm (about 0.50 g) |

<<Preparation of Coating Solution for Protective Layers on Image-forming Side>>

(1) Preparation of Coating Solution for Protective Layer (a) on Image-forming Side A polymer latex solution containing copolymer of methyl methacrylate/styrene/2-ethylhexyl acrylate/2-hydroxyethyl methacrylate/acrylic acid=58.9/8.6/25.4/5.1/2 (wt %) (glass transition temperature: 57° C., solid content: 21.5 weight %, average particle diameter: 120 nm, containing Compound D as a film-forming aid in an amount of 15 weight % relative to solid content of the latex, 956 g) was added with water, Compound E (1.62 g), Compound S (3.15 g), matting agent (polystyrene particles, average diameter: 7 μm, variation coefficient of 8% for average particle size, 1.98 g) and polyvinyl alcohol (PVA-235, Kuraray Co., Ltd., 23.6 g) and further added with water to form a coating solution for protective layer (a) on image-forming side.

(2) Preparation of Coating Solution for Protective Layer (b) on Image-forming Side A polymer latex solution containing copolymer of methyl methacrylate/styrene/2-ethylhexyl acrylate/2-hydroxyethyl methacrylate/acrylic acid=58.9/8.6/25.4/5.1/2 (wt %) (glass transition temperature: 54° C., solid content: 21.5 weight %, average particle diameter: 70 nm, containing Compound D shown in (6-1) as a film-forming aid in an amount of 15 weight % relative to solid content of the latex, 630 g) was added with water, 30 weight % solution of carnauba wax (Cellosol 524, Chukyo Yushi Co., Ltd., 6.30 g), Compound E (0.72 g), Compound F (7.95 g), Compound S (0.90 g), which were mentioned in the above (1), matting agent (polystyrene particles, average diameter: 7 μm, 1.18 g) and polyvinyl alcohol (PVA-235, Kuraray Co., Ltd., 8.30 g) and further added with water to form a coating solution for protective layer (b) on image-forming side.

<<Preparation of Photothermographic Material>>

On the side opposite to the side provided with the back layer of the aforementioned PET support subjected to the heat treatment during transportation, i.e., the side of the support coated with Undercoat layer (a) and Undercoat layer (b), the coating solution for image-forming layer was coated so that the coated silver amount became 1.6 g/m$^2$. Further, the coating solution for Protective layer (a) for image-forming surface was coated on the image-forming layer simultaneously with the coating solution for image-forming layer as laminated layers, so that the coated solid content of the polymer latex became 1.31 g/m$^2$. Then, the coating solution for Protective layer (b) for image-forming surface was coated on the coated layer, so that the coated solid content of the polymer latex became 3.02 g/m$^2$ to prepare a photothermographic material. The film surface pH of the obtained photothermographic material on the image-forming side was 4.9, and the Beck's smoothness was 660 seconds. As for the opposite surface, the film surf-ace pH was 5.9 and the Beck's smoothness was 560 seconds.

Samples were prepared with various kinds and coated amounts of phenolic reducing agents (compounds of the formula (I)) and compounds of the formulas (II), (III), (IV) and (V) as in Example 1 so that the samples gave substantially comparative development density to the above sample, and they are evaluated for image storability.

<<Evaluation>>

(1) Light Exposure

Each photothermographic material was light exposed for $2\times10^{-8}$ seconds by using a laser light-exposure apparatus of single channel cylindrical inner surface type provided with a semiconductor laser with a beam diameter (½ of FWHM of beam intensity) of 12.56 μm, laser output of 50 mW and output wavelength of 783 nm. The exposure time was adjusted by controlling the mirror revolution number, and exposure was adjusted by changing output. The overlap coefficient of the light exposure was 0.449.

(2) Heat Development

The light-exposed photothermographic material obtained in the above (1) was heat-developed by using a heat-developing apparatus as shown in FIG. 1, in which the roller surface material of the heat development section was composed of silicone rubber, and the flat surface consisted of Teflon non-woven fabric. The heat development was performed at a transportation linear speed of 20 mm/second in the preheating section at 90–110° C. for 15 seconds (driving units of the preheating section and the heat development section were independent from each other, and speed difference as to the heat development section was adjusted to −0.5% to −1%), in the heat development section at 120° C. for 20 seconds, and in the gradual cooling section for 15 seconds. The temperature precision as for the transverse direction was ±1° C.

(3) Evaluation of Heat-developed Image Storability After Storage in Dark Place

The photothermographic materials subjected to light exposure and heat development were evaluated in the same manner as in Example 1.

As a result, it became clear that the photothermographic materials of the present invention showed more superior performance compared with comparative examples, and even ultrahigh contrast photothermographic materials showed superior image storability comparable to that observed in Example 1.

Example 4

Fourteen kinds of photothermographic materials were prepared by replacing Compound (II-2) in Sample 102 with an equimolar amount of each of the compounds mentioned in Table 4. Each photothermographic material was evaluated for image storability (ΔDmin) in the same manner as in Example 1 The results are shown in Table 4.

TABLE 4

| Sample No. | Compound used in combination with reducing agent | Image storability ΔDmin | Note |
|---|---|---|---|
| 401 | II-56 | 0.039 | Invention |
| 402 | II-57 | 0.034 | Invention |
| 403 | II-58 | 0.030 | Invention |
| 404 | II-61 | 0.022 | Invention |
| 405 | II-62 | 0.018 | Invention |
| 406 | II-64 | 0.029 | Invention |
| 407 | II-66 | 0.040 | Invention |
| 408 | II-69 | 0.020 | Invention |
| 409 | II-71 | 0.027 | Invention |
| 410 | II-77 | 0.039 | Invention |
| 411 | II-81 | 0.028 | Invention |
| 412 | II-84 | 0.037 | Invention |
| 413 | II-85 | 0.034 | Invention |
| 414 | II-88 | 0.037 | Invention |

When a phosphoryl compound having a substituent at the o-position of phenyl group was used, superior image storability was obtained.

Example 5

A sample of photothermographic material, Sample 501, was prepared in the same manner as that for Sample 105 prepared in Example 1, except that the SBR latex used for the photosensitive layer of Sample 105 in Example 1 was replaced with the same weight of latex of styrene (70.5)/butadiene (26.5)/acrylic acid (3) copolymer (Tg: 23° C., average particle size: 92 nm).

The surface condition of the coated sample was confirmed to be transparent by visual observation. In Sample 502, which correspond to Sample 501 not containing Compound (II-2), it was confirmed that the film-forming property and transparency were degraded and haze was increased because a high Tg binder was used. Therefore, it was confirmed that Compound (II-2) also played a role of a placticizer.

Change of color tone in Samples 501 and 502 was also evaluated.

<<Evaluation of Color Tone>>

Each photographic material was light-exposed and heat-developed (about 120° C.) by using Fuji Medical Dry Laser Imager FM-DP L (provided with a semiconductor laser of 660 nm, maximum output: 60 mW (IIIB)), and visible absorption spectrum of a portion having a density of 1.0 in the obtained image was determined to obtain chromaticity coordinates in the L*a*b* color space using an F2 fluorescent lamp as a light source. Then, the sample after the treatment was left for one day under fluorescent lighting (1000 lux, 30° C., 80%), and the chromaticity coordinates were determined for the same portion as the portion where the chromaticity coordinates were obtained before irradiation. Color difference ΔEab* before and after the irradiation of fluorescent lighting to obtain the magnitude of color tone change caused by the irradiation of fluorescent lighting. If the value of Sample 502 was taken as 100, the value of Sample 501 was 30. Thus, it was confirmed that the change in color tone was also reduced by using a compound of the present invention.

Example 6

The photothermographic material of Example 2 according to the present invention was cut into sheets of B4 size, and 151 sheets of photothermographic material 1 in B4 size were stacked, packaged with an inner packaging material made of polypropylene, and further packaged with an outer packaging material composed of an aluminum sheet coated with polypropylene over the outside of the inner packaging material as shown in FIG. 2. The air space was adjusted to be 33% or 10% by controlling the gas sucking pressure when the inner packaging material was packaged with the outer packaging material.

The space ratio was calculated as follows. The volume of the outer packaging material (A) was obtained by immersing the packaged material in water. Then, the packaged material was opened, and the specific gravity of the inner packaging material was obtained to calculate its volume (B) . Finally, from the thickness of the stacked photosensitive material (C) and the area of the sheets (D), the volume of the photothermographic material was obtained (E=D×C), and the space ratio was obtained as a value of (A−B−E)/A×100). Further, the packaging with the outer packaging material was performed under a nitrogen partial pressure of 80% so that the nitrogen partial pressure in the outer packaging material became 80%. Further, the packaging was performed so that the humidity in the package was 40% RH by selecting the atmosphere. The humidity in the package was measured by using a hygrometer inserted into a small hole opened in the outer packaging material after the photosensitive material was left at 25° C. for 10 days.

Then, the material was stored in the aforementioned state at 40° C. for 10 days. The photothermographic materials before and after the storage were light-exposed and heat-developed (about 120° C.) by using Fuji Medical Dry Laser Imager FM-DP L (provided with a semiconductor laser of 660 nm, maximum output: 60 mW (IIIB)), and the obtained images were evaluated by using a densitometer.

Change in the optical density before and after the storage was calculated. As a result, it was found that a smaller space ratio gave a smaller change in optical density.

What is claimed is:

1. A photothermographic material comprising, on one side of a support, a photosensitive silver halide, a non-photosensitive silver salt of an organic acid, a reducing agent for silver ions and a binder, which is characterized by containing at least one o-polyphenol compound as the reducing agent, and one or more compounds having a phosphoryl group in combination with said o-polyphenol compound, wherein the compound having a phosphoryl group is a compound represented by the following formula (VI):

(VI)

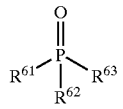

wherein $R^{61}$, $R^{62}$ and $R^{63}$ independently represent an alkyl group, an aryl group, an aralkyl group, an alkoxy group, an aryloxy group, an amino group or a heterocyclic group.

2. The photothermographic material according to claim 1, wherein the o-polyphenol compound is a compound represented by the following formula (I):

(I)

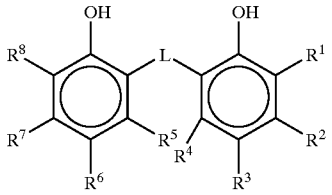

wherein $R^1$, $R^2$, $R^3$, $R^4$, $R^5$, $R^6$, $R^7$ and $R^8$ independently represent a hydrogen atom or a group that can substitute on a benzene ring, and L represents a group —S— or a group —$CHR^9$— where $R^9$ represents a hydrogen atom or an alkyl group.

3. The photothermographic material according to claim 3, wherein, in the compound represented by the formula (I), $R^2$, $R^4$, $R^5$ and $R^7$ are hydrogen atoms, $R^1$ and $R^8$ independently represents an alkyl group, $R^3$ and $R^6$ independently represents an alkyl group, and L is —$CHR^9$—.

4. The photothermographic material according to claim 3, wherein $R^1$ and $R^8$ independently represent a secondary or tertiary alkyl group.

5. The photothermographic materials of claim 1, wherein the amount of the o-polyphenol compound is 0.01–4.0 g/$m^2$.

6. The photothermographic materials of claim 1, wherein the amount of the phosphoryl compound is 0.01–4.0 g/$m^2$.

* * * * *